US011738958B2

(12) United States Patent
Uegane et al.

(10) Patent No.: US 11,738,958 B2
(45) Date of Patent: Aug. 29, 2023

(54) RECORDING MATERIAL PROCESSING APPARATUS AND IMAGE FORMING SYSTEM

(71) Applicant: FUJIFILM Business Innovation Corp., Tokyo (JP)

(72) Inventors: Takumi Uegane, Kanagawa (JP); Mitsuhiro Nakamura, Kanagawa (JP); Masashi Matsumoto, Kanagawa (JP); Takayuki Uchiyama, Kanagawa (JP); Satoko Monoe, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/709,422

(22) Filed: Mar. 31, 2022

(65) Prior Publication Data

US 2022/0340386 A1 Oct. 27, 2022

(30) Foreign Application Priority Data

Apr. 27, 2021 (JP) ..... 2021-075429
Nov. 19, 2021 (JP) ..... 2021-189001

(51) Int. Cl.
*B65H 37/04* (2006.01)
*B65H 5/20* (2006.01)
(Continued)

(52) U.S. Cl.
CPC ..... *B65H 5/20* (2013.01); *B65H 37/04* (2013.01); *B65H 37/06* (2013.01);
(Continued)

(58) Field of Classification Search
CPC ..... B65H 37/04; B65H 2301/51616; B65H 2301/43828; B31F 5/02; B31F 2201/0754;
(Continued)

(56) References Cited

U.S. PATENT DOCUMENTS 3,106,139 A * 10/1963 Leopoldi ..... B31F 5/02 493/393
9,090,051 B2 7/2015 Takahashi et al.
(Continued)

FOREIGN PATENT DOCUMENTS

JP 2014118300 6/2014
JP 2014148398 8/2014
(Continued)

*Primary Examiner* — Leslie A Nicholson, III
(74) *Attorney, Agent, or Firm* — JCIPRNET

(57) ABSTRACT

A recording material processing apparatus includes first teeth that are used for binding processing of a recording material bundle; second teeth that move toward the first teeth and press the recording material bundle located between the first teeth and the second teeth; a guide portion that guides an interlocking portion interlocking with the second teeth; and a guided portion that is provided in the interlocking portion and guided by the guide portion, in which one of the guide portion and the guided portion includes a hole, and the other includes a rod-shaped portion that extends in a movement direction of the interlocking portion and comes into contact with an inner surface of the hole.

20 Claims, 25 Drawing Sheets

(51) Int. Cl.
*B65H 37/06* (2006.01)
*G03G 15/00* (2006.01)

(52) U.S. Cl.
CPC ..... *G03G 15/6541* (2013.01); *B65H 2403/40* (2013.01); *B65H 2403/541* (2013.01)

(58) Field of Classification Search
CPC ..... B31F 1/07; G03G 15/6544; G03G 2215/00852
USPC ..... 270/58.07, 58.08
See application file for complete search history.

(56) References Cited

U.S. PATENT DOCUMENTS

| | | | | |
|---|---|---|---|---|
| 9,254,621 | B2 * | 2/2016 | Takahashi | B31F 5/02 |
| 10,406,772 | B2 * | 9/2019 | Takahashi | B42C 1/12 |
| 10,539,914 | B2 * | 1/2020 | Awano | B42B 4/00 |
| 10,654,240 | B2 * | 5/2020 | Takahashi | B65H 37/04 |
| 10,926,970 | B2 | 2/2021 | Tanoue et al. | |
| 10,981,747 | B2 * | 4/2021 | Kobayashi | B42B 5/00 |
| 2012/0213612 | A1 * | 8/2012 | Wu | B42F 3/003 412/16 |
| 2015/0314626 | A1 * | 11/2015 | Kushida | B65H 37/04 412/38 |
| 2018/0273336 | A1 * | 9/2018 | Sato | B65H 37/04 |

FOREIGN PATENT DOCUMENTS

| | | |
|---|---|---|
| JP | 2015229262 | 12/2015 |
| JP | 2019163123 | 9/2019 |
| JP | 2020093929 | 6/2020 |
| JP | 2020097478 | 6/2020 |

* cited by examiner

RECORDING MATERIAL PROCESSING APPARATUS AND IMAGE FORMING SYSTEM

CROSS-REFERENCE TO RELATED APPLICATIONS

This application is based on and claims priority under 35 USC 119 from Japanese Patent Application No. 2021-189001 filed Nov. 19, 2021 and Japanese Patent Application No. 2021-075429 filed Apr. 27, 2021.

BACKGROUND

(i) Technical Field

The present invention relates to a recording material processing apparatus and an image forming system.

(ii) Related Art

JP2015-229262A discloses a sheet processing apparatus including fixing means for fixing second teeth, which has moved to a position where the second teeth meshes with first teeth, to second support means.

JP2014-148398A discloses a paper binding device having a first link member having one end rotatably connected to a movable crimping member and a second link member having one end rotatably connected to a fixing member fixed to a device body.

SUMMARY

In binding processing for a recording material bundle, for example, the teeth may be advanced to the recording material bundle, the teeth may be pushed against the recording material bundle, and the binding processing of the recording material bundle is performed.

Here, in a case where the behavior of the teeth is unstable when the teeth move toward the recording material bundle, problems such as a decrease in the reliability of the binding are likely to occur.

Aspects of non-limiting embodiments of the present disclosure relate to a recording material processing apparatus and an image forming system that stabilize binding processing for a recording material bundle as compared to a case where a guide portion for guiding an interlocking portion interlocking with teeth is not provided.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a recording material processing apparatus including first teeth that are used for binding processing of a recording material bundle; second teeth that move toward the first teeth and press the recording material bundle located between the first teeth and the second teeth; a guide portion that guides an interlocking portion interlocking with the second teeth; and a guided portion that is provided in the interlocking portion and guided by the guide portion, in which one of the guide portion and the guided portion includes a hole, and the other includes a rod-shaped portion that extends in a movement direction of the interlocking portion and comes into contact with an inner surface of the hole.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments of the present invention will be described in detail with reference to the accompanying drawings.

Figure 1:
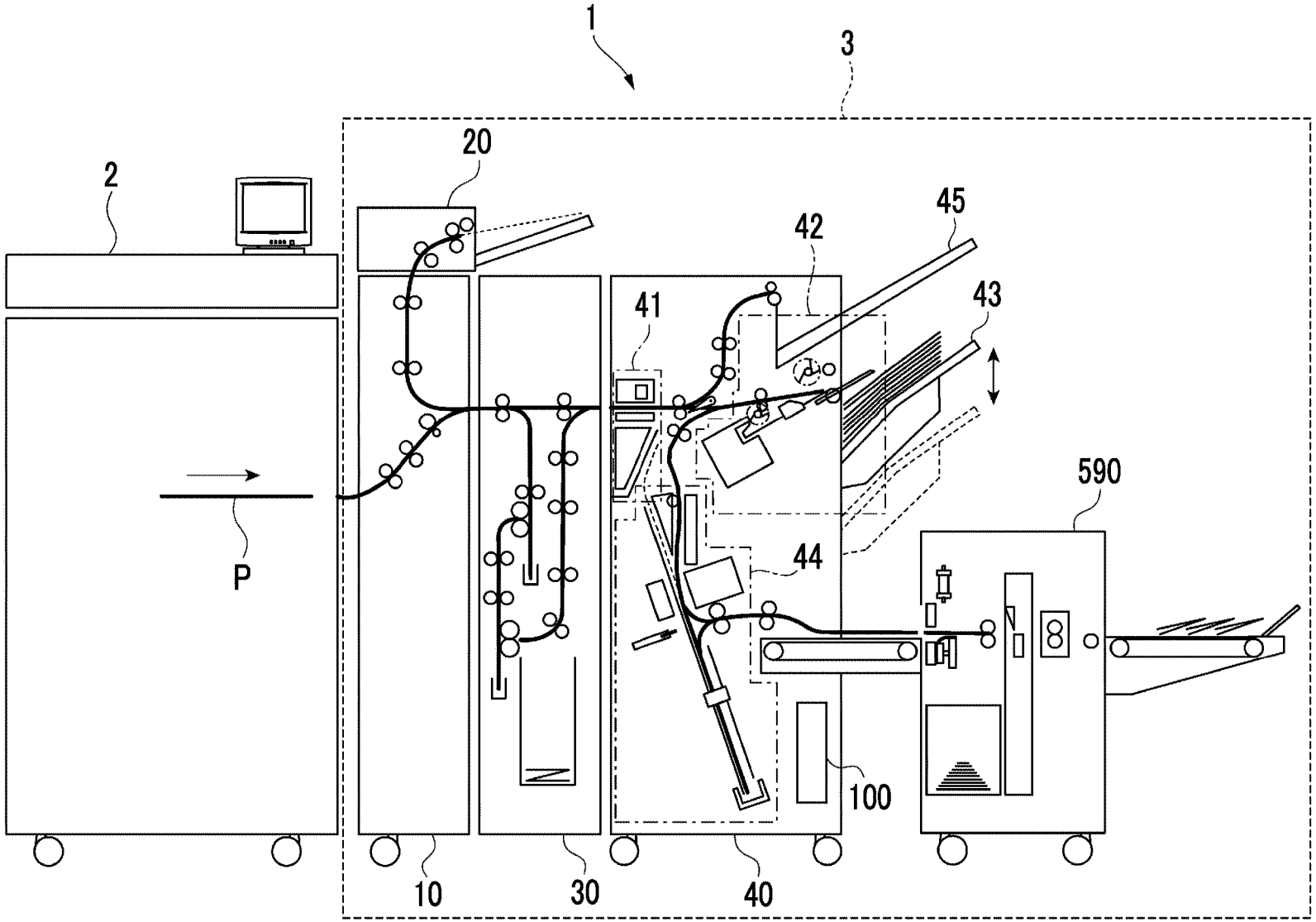
FIG. 1 is a diagram illustrating an overall configuration of an image forming system.

FIG. 1 is a diagram illustrating an overall configuration of an image forming system 1.

The image forming system 1 illustrated in FIG. 1 includes an image forming apparatus 2 that forms an image on paper P as an example of a recording material and the paper processing apparatus 3 that perform predetermined processing on the paper P on which the image has been formed by the image forming apparatus 2.

Here, the image forming apparatus 2 forms the image on the paper P by using an electrophotographic method or an ink jet method.

The paper processing apparatus 3 as an example of a recording material processing apparatus is provided a transport device 10 that transports the paper P output from the image forming apparatus 2 to the downstream side, and an interleaf paper supply device 20 that supplies interleaf paper such as thick paper or paper P with a window to the paper P transported by the transport device 10.

Additionally, the paper processing apparatus 3 is provided with a folding device 30 that performs folding processing such as inner tri-folding (C-folding) or outer tri-folding (Z-folding) on the paper P transported from the transport device 10.

Additionally, the paper processing apparatus 3 is provided with a first post-processing device 40 that is provided on the downstream side of the folding device 30 and that performs punching, end binding, saddle binding, and the like on the paper P.

In addition, the first post-processing device 40, which performs processing on a paper bundle (an example of a recording material bundle) including a plurality of sheets of paper P on which images are formed by the image forming apparatus 2 and performs processing for the paper P on each sheet of paper P, is provided on the downstream side of the folding device 30.

Additionally, the paper processing apparatus 3 is provided with a second post-processing device 590 that is provided on the downstream side of the first post-processing device 40 and further performs processing on the paper bundle that is center-folded or saddle-bounded.

Additionally, the paper processing apparatus 3 is provided with a control unit 100 constituted by a central processing unit (CPU) that executes a program and controls the entire paper processing apparatus 3.

The first post-processing device 40 is provided with a punching unit 41 that performs punching the paper P and an end-binding stapler unit 42 that binds the end of the paper bundle.

Additionally, a first stacking part 43 on which the paper P that has passed through the end-binding stapler unit 42 is stacked, and a second stacking part 45 on which the paper P on which the processing in the first post-processing device 40 is not performed or the paper P on which only the punching is performed is stacked are provided.

Moreover, the first post-processing device 40 is provided with a saddle binding unit 44 that center-fold or saddle-binds the paper bundle to produce a spread-like booklet.

Figure 2:
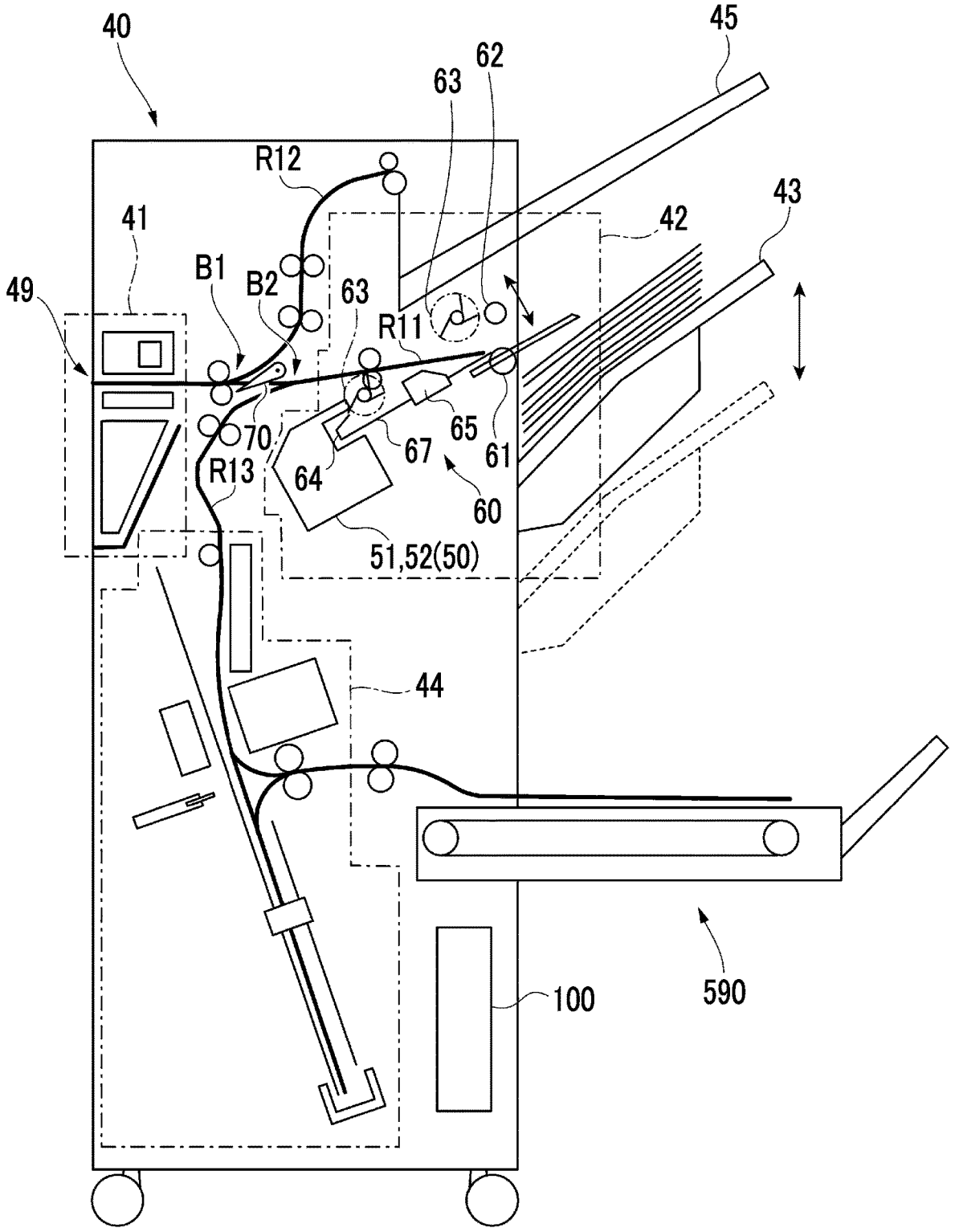
FIG. 2 is a diagram illustrating a configuration of a first post-processing device.

FIG. 2 is a diagram illustrating the configuration of the first post-processing device 40.

The first post-processing device 40 is provided with a receiving port 49 that receives the paper P transported from the folding device 30.

The punching unit 41 is provided immediately behind the receiving port 49. The punching unit 41 performs punching for two or four holes on the paper P transported to the first post-processing device 40.

Additionally, a first paper transport route R11, which is provided from the receiving port 49 to the end-binding stapler unit 42 and is used for transporting the paper P received at the receiving port 49 to the end-binding stapler unit 42, is provided.

Moreover, a first branch part B1 is provided with a second paper transport route R12 that branches from the first paper transport route R11 and is used for transporting the paper P to the second stacking part 45.

Additionally, a second branch part B2 is provided with a third paper transport route R13 that branches from the first paper transport route R11 and is used for transporting the paper P to the saddle binding unit 44.

Additionally, a switching gate 70 that switches (sets) a transport destination of the paper P to any one of the first paper transport route R11 to the third paper transport route R13 is provided.

The end-binding stapler unit 42 is provided with the paper stacking section 60 that stacks a required number of sheets of paper P to generate the paper bundle.

The paper stacking section 60 is provided with a support plate 67 that is disposed to be inclined with respect to the horizontal direction and supports the transported paper P from below. In the present exemplary embodiment, the paper bundle is generated on the support plate 67.

Moreover, the end-binding stapler unit 42 is provided with a binding processing device 50 that executes binding (end binding) on an end part of the paper bundle generated at the paper stacking section 60.

In addition, in the present exemplary embodiment, as will be described below, two binding processing devices 50 are provided, including a first binding processing device that performs binding processing using staples and a second binding processing device 52 that performs binding processing without using staples.

Additionally, the end-binding stapler unit 42 is provided with a transport roll 61 that performs rotational driving and delivers the paper bundle generated at the paper stacking section 60 to the first stacking part 43.

Moreover, a movable roll 62 is provided that is movable to a position where the movable roll has retreated from the transport roll 61 and a position where the movable roll is brought into pressure contact with the transport roll 61.

Here, in a case where the processing is performed by the end-binding stapler unit 42, first, the transported paper P is received at the receiving port 49.

Thereafter, the paper P is transported along the first paper transport route R11 and reaches the end-binding stapler unit 42.

Then, the paper P is transported to a position above the support plate 67 and then falls onto the support plate 67.

Additionally, the paper P is supported from below by the support plate 67 and slidingly moves on the support plate 67 by the inclination given to the support plate 67 and a rotating member 63.

Thereafter, the paper P bumps against an end guide 64 attached to an end part of the support plate 67. In addition, in the present exemplary embodiment, the end part of the support plate 67 is provided with the end guide 64 extending upward in the drawing, and the paper P that has moved on the support plate 67 bumps against the end guide 64.

Accordingly, in the present exemplary embodiment, the movement of the paper P is stopped. Thereafter, this operation is performed whenever the paper P is transported from the upstream side, and the paper bundle in which the paper P is aligned is generated on the support plate 67.

In addition, in the present exemplary embodiment, a paper width position alignment member 65 that aligns the position of the paper bundle in the width direction is further provided.

In the present exemplary embodiment, whenever the paper P is supplied onto the support plate 67, an end part (side portion) of the paper P in the width direction is pressed by the paper width position alignment member 65, and the position of the paper P (paper bundle) in the width direction is also aligned.

In a case where a predetermined number of sheets of paper P are stacked on the support plate 67, the first binding processing device 51 and the second binding processing device 52 execute binding on the end part of the paper bundle.

In addition, the first binding processing device 51 executes binding by driving metallic staples (U-shaped needles) into the paper bundle. Additionally, the second binding processing device 52 executes binding by sandwiching the paper bundle between two binding teeth and pressure-bonding paper sheets constituting the paper bundle to each other.

Thereafter, in the present exemplary embodiment, the movable roll 62 advances toward the transport roll 61, and the paper bundle is sandwiched between the movable roll 62 and the transport roll 61. Thereafter, the transport roll perform rotational driving, and the paper bundle is transported to the first stacking part 43.

In addition, the first binding processing device 51 and the second binding processing device 52 are provided so as to be movable toward the far side and the near side of the paper plane in the drawing, and in the present exemplary embodiment, the binding processing on the paper P can be performed in a plurality of points.

Figure 3:
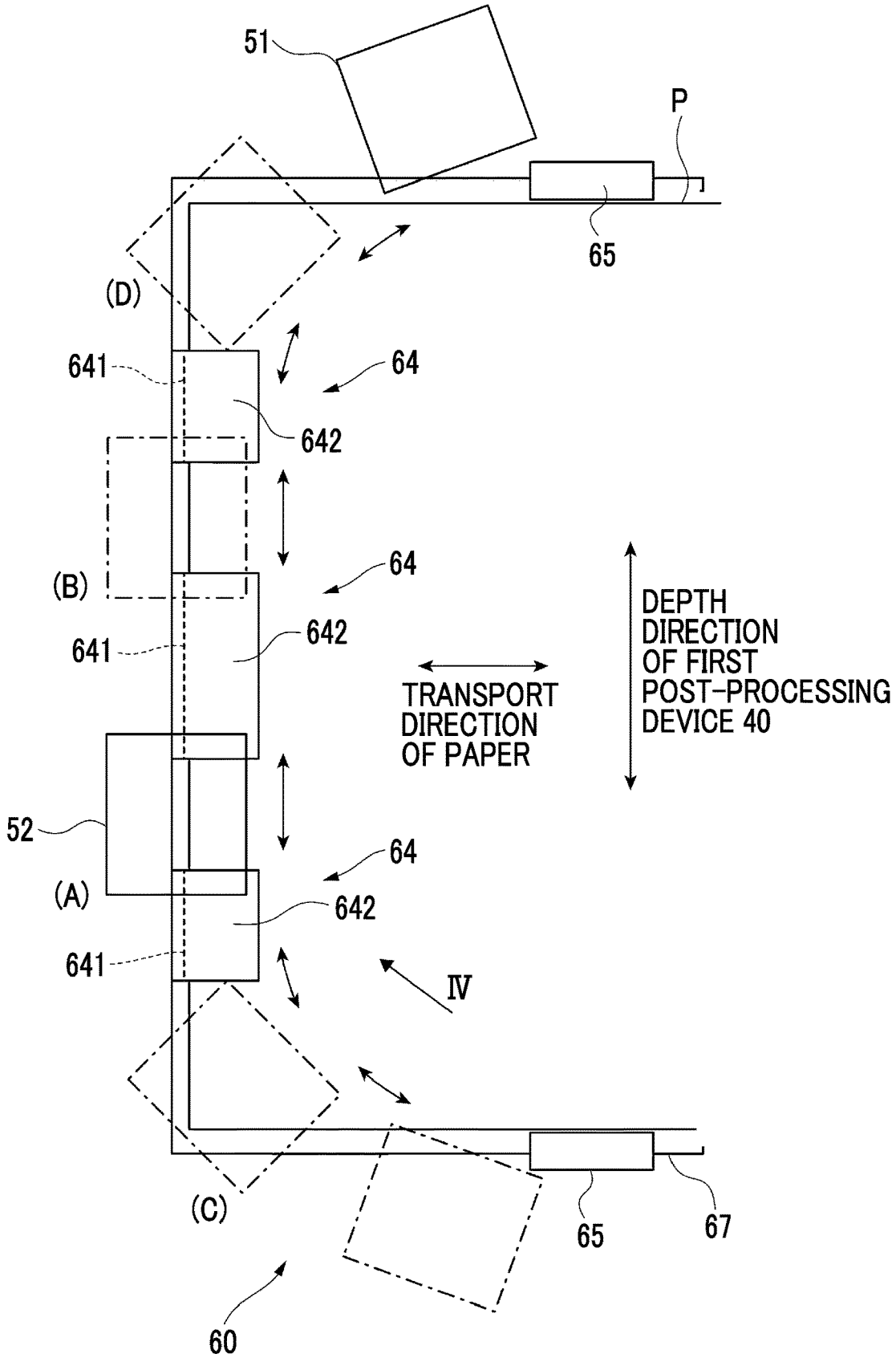
FIG. 3 is a diagram in a case where a paper stacking section is viewed from above.

Referring to and further describing FIG. 3 (a diagram in a case where the paper stacking section 60 is viewed from above), in the present exemplary embodiment, as described above, the first binding processing device 51 and the second binding processing device 52 are provided.

The first binding processing device 51 and the second binding processing device 52 are disposed such that the positions of the first post-processing device 40 in the depth direction are different from each other.

In the present exemplary embodiment, the first binding processing device 51 and the second binding processing device 52 move in the depth direction of the first post-processing device 40, which is a direction orthogonal to the transport direction of the paper P (paper bundle).

In addition, in the present exemplary embodiment, the first binding processing device 51 and the second binding processing device 52 move along one common route.

In the present exemplary embodiment, the first binding processing device 51 and the second binding processing device 52 are movable and can perform binding processing on a plurality of points of the paper bundle.

Here, the first binding processing device 51 and the second binding processing device 52 respectively stop at, for example, two points located at mutually different points in the depth direction of the first post-processing device (position (A) and position (B) in FIG. 3) and perform binding processing (two-point end binding processing) at these two points.

Additionally, each of the first binding processing device 51 and the second binding processing device 52 stops at, for example, one end (one corner portion of the paper bundle) (position (D) in FIG. 3) of the paper bundle, and binding processing (single-point end binding) is performed at this stop position.

Additionally, each of the first binding processing device 51 and the second binding processing device 52 stops at, for example, the other end (the other corner portion of the paper bundle) (position (C) in FIG. 3) of the paper bundle, and binding processing (single-point end binding) is performed at this stop position.

Here, in the present exemplary embodiment, each of the first binding processing device 51 and the second binding processing device 52 moves linearly between the position (A) and the position (B), and each of the first binding processing device 51 and the second binding processing device 52 moves while rotating by, for example, 45° between the position (A) and the position (C) and between the position (B) and the position (D).

Here, in the present exemplary embodiment, as illustrated in FIG. 3, a plurality of the end guides 64 are provided.

The end guides 64 are disposed at mutually different points in the depth direction (the direction orthogonal to the transport direction of the paper P) of the first post-processing device 40.

Additionally, each of the end guides 64 has a restricting portion 641 and a facing piece 642 as illustrated in FIG. 3.

The restricting portion 641 is disposed in a relationship orthogonal to the support plate 67, and in the present exemplary embodiment, the movement of the paper P is restricted by the end part of the paper P bumping against the restricting portion 641.

The facing piece 642 is connected to the restricting portion 641 and is disposed to face the support plate 67.

In the present exemplary embodiment, in a case where the paper P is placed on the support plate 67, the end part of the paper P enters between the facing piece 642 and the support plate 67. Moreover, the end part of the paper P bumps against the restricting portion 641. Accordingly, the paper P is aligned.

In addition, in a case where the binding processing is performed at the position (A) in FIG. 3, the binding processing is performed through a gap formed between the facing piece 642 located at the center (the center in the upward-downward direction) in FIG. 3 and the facing piece 642 located at a lower portion in the drawing.

Additionally, in a case where the binding processing is performed at the position (B) in FIG. 3, the binding processing is performed through a gap formed between the facing piece 642 located in the upper portion of FIG. 3 and the facing piece 642 located in the center in the drawing.

Figure 4:
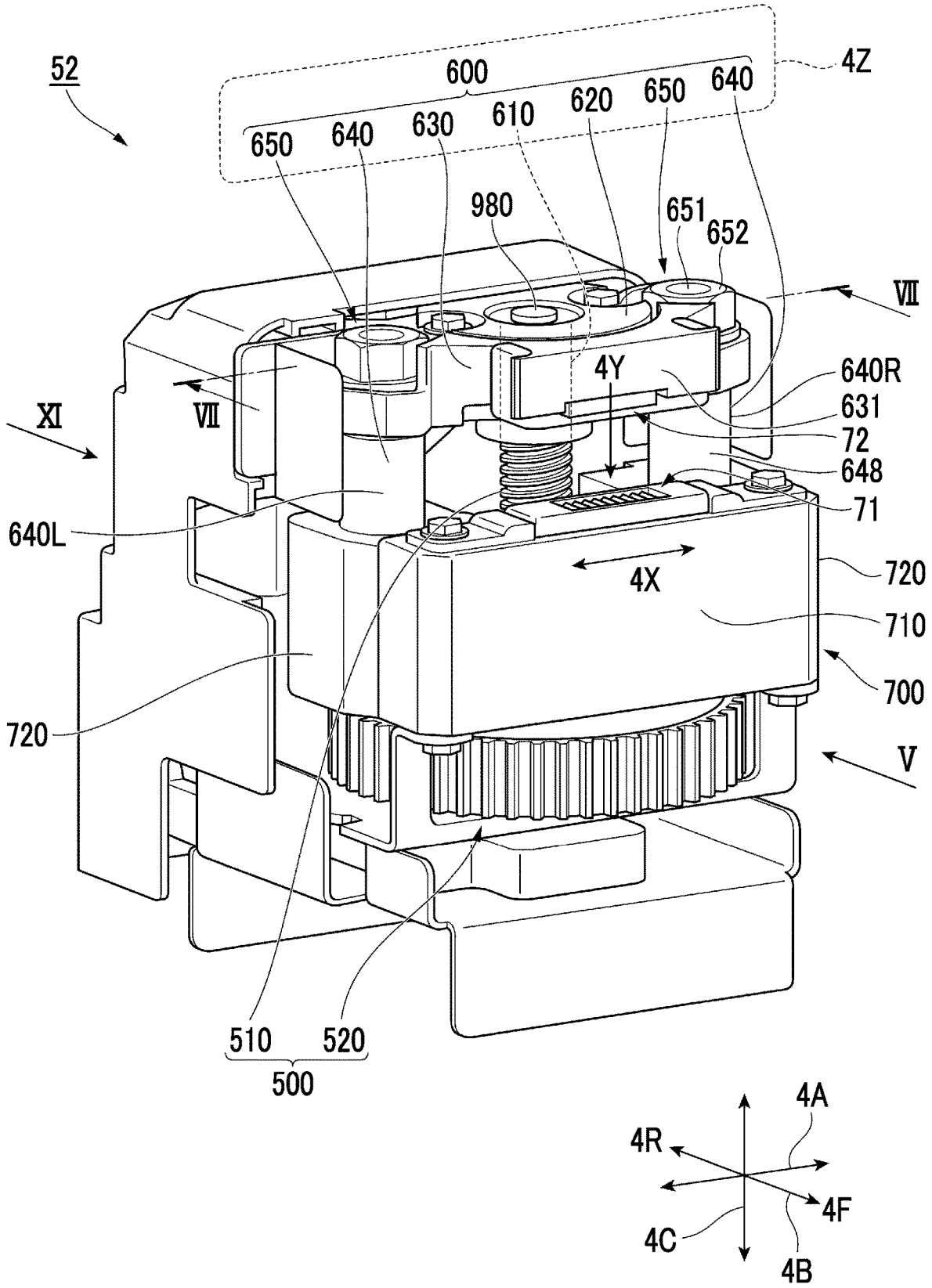
FIG. 4 is a diagram in a case where a second binding processing device is viewed from a direction indicated by arrow IV in FIG. 3.
Figure 5:
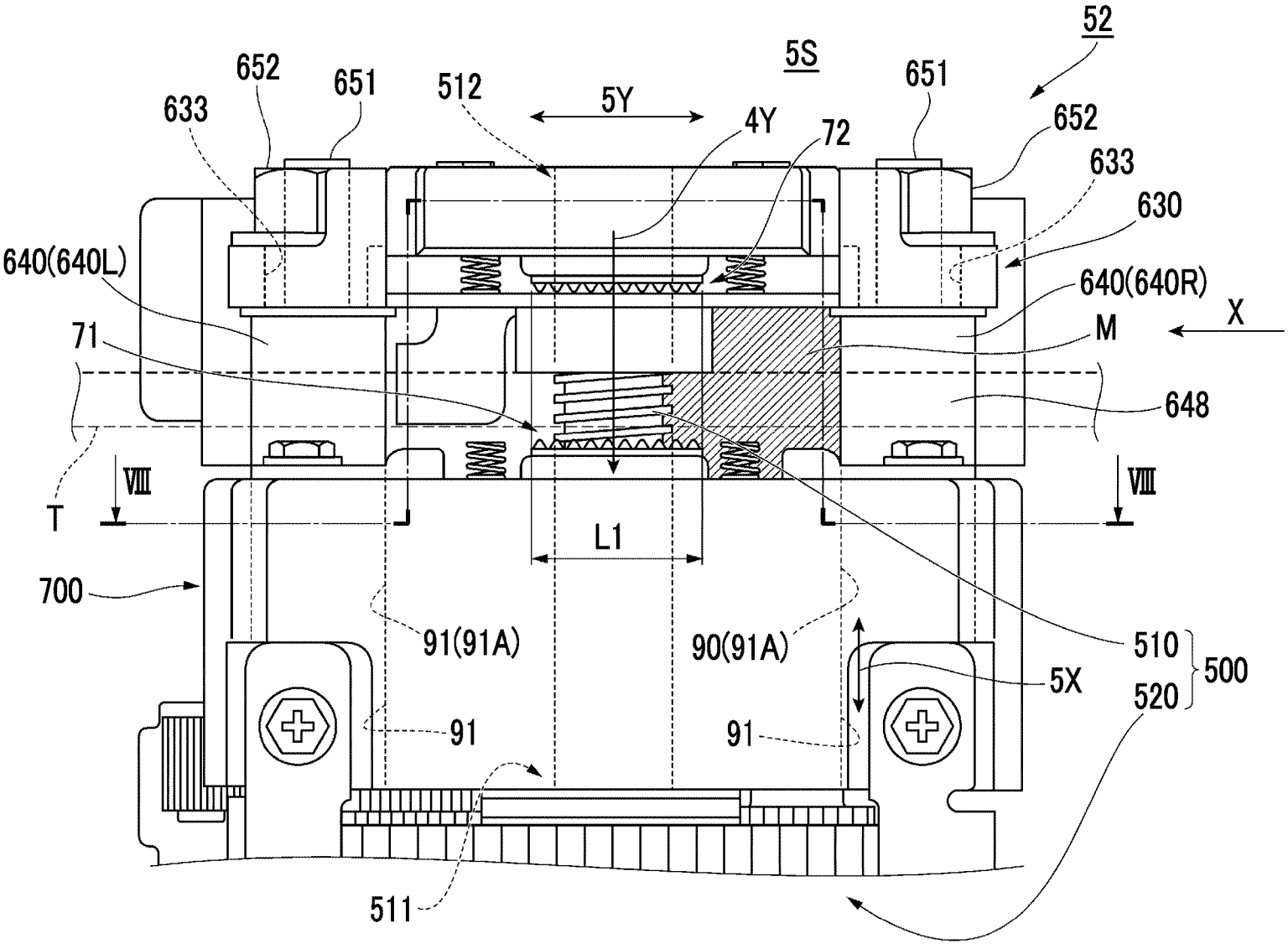
FIG. 5 is a diagram in a case where the second binding processing device is viewed from the direction of arrow V in FIG. 4.

FIG. 4 is a diagram in a case where the second binding processing device 52 is viewed from a direction indicated by arrow IV in FIG. 3. FIG. 5 is a diagram in a case where the second binding processing device 52 is viewed from the direction of arrow V in FIG. 4. In addition, FIG. 5 is a diagram in a case where the second binding processing device 52 is viewed from the front.

In addition, in FIG. 4, a direction indicated by arrow 4A is hereinafter referred to as a width direction of the second binding processing device 52, and a direction indicated by arrow 4B is referred to as a depth direction of the second binding processing device 52. Additionally, a direction indicated by arrow 4C is referred to as a height direction of the second binding processing device 52.

Additionally, in the present specification, a direction indicated by arrow 4R in the drawing is referred to as a rear direction or a rear side, and a direction indicated by arrow 4F in the drawing is referred to as a front direction or a front side.

As illustrated in FIG. 4, the second binding processing device 52 is provided with first binding teeth 71 used for binding processing of a paper bundle T (refer to FIG. 5) that is an example of the recording material bundle. Additionally, second binding teeth 72 are provided above the first binding teeth 71.

Each of the first binding teeth 71 as an example of first teeth and the second binding teeth 72 as an example of second teeth is provided with an uneven portion.

The surface of the first binding teeth 71 located on the side of the second binding teeth 72 and the surface of the second binding teeth 72 located on the side of the first binding teeth 71 are provided with an uneven portion in which a convex portion and a concave portion are alternately lined up in the direction indicated by arrow 4X in the drawing.

In other words, the surface of the first binding teeth 71 located on the side of the second binding teeth 72 and the surface of the second binding teeth 72 located on the side of the first binding teeth 71 are provided with an uneven portion in which a convex portion and a concave portion are alternately lined up in a longitudinal direction of the first binding teeth 71 and the second binding teeth 72.

In a case where the binding processing is performed by the first binding teeth 71 and the second binding teeth 72, in the present exemplary embodiment, the second binding teeth 72 advance toward the first binding teeth 71.

More specifically, in the present exemplary embodiment, in a case where the binding processing is performed, the second binding teeth 72 moves down along a linear route indicated by arrow 4Y in the drawing (hereinafter, referred to as a "linear route 4Y"), and moves toward the first binding teeth 71.

Then, in the present exemplary embodiment, the paper bundle T located between the first binding teeth 71 and the second binding teeth 72 is sandwiched and pressed by the first binding teeth 71 and the second binding teeth 72.

In this case, in the present exemplary embodiment, the convex portions provided on the first binding teeth 71 and the concave portions provided on the second binding teeth 72 face each other. Additionally, in this case, the concave portions provided on the first binding teeth 71 and the convex portions provided on the second binding teeth 72 face each other.

Additionally, the convex portions provided on one binding teeth enter the concave portions provided on the other binding teeth.

Accordingly, sheets of the paper P constituting the paper bundle T are pressure-bonded to each other, and the binding processing of the paper P is performed. Thereafter, in the present exemplary embodiment, the second binding teeth 72 move upward and retreat from the first binding teeth 71.

In addition, in the present exemplary embodiment, a case where the convex portions and the concave portions are alternately lined up in the first binding teeth 71 and the second binding teeth 72, respectively, has been described as an example. However, the convex portions and the concave portions may be disposed by another line-up method.

Additionally, for example, in a case where the paper bundle T is pressed by the first binding teeth 71 and the second binding teeth 72, the binding processing may be performed by cutting a part of the paper bundle T to form a strip-shaped piece, forming a through-hole may be formed in the paper bundle T, and passing the strip-shaped piece through the through-hole.

The method of binding processing by the first binding teeth 71 and the second binding teeth 72 is not particularly limited.

As illustrated in FIG. 4, the second binding processing device 52 is provided with a moving mechanism 500 as an example of a moving unit that moves the second binding teeth 72 toward the first binding teeth 71.

The moving mechanism 500 includes a rod-shaped screw member 510 extending in the upward-downward direction in the drawing, and the screw member 510 is rotated in the circumferential direction so as to move the second binding teeth 72 toward the first binding teeth 71.

The screw member 510 is made of metal. Additionally, the screw member 510 is formed in a straight shape.

Additionally, spiral convex portions and groove portions are formed on an outer peripheral surface of the screw member 510. In other words, the outer peripheral surface of the screw member 510 is provided with a male screw in which the convex portions and the groove portions are lined up at predetermined regular intervals in the axial direction of the screw member 510. The convex portions and the groove portions are alternately disposed in the axial direction of the screw member 510.

Additionally, the screw member 510 of the present exemplary embodiment is a screw conforming to the JIS standard.

Additionally, the type of the screw member 510 is not particularly limited, but for example, a trapezoidal screw is used. Additionally, the screw member 510 is not limited to being provided by the screw alone but may be integrated with a member having another function.

Additionally, the screw member 510 is disposed along the linear route 4Y in which the second binding teeth 72 moves.

Additionally, in the present exemplary embodiment, a multi-thread screw is used as the screw member 510. More specifically, in the present exemplary embodiment, a double-thread screw is used as the screw member 510.

In the present exemplary embodiment, the "multi-thread screw" refers to a screw having two or more spirals in one pitch.

Additionally, in the present exemplary embodiment, an interlocking portion 600 that moves in conjunction with the second binding teeth 72 is provided. Moreover, the screw member 510 meshes with the interlocking portion 600. In other words, the screw member 510 is connected to the interlocking portion 600.

More specifically, the interlocking portion 600 is provided with a female thread portion 610, and the screw member 510 that is a male screw meshes with the portion of the interlocking portion 600 where the female thread portion 610 is provided.

The moving mechanism 500 rotates the screw member 510 meshing with the female thread portion 610 in the circumferential direction to move the second binding teeth 72 toward the first binding teeth 71.

More specifically, in the present exemplary embodiment, in a case where a drive motor M to be described below is rotated forward, the screw member 510 rotates in one direction in the circumferential direction.

Accordingly, the interlocking portion 600 and the second binding teeth 72 move downward, and the second binding teeth 72 are moved to the first binding teeth 71. Accordingly, the binding processing is performed.

In the present exemplary embodiment, in a case where the screw member 510 rotates in the circumferential direction, the interlocking portion 600 and the second binding teeth 72 move in the axial direction of the screw member 510.

Additionally, in the present exemplary embodiment, in a case where the binding processing ends, the drive motor M is rotated reversely, the screw member 510 rotates in the reverse direction.

Accordingly, the interlocking portion 600 and the second binding teeth 72 move upward. In a case where the second binding teeth 72 move upward, the second binding teeth 72 retreat from the first binding teeth 71.

The moving mechanism 500 is provided with the drive motor M as an example of a drive source as illustrated in FIG. 5 in addition to the screw member 510.

Additionally, in the present exemplary embodiment, a pinion gear (not illustrated) connected to an output shaft of the drive motor M and disposed coaxially with the output shaft is provided below the drive motor M. Additionally, a rotary gear (not illustrated) that meshes and rotates with the pinion gear is provided.

Moreover, in the present exemplary embodiment, as illustrated in FIG. 4, a larger-diameter gear 520 meshing with the rotary gear and receiving a driving force from the rotary gear is provided.

The larger-diameter gear 520 as an example of a rotating body is disposed coaxially with the screw member 510.

Additionally, in the present exemplary embodiment, a lower end part of the screw member 510 is fixed to the larger-diameter gear 520. Moreover, in the present exemplary embodiment, the outer diameter of the larger-diameter gear 520 is larger than the outer diameter of the screw member 510.

In the present exemplary embodiment, the larger-diameter gear 520 is rotated by the drive motor M, and accordingly, the screw member 510 rotates in the circumferential direction.

In the present exemplary embodiment, the larger-diameter gear 520 receives a driving force transmitted to the screw member 510. Then, the driving force is transmitted from the larger-diameter gear 520 to the screw member 510.

Accordingly, the screw member 510 rotates about an axis. In a case where the screw member 510 rotates about the axis, the second binding teeth 72 advance and retreat with respect to the first binding teeth 71.

A mechanism that moves the second binding teeth 72 is not particularly limited, and examples thereof include a cam mechanism and a jack mechanism. Here, in a case where the screw member 510 is used as in the present exemplary embodiment, the size of the second binding processing device 52 may be reduced.

Here, in a case where the cam mechanism or the jack mechanism is used, an aspect is conceivable in which the cam mechanism or the jack mechanism is provided, for example, at a point indicated by reference numeral 4Z in FIG. 4 (above the second binding processing device 52).

In this aspect, the interlocking portion 600 is pressed from above by the cam mechanism or the jack mechanism to move the second binding teeth 72.

Meanwhile, in this case, it is difficult to increase the separation amount between the first binding teeth 71 and the second binding teeth 72 while suppressing an increase in the size of the second binding processing device 52.

In addition, in the present exemplary embodiment, a space between the first binding teeth 71 and the second binding teeth 72 is a receiving portion that receives the paper bundle T. However, in a case where the cam mechanism or the jack mechanism is used, it is difficult to enlarge the receiving portion while suppressing an increase in the size of the second binding processing device 52.

In a case where the cam mechanism or the jack mechanism is used, the amount of advance and retreat of the second binding teeth 72 increases in a case where the cam mechanism or the jack mechanism is enlarged. Therefore, the receiving portion can be enlarged.

However, in this case, the size of the second binding processing device 52 is increased.

Additionally, in a case where the receiving portion is made smaller, the increase in the size of the second binding processing device 52 can be suppressed, but in this case, the maximum number of sheets of the paper P that can be subjected to the binding processing is reduced.

In contrast, in a case where the screw member 510 is used as in the present exemplary embodiment, the increase in the size of the second binding processing device 52 is suppressed, and the receiving portion becomes larger.

Particularly, in the present exemplary embodiment, as illustrated in FIG. 5, some components of the moving mechanism 500 such as the drive motor M and the screw member 510 is configured to be provided on the side of the linear route 4Y where the second binding teeth 72 moves.

In this case, it is easy to secure the size of the receiving portion while reducing the dimension of the second binding processing device 52 in the height direction.

Additionally, in the present exemplary embodiment, as illustrated in FIG. 4, the larger-diameter gear 520 is disposed so as to extend in a direction intersecting the linear route 4Y in which the second binding teeth 72 move. This also reduces the dimension of the second binding processing device 52 in the height direction.

In the present exemplary embodiment, the direction in which the linear route 4Y extends and the radial direction of the larger-diameter gear 520 has an intersecting (orthogonal) relationship.

In this case, the dimension of the second binding processing device 52 in the height direction is smaller than that in a case where the larger-diameter gear 520 is installed in a direction in which the linear route 4Y extends.

Additionally, in the present exemplary embodiment, the second binding processing device 52 is configured to be capable of passing through the end guide 64 illustrated in FIG. 3.

More specifically, in the present exemplary embodiment, the maximum separation amount between the first binding teeth 71 and the second binding teeth 72 is larger than the height dimension of the end guide 64, and the end guide 64 passes through the above-described receiving portion. Accordingly, the second binding processing device 52 passes through the end guide 64.

As illustrated in FIG. 4, the interlocking portion 600 is provided with a load receiving member 620. In the present exemplary embodiment, the female thread portion 610 is provided in the load receiving member 620.

The load receiving member 620 as an example of a load receiving portion comes into contact with the screw member 510 and receives a load from the screw member 510.

Additionally, the interlocking portion 600 is provided with an upper support member 630 that supports the load receiving member 620 and the second binding teeth 72.

Additionally, the interlocking portion 600 is provided with two rod-shaped members 640 that are attached to the upper support member 630 and extend downward. Additionally, the interlocking portion 600 is provided with a fixing member 650 for fixing each of the rod-shaped members 640 to the upper support member 630.

In the present exemplary embodiment, a left rod-shaped member 640L located on the left side in the drawing and a right rod-shaped member 640R located on the right side in the drawing are provided as the rod-shaped members 640.

Each of the left rod-shaped member 640L and the right rod-shaped member 640R is disposed so as to extend along the linear route 4Y.

Each rod-shaped member 640 is used to guide the interlocking portion 600. Additionally, the rod-shaped member 640 is used to guide the second binding teeth 72.

In the present exemplary embodiment, the outer diameter of the rod-shaped member 640 is larger than the outer diameter of the screw member 510. More specifically, the outer diameters of the left rod-shaped member 640L and the right rod-shaped member 640R are larger than the outer diameter of the screw member 510.

Additionally, in the present exemplary embodiment, the upper support member 630 and the rod-shaped member 640 are separate parts, and the rod-shaped member 640 is attached to the upper support member 630.

In addition, not limited to this, the upper support member 630 and the rod-shaped member 640 may be integrated with each other such that the upper support member 630 has the function of the rod-shaped member 640.

The fixing member 650 is constituted by a nut 652.

A bolt portion 651 is provided at a distal end part of the rod-shaped member 640 located at the upper portion in the drawing, and the nut 652 is fixed to the bolt portion 651.

Additionally, in the present exemplary embodiment, a columnar rod-shaped member body 648 is provided in the portion of the rod-shaped member 640 located below the upper support member 630.

Additionally, in the present exemplary embodiment, the upper support member 630 is formed with a through-hole 633 (refer to FIG. 5) as an example of the hole portion.

In the present exemplary embodiment, the rod-shaped member 640 is passed through the through-hole 633. Additionally, in the present exemplary embodiment, as illustrated in FIG. 5, the bolt portion 651 of the rod-shaped member 640 protrudes upward from the upper support member 630.

In the present exemplary embodiment, as illustrated in FIG. 5, the nut 652 is attached to the bolt portion 651 that protrudes upward from the upper support member 630.

Additionally, in the present exemplary embodiment, the upper support member 630 is sandwiched between the nut 652 attached to the bolt portion 651 and the rod-shaped member body 648 of the rod-shaped member 640. Accordingly, the rod-shaped member 640 is fixed to the upper support member 630.

Additionally, in the present exemplary embodiment, as illustrated in FIG. 4, the second binding teeth 72 are fixed to the upper support member 630. More specifically, in the present exemplary embodiment, the second binding teeth 72 are fixed to one end part 631 of the upper support member 630 located on the near side in the drawing.

More specifically, in the present exemplary embodiment, the second binding teeth 72 are fixed to the upper support member 630 by press fitting.

In addition, the fixing of the second binding teeth 72 is not limited to the press fitting, and may be performed by other methods such as adhesion, welding, and fastening.

Moreover, a lower support member 700 that supports the first binding teeth 71 is provided below the interlocking portion 600. In other words, the lower support member 700 that supports the first binding teeth 71 is provided below the upper support member 630.

In the present exemplary embodiment, the first binding teeth 71 are fixed to the lower support member 700 by press fitting.

In addition, similar to the above, the fixing of the first binding teeth 71 is not limited to the press fitting, and may be performed by the other methods such as adhesion, welding, and fastening.

The lower support member 700 is provided with a teeth support portion 710 extending in the width direction of the second binding processing device 52 and supporting the first binding teeth 71 from below.

Moreover, the lower support member 700 is provided with a connection portion 720 that is connected to each of the end parts of the teeth support portion 710 and extends from the end part to the rear side of the second binding processing device 52.

In the present exemplary embodiment, as will be described below, the lower support member 700 is formed of a metal block, and the teeth support portion 710 and the connection portion 720 are integrated with each other.

Additionally, in the present exemplary embodiment, as illustrated in FIG. 5, a guide portion 90 that guides the second binding teeth 72 is provided.

The guide portion 90 is provided on the lower support member 700. Additionally, the guide portion 90 is disposed along the linear route 4Y in which the second binding teeth 72 move.

In the present exemplary embodiment, as described above, the rod-shaped member 640 is provided, and the guide portion 90 guides the rod-shaped member 640 to guide the second binding teeth 72.

More specifically, in the present exemplary embodiment, the lower support member 700 is provided with a hole portion 91 extending along the linear route 4Y.

The guide portion 90 of the present exemplary embodiment is constituted by an inner peripheral surface 91A of the hole portion 91.

In the present exemplary embodiment, the inner peripheral surface 91A of the hole portion 91 is used to guide the rod-shaped member 640 as an example of a guided portion.

In addition, in the present exemplary embodiment, a cylindrical member 198 (refer to FIG. 13) is inserted inside each of the hole portions 91, and the inner peripheral surface 91A (refer to FIG. 5) of the hole portion 91 guides a rod-shaped member 640 via the cylindrical member 198.

In addition, not limited to this, the inner peripheral surface 91A of the hole portion 91 may come into direct contact with an outer peripheral surface of the rod-shaped member 640 without installing the cylindrical member 198.

The expression "the inner peripheral surface 91A of the hole portion 91 guides the rod-shaped member 640" is not limited to an aspect in which the inner peripheral surface 91A comes into direct contact with the rod-shaped member 640 to guide the rod-shaped member 640, and also includes an aspect in which the inner peripheral surface 91A guides the rod-shaped member 640 via another member such as the above cylindrical member 198.

In the present exemplary embodiment, a plurality of the guide portion 90 and a plurality of the rod-shaped member 640 which is the guided portion are provided. Specifically, in the present exemplary embodiment, two guide portions 90 and two rod-shaped members 640 are provided.

In addition, in the present exemplary embodiment, the two guided portions and the two guide portions are provided in this way, but the numbers of guided portions and guide portions installed are not limited to these and may be one or may be 3 or more.

The cross section of the hole portion 91 is formed in a circular shape. Additionally, in the present exemplary embodiment, the rod-shaped member 640 is constituted by, for example, a columnar member having a diameter of φ10 mm or more.

In addition, the cross-sectional shape of the hole portion 91 and the cross-sectional shape of the rod-shaped member 640 are not limited to the circular shape but may be an elliptical shape, a polygonal shape, or the like.

In the present exemplary embodiment, the columnar rod-shaped member 640 constituting a part of the interlocking portion 600 (refer to FIG. 4) enters the hole portion 91, and the rod-shaped member 640 is guided by the inner peripheral surface 91A of the hole portion 91.

In the present exemplary embodiment, the guide portion 90 is constituted by the hole portion 91 that is an example of a hole provided in the lower support member 700. More specifically, the guide portion 90 is constituted by an inner surface of the hole portion 91 provided in the lower support member 700.

The guide portion 90 guides an outer surface of the rod-shaped member 640, using the inner surface of the hole portion 91.

The rod-shaped member 640 (refer to FIG. 4) as an example of the guided portion and the rod-shaped portion extends in the upward-downward direction that is the movement direction of the interlocking portion 600. In other words, the rod-shaped member 640 extends along the movement route of the interlocking portion 600.

Additionally, the rod-shaped member 640 extends toward the downstream side in the movement direction of the interlocking portion 600 in a case where a connection point with the upper support member 630 is used as a starting point.

Additionally, in the present exemplary embodiment, the hole portion 91 (refer to FIG. 5) provided in the lower support member 700 to function as a guide portion also extends in the movement direction of the interlocking portion 600.

In addition, in FIGS. 4 and 5, the guide portion is constituted by the inner surface of the hole, and the guided portion is constituted by the rod-shaped portion that comes into contact with the inner surface of the hole. However, not limited to this, as will be described below, the guided portion may be constituted by the inner surface of the hole, and the guide portion may be constituted by the rod-shaped portion that comes into contact with the inner surface of the hole.

Additionally, the hole portion 91 (refer to FIG. 5) provided in the lower support member 700 may be provided in a state of penetrating the lower support member 700. Additionally, not limited to this, the hole portion 91 may be provided such that the hole portion 91 does not penetrate the lower support member 700 and has a bottom.

In the present exemplary embodiment, as the second binding teeth 72 moves toward the first binding teeth 71, the contact area between the guide portion 90 (refer to FIG. 5) and the rod-shaped member 640, which is the guided portion, increases.

More specifically, in the present exemplary embodiment, as the second binding teeth 72 moves toward the first binding teeth 71, the amount of the rod-shaped member 640 entering the hole portion 91 increases, and the contact area between the guide portion 90 and the rod-shaped member 640 increases.

In other words, in the present exemplary embodiment, as the second binding teeth 72 move toward the first binding teeth 71, the area of a region where the guide portion 90 and the rod-shaped member 640 overlap each other increases.

Figure 6:
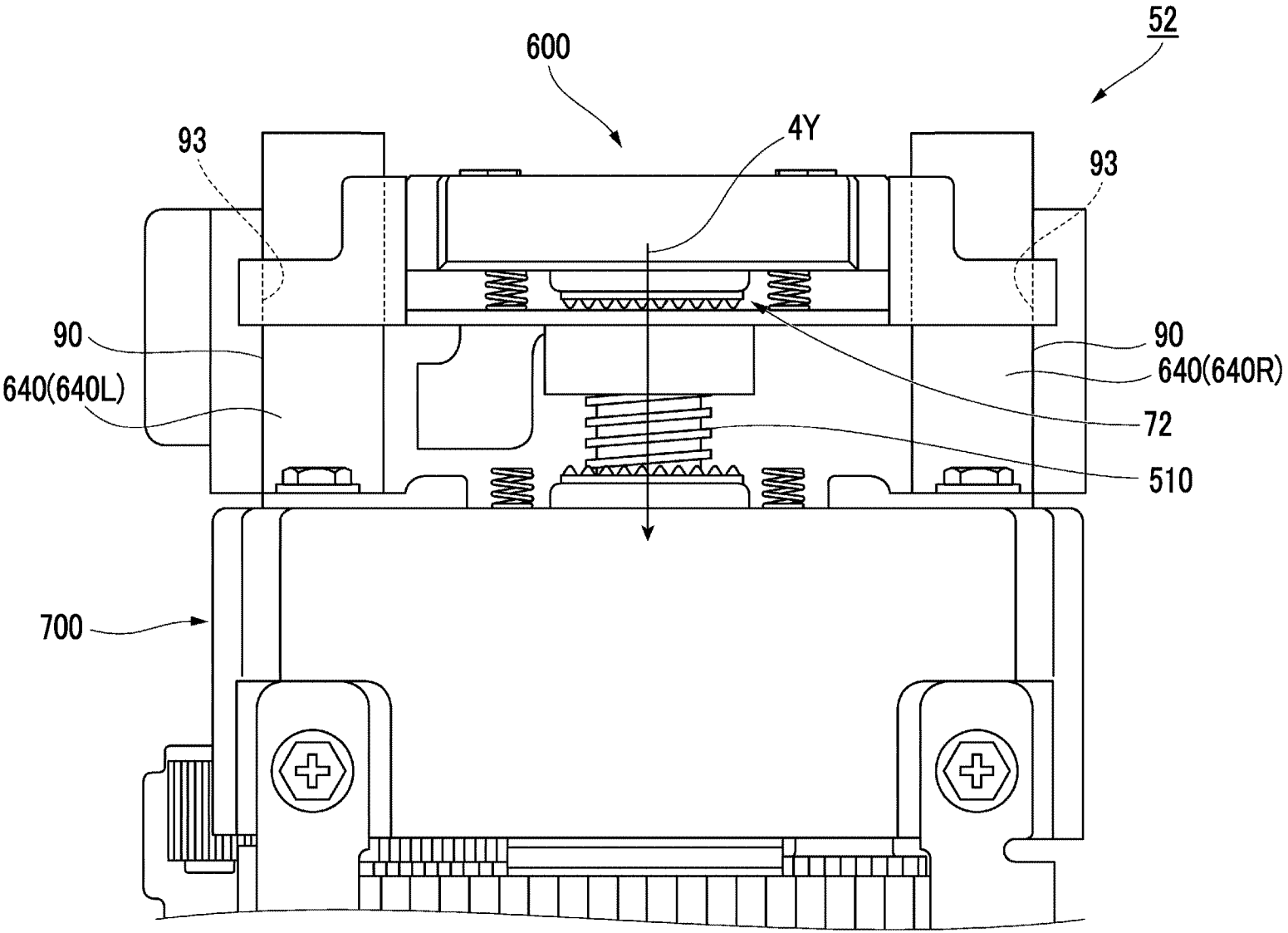
FIG. 6 is a diagram illustrating another configuration example of the second binding processing device.

FIG. 6 is a diagram illustrating another configuration example of the second binding processing device 52.

A case where the guided portion is constituted by the inner surface of the hole and the guide portion is constituted by the rod-shaped portion that comes into contact with the inner surface of the hole is exemplified in FIG. 6.

In this configuration example, a hole portion 93 extending along the linear route 4Y is provided on the interlocking portion 600 side interlocking with the second binding teeth 72.

Additionally, in this configuration example, the rod-shaped member 640 that enters the hole portion 93 and extends along the linear route 4Y is provided on the lower support member 700 side. The rod-shaped member 640 is fixed to the lower support member 700.

In this configuration example, an outer peripheral surface of the rod-shaped member 640 serves as the guide portion 90, and the outer peripheral surface is used to guide the interlocking portion 600.

In this configuration example, the guided portion is constituted by the inner surface of the hole portion 93 extending in the movement direction of the interlocking portion 600.

Additionally, in this configuration example, the guide portion is constituted by the rod-shaped member 640 that comes into contact with the inner surface of the hole portion 93 extending in the movement direction of the interlocking portion 600.

Additionally, in the present exemplary embodiment (in the exemplary embodiments illustrated in FIGS. 4 and 5), the screw member 510 is movable with respect to the interlocking portion 600, and the screw member 510 is movable in a direction intersecting (orthogonal to) the direction in which the screw member 510 extends.

Specifically, in the present exemplary embodiment, the screw member 510 is movable with respect to the interlocking portion 600, that is, the screw member 510 in the direction indicated by the arrow 4A in FIG. 4 is movable.

In other words, the screw member 510 is movable in the width direction of the second binding processing device 52.

In the present exemplary embodiment, the load receiving member 620 is movable in the direction indicated by the arrow 4A.

More specifically, in the present exemplary embodiment, the load receiving member 620 is configured to be relatively movable with respect to the upper support member 630, and thereby, the load receiving member 620 in the width direction of the second binding processing device 52 is movable.

In other words, in the present exemplary embodiment, the load receiving member 620 is configured to be movable with respect to the upper support member 630 and the rod-shaped member 640 that constitute a part of the interlocking portion 600.

In this way, in a case where the load receiving member 620 is movable with respect to the upper support member 630 and the rod-shaped member 640, the screw member 510 is movable with respect to the upper support member 630 and the rod-shaped member 640.

More specifically, the screw member 510 is movable with respect to the upper support member 630 and the rod-shaped member 640, and the screw member 510 is movable in the direction intersecting (orthogonal to) the direction in which the screw member 510 extends.

In other words, the screw member 510 is movable in the radial direction of the screw member 510.

Figure 7:
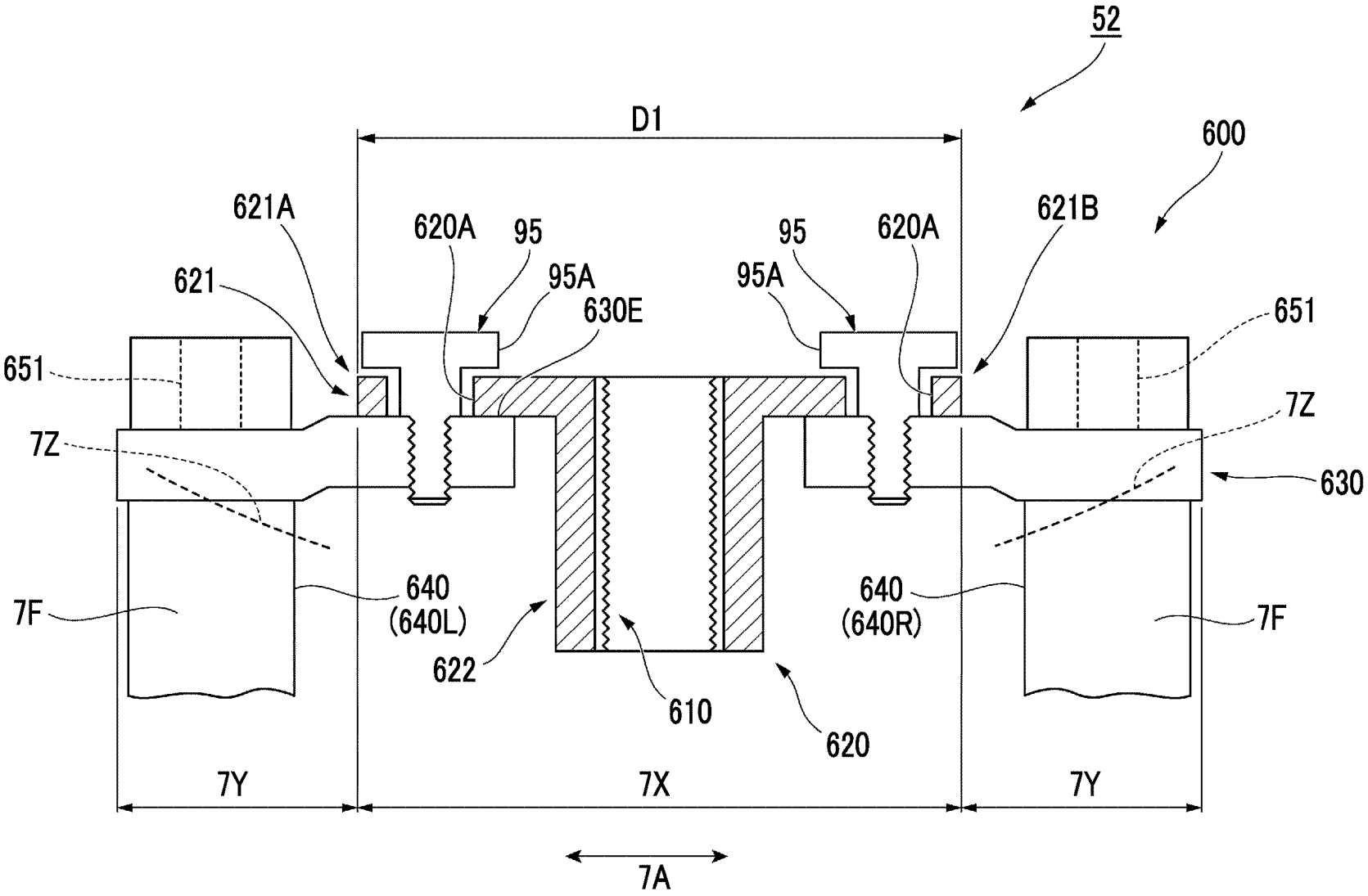
FIG. 7 is a cross-sectional view of the second binding processing device taken along line VII-VII in FIG. 4.

FIG. 7 is a cross-sectional view of the second binding processing device 52 taken along line VII-VII in FIG. 4, and is a cross-sectional view illustrating an upper portion of the second binding processing device 52.

In the present exemplary embodiment, as illustrated in FIG. 7, a through-hole 620A is formed in the load receiving member 620, and a fixing screw 95 used for fixing the load receiving member 620 to the upper support member 630 is passed through the through-hole 620A.

A gap is formed between an inner peripheral surface of the through-hole 620A and the fixing screw 95. Additionally, no thread portion is provided on an outer peripheral surface of the portion of the fixing screw 95 located within the through-hole 620A.

Additionally, the thickness of the load receiving member 620 is smaller than the separation distance between a head portion 95A of the fixing screw 95 and an upper surface 630E of the upper support member 630.

Accordingly, in the present exemplary embodiment, the load receiving member 620 is movable with respect to the upper support member 630, that is, the load receiving member 620 is movable in the direction indicated by arrow 7A in the drawing.

In this case, the screw member 510 (not illustrated in FIG. 7) is movable with respect to the upper support member 630 and the rod-shaped member 640.

In other words, the screw member 510 is movable with respect to the interlocking portion 600 (refer to FIG. 4), and the screw member 510 is movable in the direction intersecting the direction in which the screw member 510 extends.

Here, for example, a configuration in which the screw member 510 cannot be moved with respect to the interlocking portion 600, and for example, a state in which the screw member 510 is inclined with respect to the linear route 4Y (refer to FIG. 4) is assumed.

In this case, in a case where the second binding teeth 72 advance to the first binding teeth 71, the second binding teeth 72 move to a position different from the original position thereof. In this case, the position of the second binding teeth 72 with respect to the first binding teeth 71 deviate from an originally predetermined position.

In contrast, in a case where the screw member 510 is movable as in the present exemplary embodiment, the inclination of the screw member 510 with respect to the linear route 4Y becomes smaller, and the deviation of the second binding teeth 72 with respect to the first binding teeth 71 becomes smaller.

Additionally, in a case where the screw member 510 cannot be moved with respect to the interlocking portion 600 and the screw member 510 is inclined with respect to the linear route 4Y, a situation may occur in which, while the second binding teeth 72 faces the first binding teeth 71, the second binding teeth 72 stop and the binding cannot be performed.

In contrast, in a case where the screw member 510 is movable as in the present exemplary embodiment, the inclination of the screw member 510 with respect to the linear route 4Y becomes smaller. As a result, problems such that the second binding teeth 72 stops halfway are less likely to occur.

In the present exemplary embodiment, the portion indicated by reference numeral 7F in FIG. 7 is a guided portion guided by the guide portion 90 (refer to FIG. 5), and in the present exemplary embodiment, the load receiving member 620 is movable with respect to the guided portion.

More specifically, the load receiving member 620 is movable with respect to the guided portion in a direction intersecting (orthogonal) the axial direction of the screw member 510 (not illustrated in FIG. 7).

The interlocking portion 600 is configured to include the load receiving member 620 as an example of a load receiving portion that comes into contact with the screw member 510 and receives a load from the screw member 510, and the rod-shaped member 640 as an example of the guided portion guided by the guide portion 90.

In the present exemplary embodiment, the load receiving member 620 as an example of the load receiving portion is movable with respect to the rod-shaped member 640.

In a case where the load receiving member 620 is movable with respect to the rod-shaped member 640 as in the present exemplary embodiment, the deviation of the second binding teeth 72 with respect to the first binding teeth 71 becomes smaller as described above. As a result, problems such that the second binding teeth 72 stops halfway are less likely to occur.

As illustrated in FIG. 7, the load receiving member 620 has a T-shaped cross-sectional shape.

More specifically, the load receiving member 620 includes a disk-shaped larger-diameter portion 621 located at the upper portion in the drawing, and a smaller-diameter portion 622 located below the larger-diameter portion 621.

The larger-diameter portion 621 and the smaller-diameter portion 622 are disposed coaxially with each other. Additionally, a lower end part of the larger-diameter portion 621 and an upper end part of the smaller-diameter portion 622 are connected to each other.

A female thread portion 610 is provided on the central axis of the load receiving member 620.

The female thread portion 610 has a tubular shape, and in the present exemplary embodiment, the rod-shaped screw member 510 (refer to FIG. 4) is passed through the female thread portion 610. In other words, in the present exemplary embodiment, the female thread portion 610 and the screw member 510 mesh with each other and are connected to each other.

Additionally, in the present exemplary embodiment, a length L1 (refer to FIG. 5) of the second binding teeth 72 in the longitudinal direction is smaller than an outer diameter Dl (refer to FIG. 7) of the larger-diameter portion 621.

Additionally, in the present exemplary embodiment, in a case where the position of the larger-diameter portion 621 in the radial direction is compared, the second binding teeth 72 (refer to FIG. 7) are located closer to the other end 621B than the one end 621A (refer to FIG. 5) of the larger-diameter portion 621.

Additionally, the second binding teeth 72 are located closer to the one end 621A than the other end 621B of the larger-diameter portion 621.

In other words, in the present exemplary embodiment, in a case where the second binding processing device 52 is viewed from the front (in a case where the second binding processing device 52 is viewed from the side where the receiving portion is provided), the second binding teeth 72 is located between the one end 621A and the other end 621B of the larger-diameter portion 621.

In the present exemplary embodiment, the load receiving member 620 is pulled downward by the screw member 510, and accordingly, a portion of the upper support member 630 indicated by reference numeral 7X in FIG. 7 is uniformly pressed from above by the load receiving member 620.

In this case, the portion of the upper support member 630 that is uniformly pressed is likely to move downward while substantially maintaining a shape that extends laterally and linearly.

On the other hand, side portions (portions indicated by reference numeral 7Y in FIG. 7) of the upper support member 630 located on both sides of the pressed portion are likely to be inclined with respect to the horizontal direction as indicated by reference numeral 7Z.

In this case, for example, in a case where the dimension of the second binding teeth 72 in the longitudinal direction is large and some of the second binding teeth 72 reach the above side portions (portions indicated by reference numeral 7Y), the second binding teeth 72 are easily distorted.

In contrast, as in the present exemplary embodiment, in a case where the second binding teeth 72 do not reach the side portions, and the second binding teeth 72 is fitted between the one end 621A and the other end 621B of the larger-diameter portion 621, the second binding teeth 72 are less likely to be distorted.

Additionally, in the present exemplary embodiment, the second binding teeth 72 is movable with respect to the guide portion 90 (refer to FIG. 5), and the second binding teeth 72 is movable in a direction intersecting the direction in which the guide portion 90 extends.

More specifically, in the present exemplary embodiment, the second binding teeth 72 is movable in the direction intersecting the direction indicated by arrow 5X (refer to FIG. 5), which is the direction in which the inner peripheral surface 91A of the hole portion 91 extends.

In addition, in the present exemplary embodiment, the second binding teeth 72 are movable in a direction intersecting the direction in which the second binding teeth 72 advance and retreat.

Additionally, in the present exemplary embodiment, the upper support member 630 is movable in the direction indicated by arrow 5Y in FIG. 5.

More specifically, in the present exemplary embodiment, the upper support member 630 is movable with respect to the rod-shaped member 640, and the upper support member 630 is movable in the direction indicated by the arrow 5Y.

In other words, in the present exemplary embodiment, the upper support member 630 is movable in the longitudinal direction of the second binding teeth 72.

In the present exemplary embodiment, the second binding teeth 72 are moved in the longitudinal direction by moving the upper support member 630 with respect to the rod-shaped member 640.

In addition, in the present exemplary embodiment, in a case where the upper support member 630 is moved with respect to the rod-shaped member 640, the second binding teeth 72 are moved in the direction intersecting the direction in which the guide portion 90 extends (the direction indicated by the arrow 5X in the drawing).

More specifically, in the present exemplary embodiment, as illustrated in FIG. 5, the bolt portion 651 is provided at the upper end part of the rod-shaped member 640.

Moreover, in the present exemplary embodiment, a through-hole 633 through which the bolt portion 651 is passed is formed in the upper support member 630. The through-hole 633 is a so-called elongated hole, and is formed so as to extend in the longitudinal direction of the second binding teeth 72.

Accordingly, in the present exemplary embodiment, the upper support member 630 is movable with respect to the rod-shaped member 640, and the second binding teeth 72 are movable in the direction intersecting the direction in which the rod-shaped member 640 extends. In other words, the second binding teeth 72 are movable in the direction intersecting the direction in which the guide portion 90 extends.

More specifically, the second binding teeth 72 are movable in the direction indicated by the arrow 5Y in FIG. 5.

In the present exemplary embodiment, after the fixing of the rod-shaped member 640 to the upper support member 630 by the bolt portion 651 and the nut 652 is released, the upper support member 630 is moved in the longitudinal direction of the second binding teeth 72.

Accordingly, a positional relationship between the first binding teeth 71 and the second binding teeth 72 is changed. In addition, the relative position of the second binding teeth 72 with respect to the first binding teeth 71 is adjusted.

In addition, in the present exemplary embodiment, in a case where the adjustment of the position of the second binding teeth 72 ends, the nut 652 is tightened to the bolt portion 651, and the rod-shaped member 640 is fixed to the upper support member 630 again.

In addition, in the present exemplary embodiment, the configuration in which the upper support member 630 moves in the longitudinal direction of the second binding teeth 72 has been described. However, the present invention is not limited to the configuration, and the upper support member 630 may be moved in both of the longitudinal direction of the second binding teeth 72 and the direction orthogonal to the longitudinal direction.

In addition, in order to allow the upper support member 630 to move in both directions of the longitudinal direction and the orthogonal direction, for example, the above-described through-hole 633 formed in the upper support member 630 is formed of, for example, a round hole having a diameter larger than the outer diameter of the bolt portion 651.

Accordingly, the upper support member 630 moves in both directions of the longitudinal direction and the orthogonal direction.

Moreover, in the present exemplary embodiment, as illustrated in FIG. 5, the drive motor M is fitted between the one end 511 and the other end 512 of the screw member 510 in the axial direction. In other words, in the present exemplary embodiment, the drive motor M is located beside the screw member 510.

Accordingly, in the present exemplary embodiment, the size of the second binding processing device 52 in the direction in which the screw member 510 extends, in other words, in the direction in which the second binding teeth 72 advance and retreat, is reduced.

Here, in a case where the drive motor M is located, for example, at a point indicated by reference numeral 5S in FIG. 5, the second binding processing device 52 is likely to be increased in size.

In contrast, as in the present exemplary embodiment, in a case where the drive motor M is located beside the screw member 510, the increase in the size of the second binding processing device 52 is suppressed.

In the present exemplary embodiment, all or most of the drive motor M is fitted between the one end 511 and the other end 512 of the screw member 510 in the axial direction.

In addition, not limited to this, at least a part of the drive motor M may be located closer to the other end 512 side than the one end 511 of the screw member 510 in the axial direction and closer to the one end 511 side than the other end 512.

In this case, the size of the second binding processing device 52 may be reduced as compared to a configuration in which the drive motor M is not located at all between the one end 511 and the other end 512.

Figure 8:
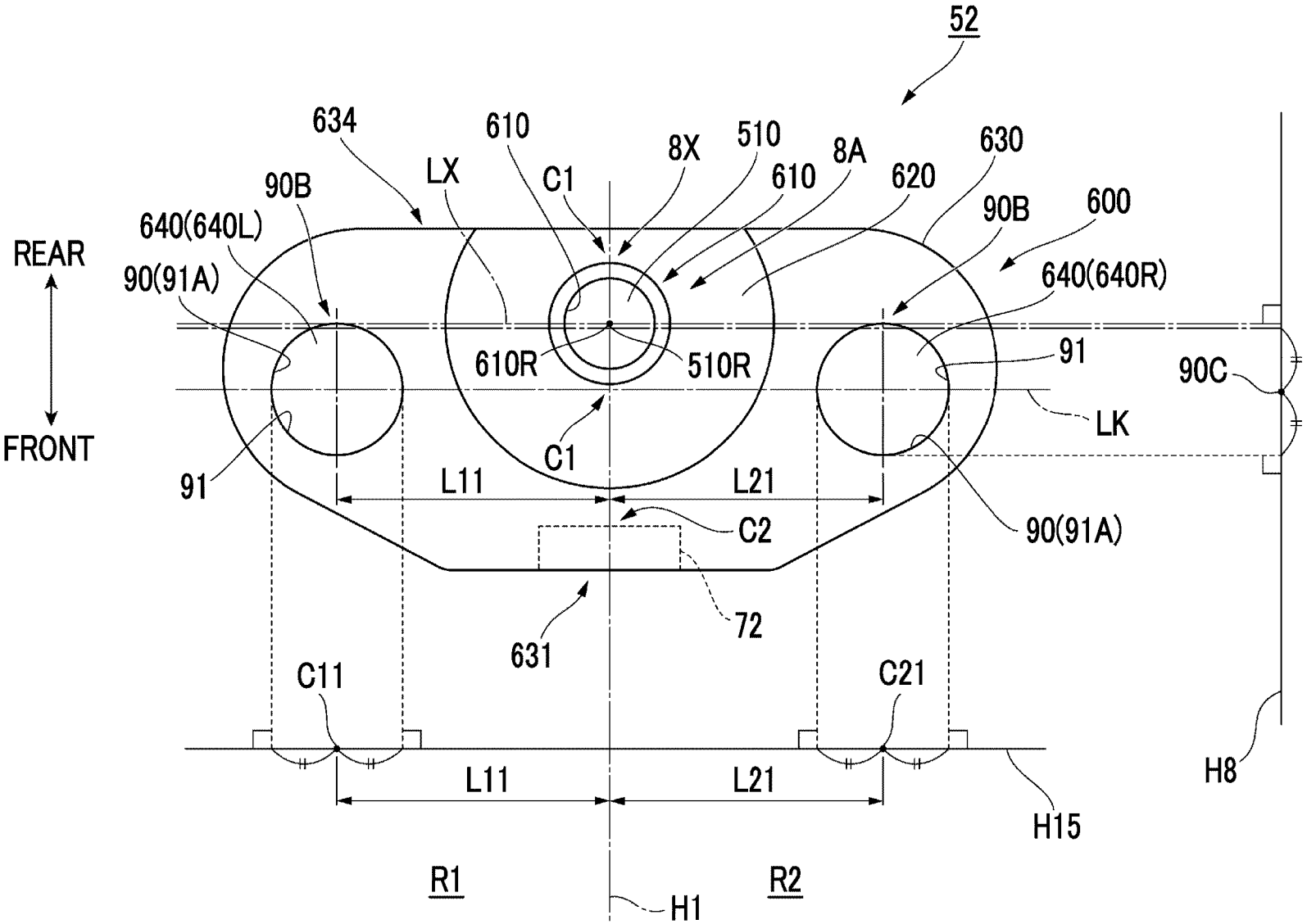
FIG. 8 is a diagram illustrating a cross section of the second binding processing device taken along line VIII-VIII in FIG. 5.

FIG. 8 is a diagram illustrating a cross section of the second binding processing device 52 taken along line VIII-VIII in FIG. 5.

The moving mechanism 500 (refer to FIG. 4) of the present exemplary embodiment applies a load to a specific point of the interlocking portion 600 to move the second binding teeth 72 toward the first binding teeth 71.

More specifically, the moving mechanism 500 applies a load to a specific point (hereinafter, referred to as "load application point 8A") in the present exemplary embodiment, which is indicated by reference numeral 8A (refer to FIG. 8), in the interlocking portion 600 to move the second binding teeth 72 toward the first binding teeth 71.

More specifically, in the present exemplary embodiment, the load application point 8A is a point where the female thread portion 610 is provided, and in the present exemplary embodiment, the interlocking portion 600 is moved to move the second binding teeth 72 toward the first binding teeth 71 by applying a load to the point where the female thread portion 610 is provided.

In the present exemplary embodiment, the guide portion (the inner peripheral surface 91A of the hole portion 91) is located closer to the second binding teeth 72 side than the load application point 8A.

In addition, being located closer to does not mean that all portions of the guide portion 90 are located closer to the second binding teeth 72 side than the load application point 8A.

In the present exemplary embodiment, a rear portion 90B of the guide portion 90 located closest to the rear side is located closer to the second binding teeth 72 side than a rear portion 8X of the load application point 8A located closest to the rear side.

In this way, in a case where portions located closest to the rear side are compared with each other and in a case where the rear portion 90B of the guide portion 90 is located closer to the second binding teeth 72 side than the rear portion 8X of the load application point 8A, it can be said that the guide portion 90 is located closer to the second binding teeth 72 side than the load application point 8A.

The guide portion 90 guides a portion of the interlocking portion 600 interlocking with the second binding teeth 72, which is located closer to the second binding teeth 72 side than the load application point 8A, to guide the second binding teeth 72.

More specifically, the guide portion 90 guides the rod-shaped member 640 located closer to the second binding teeth 72 side than the load application point 8A to guide the second binding teeth 72.

Additionally, in the present exemplary embodiment, assuming a virtual plane H1 passing through the load application point 8A and the second binding teeth 72 and extending along the linear route 4Y (refer to FIG. 5), the guide portion 90 is provided in each of two regions R1 and R2 facing each other with the plane H1 interposed therebetween.

More specifically, in the present exemplary embodiment, assuming the virtual plane H1 passing through a center portion C1 of the load application point 8A and a central portion C2 of the second binding teeth 72 in the longitudinal direction and extending along the linear route 4Y, the guide portion 90 is provided in each of two regions R1 and R2 facing each other with the plane H1 interposed therebetween.

In other words, in the present exemplary embodiment, assuming the virtual plane H1 passing through an axis center 510R of the screw member 510 and the central portion C2 in the longitudinal direction of the second binding teeth 72 and extending along the linear route 4Y, the guide portion 90 is provided in each of two regions R1 and R2 facing each other with the plane H1 interposed therebetween.

Moreover, in the present exemplary embodiment, each guide portion 90 provided in each of the two regions R1 and R2 is disposed closer to the second binding teeth 72 side than the load application point 8A.

In the present exemplary embodiment, in a case where the second binding teeth 72 are pushed against the paper bundle T, the second binding teeth 72 are pressed upward by a reaction, and the one end part 631 side of the upper support member 630 moves upward.

In this case, in a case where each of the guide portions 90 is located closer to the second binding teeth 72 side than the load application point 8A as in the present exemplary embodiment, the upward movement of the one end part 631 of the upper support member 630 is less likely to occur.

Additionally, in the present exemplary embodiment, assuming a virtual line LX passing through an axis center 610R of the female thread portion 610 and extending in the longitudinal direction of the second binding teeth 72, the guide portion 90 is located at a point deviated from the virtual line LX.

More specifically, the guide portion 90 is located closer to the second binding teeth 72 side than the virtual line LX.

FIG. 8 illustrates a cross-sectional view in a case where the second binding processing device 52 is viewed from above. However, in a state where the second binding processing device 52 is viewed from above, the guide portion 90 is located closer to the second binding teeth 72 side than the virtual line LX.

The expression "the guide portion 90 is located closer to the second binding teeth 72 side than the virtual line LX" means that the central portion 90C of the guide portion 90 in a case where the guide portion 90 is projected onto a plane H8 is located closer to the second binding teeth 72 side than in a case where the virtual line LX is projected onto the plane H8.

Here, the plane H8 is a plane having a relationship orthogonal to the longitudinal direction of the second binding teeth 72.

In the present exemplary embodiment, the central portion 90C of the guide portion 90 (a central portion in a direction in which the plane H8 extends) is located closer to the second binding teeth 72 side than the virtual line LX in a case where the guide portion 90 and the virtual line LX are projected on the plane H8 (projected in a direction orthogonal to the plane H8).

The expression "the guide portion 90 is located closer to the second binding teeth 72 side than the virtual line LX" is not limited to a state where all portions of the guide portion 90 are located closer to the second binding teeth 72 side than the virtual line LX.

As described above, in a case where the central portion 90C of the guide portion 90 is located closer to the second binding teeth 72 side than the virtual line LX, it can be said that the guide portion 90 is located closer to the second binding teeth 72 side than the virtual line LX.

In this case, the upward movement of the one end part 631 of the upper support member 630 is less likely to occur than in a case where the guide portion 90 is located on the virtual line LX.

In other words, as compared to a case where the position of the virtual line LX and the position of the central portion 90C of the guide portion 90 are aligned with each other, the upward movement of the one end part 631 of the upper support member 630 is less likely to occur.

In this case, in a case where the binding processing is performed, the second binding teeth 72 do not easily escape upward, and a larger load acts on the paper bundle T.

Additionally, in the present exemplary embodiment, the guide portion 90 provided in each of the two regions R1 and R2 is disposed on a common straight line LK extending in the longitudinal direction of the second binding teeth 72.

In addition, the guide portion 90 provided in each of the two regions R1 and R2 is disposed on the straight line LK line extending in the longitudinal direction of the second binding teeth 72 and passing through a point other than the axis center 610R of the female thread portion 610.

The expression "the guide portion 90 is disposed on the straight line LK" refers to that the position of the central portion 90C (the central portion in the direction in which the plane H8 extends) of the guide portion 90 and the position of the straight line LK coincide with each other in a case where the guide portion 90 and the straight line LK are projected onto the plane H8 (projected in a direction orthogonal to the plane H8).

Moreover, in the present exemplary embodiment, a distance L11 between the guide portion 90 provided in one region R1 of the two regions R1 and R2 and the plane H1 and a distance L21 between the guide portion 90 provided in the other region R2 and the plane H1 are equal to each other.

In addition, in the present exemplary embodiment, the distance L11 between one guide portion 90 of the two guide portions 90 disposed on the common straight line LK and the plane H1, and the distance L21 between the other guide portion 90 and the plane H1 are equal to each other.

More specifically, in a case where the plane H1, one guide portion 90, and the other guide portion 90 are projected onto the plane H15 extending in the longitudinal direction of the second binding teeth 72 (projected in a direction orthogonal to the plane H15) is assumed.

In this case, in the present exemplary embodiment, a distance L11 between a central portion C11 of the one guide portion 90 (a central portion in a direction in which the plane H15 extends) and the plane H1 and a distance L21 between a central portion C21 of the other guide portion 90 (a central portion in a direction which the plane H15 extends) and the plane H1 are equal to each other.

Additionally, in the present exemplary embodiment, the female thread portion 610 of the interlocking portion 600, which is a contact portion coming into contact with the screw member 510, is located closer to the right rod-shaped member 640R side on the right side in the drawing, which is an example of a second guided portion, than the left rod-shaped member 640L on the left side in the drawing, which is an example of a first guided portion.

Additionally, the female thread portion 610 is located closer to the left rod-shaped member 640L side on the left side in the drawing than the right rod-shaped member 640R on the right side in the drawing.

In the present exemplary embodiment, the interlocking portion 600 is provided with the left rod-shaped member 640L and the right rod-shaped member 640R, which are guided by the guide portion 90.

Also, in the present exemplary embodiment, the female thread portion 610, which is an example of the contact portion, is located closer to the right rod-shaped member 640R side than the left rod-shaped member 640L and closer to the left rod-shaped member 640L side than the right rod-shaped member 640R.

In the present exemplary embodiment, the female thread portion 610 can be regarded as the load receiving portion that receives a load from the screw member 510. In the present exemplary embodiment, the load receiving portion is located closer to the right rod-shaped member 640R side than the left rod-shaped member 640L and is located closer to the left rod-shaped member 640L side than the right rod-shaped member 640R.

More specifically, a case where the left rod-shaped member 640L, the right rod-shaped member 640R, and the female thread portion 610 are projected onto the plane H15 is assumed.

In this case, on the plane H15, the female thread portion 610 is located closer to the right rod-shaped member 640R side than the left rod-shaped member 640L and is located closer to the left rod-shaped member 640L side than the right rod-shaped member 640R.

The expression "the female thread portion 610 is located closer to the right rod-shaped member 640R side than the left rod-shaped member 640L and closer to the left rod-shaped member 640L side than the right rod-shaped member 640R" is not limited to a state in which the female thread portion 610 is located in a region sandwiched by the left rod-shaped member 640L and the right rod-shaped member 640R.

Figure 9:
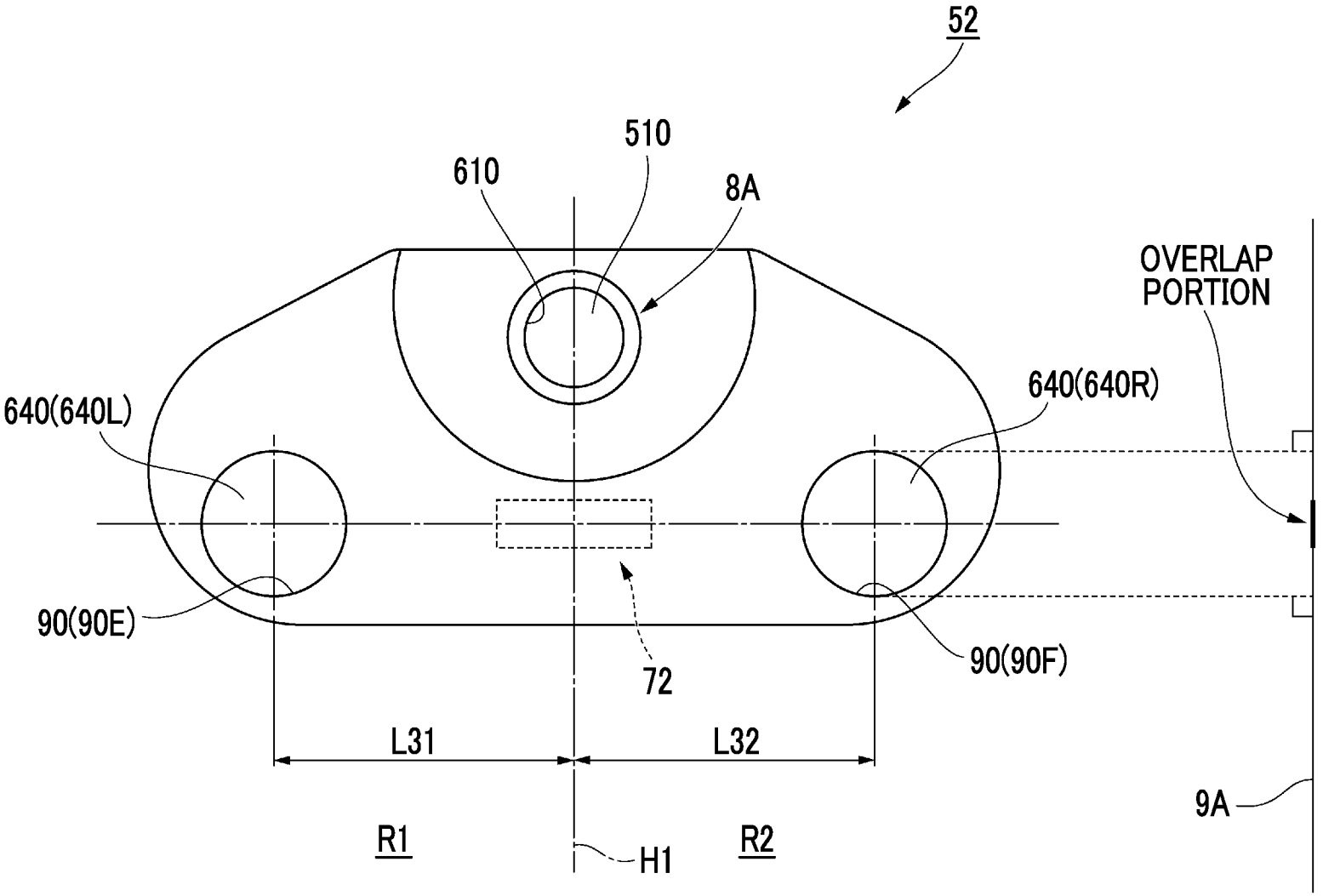
FIG. 9 is a diagram illustrating another configuration example of the second binding processing device.

As illustrated in FIG. 9, which will be described below, a form in which the female thread portion 610 is located at a point deviated from a region sandwiched between the left rod-shaped member 640L and the right rod-shaped member 640R is also conceivable.

Even in this form illustrated in FIG. 9, it can be said that the female thread portion 610 is located closer to the right rod-shaped member 640R side than the left rod-shaped member 640L and closer to the left rod-shaped member 640L side than the right rod-shaped member 640R.

In the present exemplary embodiment, the second binding teeth 72 move toward the first binding teeth 71 by applying a load to the load receiving member 620 of the interlocking portion 600 (refer to FIG. 8).

More specifically, as a load is applied to the female thread portion 610 provided on the load receiving member 620, the second binding teeth 72 move toward the first binding teeth 71.

In the present exemplary embodiment, it can be said that the first binding teeth 71 and the second binding teeth 72 are also located closer to the right rod-shaped member 640R side than the left rod-shaped member 640L and located closer to the left rod-shaped member 640L side than the right rod-shaped member 640R.

In addition, similar to the above, the expression "the first binding teeth 71 and the second binding teeth 72 are located closer to the right rod-shaped member 640R side than the left rod-shaped member 640L and located closer to the left rod-shaped member 640L side than the right rod-shaped member 640R." is not limited to a state in which the first binding teeth 71 and the second binding teeth 72 are located in the region sandwiched between the left rod-shaped member 640L and the right rod-shaped member 640R.

As illustrated in FIG. 8, even in a case where the first binding teeth 71 (not illustrated in FIG. 8) and the second binding teeth 72 are located at a point deviated from the region sandwiched by the left rod-shaped member 640L and the right rod-shaped member 640R, it can be said that the first binding teeth 71 and the second binding teeth 72 are located closer to the right rod-shaped member 640R side than the left rod-shaped member 640L and located closer to the left rod-shaped member 640L side than the right rod-shaped member 640R.

FIG. 9 is a diagram illustrating another configuration example of the second binding processing device 52.

In this configuration example, similarly to the above, the plurality of guide portions 90 are provided.

Moreover, this configuration example is a configuration in which the second binding teeth 72 are located between the one guide portion 90 (hereinafter, referred to as "a guide portion 90E") included in the plurality of guide portions 90 and another guide portion 90 (hereinafter, referred to as "a guide portion 90F").

FIG. 9 shows a state in a case where the plurality of guide portions 90 and the second binding teeth 72 are viewed from the upstream side or the downstream side in the movement direction of the second binding teeth 72.

In FIG. 9, the second binding teeth 72 are located between one guide portion 90E and the other guide portion 90F, which are included in the plurality of guide portions 90.

Here, the "located between" refers to a state where a portion where three including one guide portions 90E, the other guide portion 90F, and the second binding teeth 72 overlap each other is present in a case where the one guide portion 90E, the other guide portion 90F, and the second binding teeth 72 are projected on the plane 9A having a relationship orthogonal to the longitudinal direction of the second binding teeth 72 (projected in the direction orthogonal to the plane 9A).

Additionally, in the configuration example illustrated in FIG. 9, similarly to the above, assuming the virtual plane H1 passing through the load application point 8A and the second binding teeth 72 and extending along the linear route 4Y, the guide portion 90 is provided in each of the two regions R1 and R2 facing each other with the plane H1 interposed therebetween.

Moreover, in this configuration example, a distance L31 between the one guide portion 90E provided in the one region R1 and the plane H1 and a distance L32 between the other guide portion 90F provided in the other region R2 and the plane H1 are equal to each other.

Moreover, in this configuration example, as described above, the second binding teeth 72 are located between the one guide portion 90E and the other guide portion 90F.

In a configuration in which the second binding teeth 72 are located between one guide portion 90E and the other guide portion 90F as in this configuration example, a larger load can be exerted on the paper bundle T.

More specifically, in this configuration example, as compared to a case where the second binding teeth 72 are located at the point separated from between the one guide portion 90E and the other guide portion 90F, the second binding teeth 72 are less likely to escape upward, and a larger load is exerted on the paper bundle T.

Here, in a case where the binding processing is performed at the binding positions illustrated in (A) and (B) of FIG. 3, as in the configuration example illustrated in FIG. 8, for example, a configuration is adopted in which the rod-shaped member 640 and the guide portion 90 are not provided on both sides of the second binding teeth 72.

More specifically, in order to avoid any interference between the rod-shaped member 640 and the paper bundle T, for example, it is preferable to adopt a configuration in which the rod-shaped member 640 and the guide portion 90 are not provided on both sides of the second binding teeth 72.

In contrast, for example, in the second binding processing device 52 that performs binding only at the corner portions of the paper bundle T, as illustrated in FIG. 9, the paper bundle T can be bound even in a configuration in which the second binding teeth 72 are located between the one guide portion 90E and the other guide portion 90F.

In addition, alternatively, the guide portion 90 may be provided on the side opposite to the side where the second binding teeth 72 are located, with the load application point 8A (refer to FIG. 8) interposed therebetween.

In the present exemplary embodiment, as described above, the second binding teeth 72 receive a reaction from the paper bundle T, and the one end part 631 of the upper support member 630 moves upward. In this case, the other end part 634 (refer to FIG. 8) of the upper support member 630 moves downward.

In a case where the guide portion 90 is provided on the side opposite to the side where the second binding teeth 72 are located with the load application point 8A interposed therebetween, the downward movement of the other end part 634 of the upper support member 630 is restricted. Accordingly, even in this case, the upward movement of the one end part 631 of the upper support member 630 is restricted.

Even in this case, the second binding teeth 72 are unlikely to escape upward, and a larger load is exerted on the paper bundle T.

Figure 10:
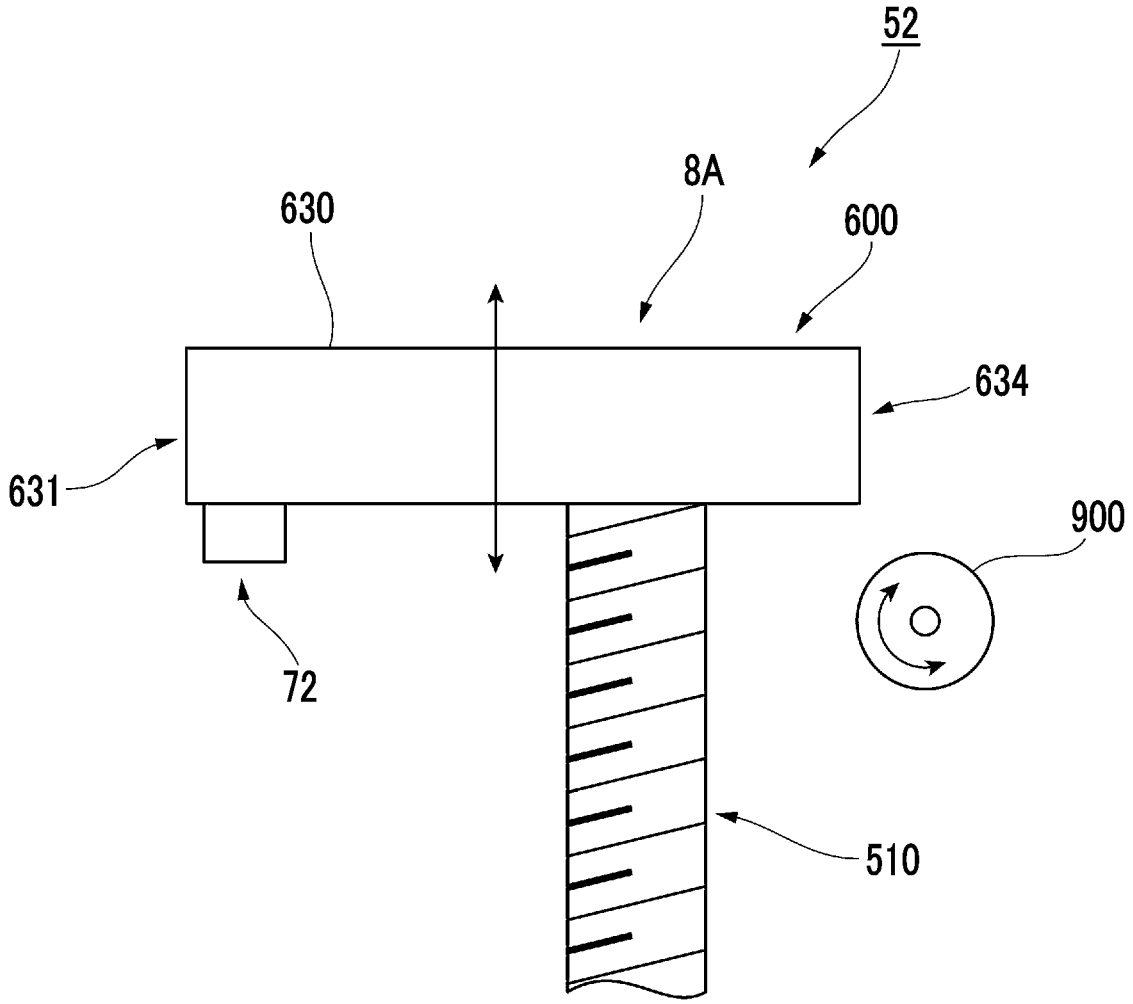
FIG. 10 is a diagram illustrating another configuration example of the second binding processing device in a case where an interlocking portion and the like are viewed from a direction indicated by arrow X in FIG. 5.

FIG. 10 is a diagram illustrating another configuration example of the second binding processing device 52 in a case where the interlocking portion 600 and the like are viewed from the direction indicated by the arrow X in FIG. 5. Here, in FIG. 10, the interlocking portion 600, the screw member 510, and the like are illustrated, and the illustration of other members is omitted.

In the configuration example illustrated in FIG. 10, a restricting portion 900 that restricts the movement of the interlocking portion 600 is provided.

The restricting portion 900 restricts the movement of a portion of the interlocking portion 600 located on the side opposite to the side where the second binding teeth 72 are located with the load application point 8A interposed therebetween.

More specifically, the restricting portion 900 comes into contact with the other end part 634 located on the side opposite to the one end part 631 that is an end part of the upper support member 630 on the side where the second binding teeth 72 are provided and restricts the downward movement of the other end part 634.

Here, in the present exemplary embodiment, as described above, the second binding teeth 72 receive a reaction from the paper bundle T, and accordingly, the other end part 634 of the upper support member 630 moves downward. The restricting portion 900 restricts the downward movement of the other end part 634.

Accordingly, even in this case, the second binding teeth 72 are less likely to escape upward, and a larger load is exerted on the paper bundle T.

Here, the restricting portion 900 of the present exemplary embodiment is constituted by a rotating body, and restricts the downward movement of the other end part 634 while allowing the downward movement of the other end part 634.

In addition, the restricting portion 900 is not limited to this, and for example, an inclined surface formed so as to extend in the upward-downward direction and approaching the other end part 634 side as the lower side may be provided, and the movement of the other end part 634 may be restricted by the inclined surface.

Figure 11:
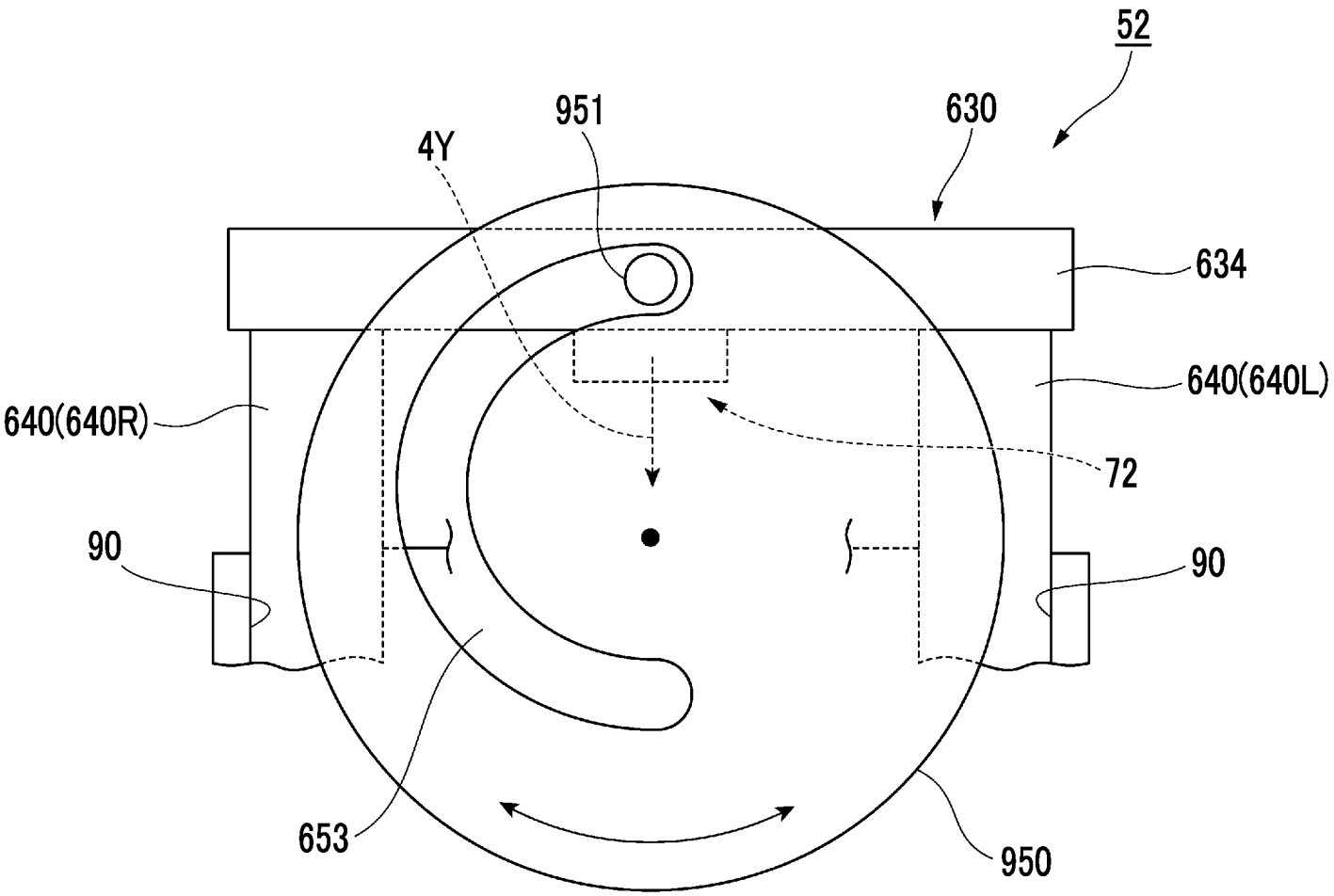
FIG. 11 is a diagram illustrating another configuration example of the second binding processing device.

FIG. 11 is a diagram illustrating another configuration example of the second binding processing device 52.

Here, FIG. 11 illustrates a part of the second binding processing device 52 in a case where the second binding processing device 52 is viewed from the direction of arrow XI in FIG. 4. In addition, FIG. 11 illustrates a state in a case where a part of the second binding processing device is viewed from the rear side of the second binding processing device 52.

In the configuration example illustrated in FIG. 11, a rotating member 950 that is rotated by a drive source such as a motor is provided behind the second binding processing device 52.

Moreover, in this configuration example, a projection 951 protruding toward the rotating member 950 is provided on the other end part 634 of the upper support member 630.

A groove 653 that accommodates the projection 951 provided on the upper support member 630 and guides the projection 951 is formed in the rotating member 950. In the configuration example, as the projection 951 is guided by an inner surface of the groove 653, the upper support member 630 moves up and down, and accordingly, the second binding teeth 72 move up and down.

In addition, also in the configuration example, similarly to the above, the rod-shaped member 640 is provided, and also in the configuration example, the guide portion 90 for guiding the rod-shaped member 640 is provided, and the second binding teeth 72 move up and down along the linear route 4Y.

Figure 12:
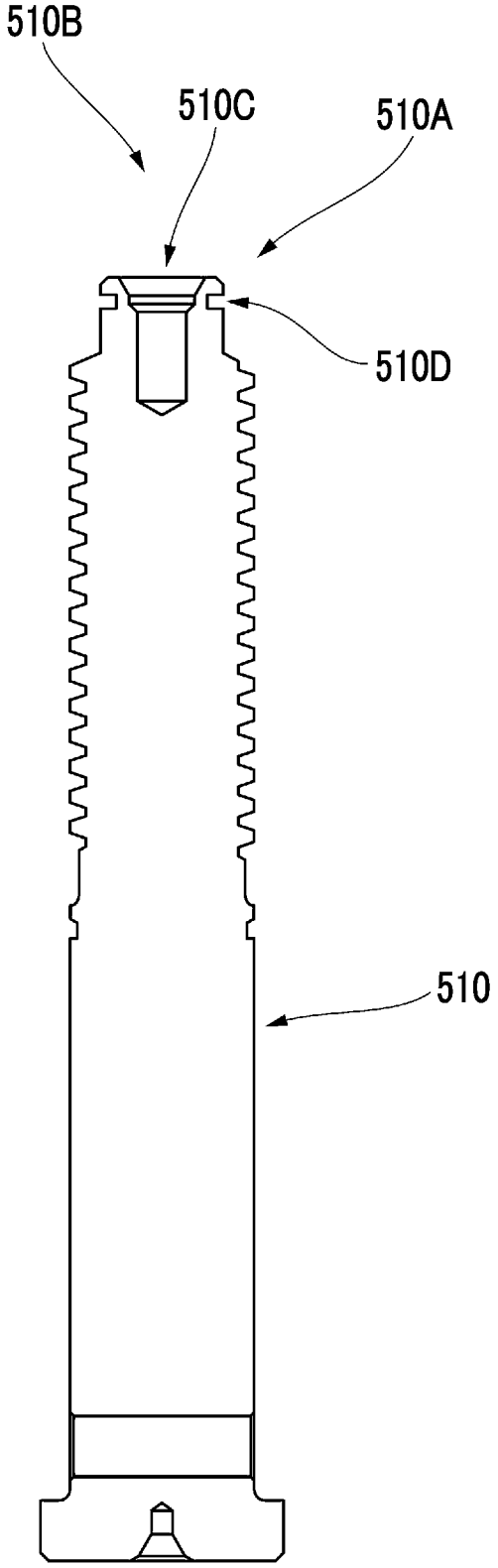
FIG. 12 is a vertical cross-sectional view of a screw member.

FIG. 12 is a vertical cross-sectional view of the screw member 510.

In the present exemplary embodiment, a restricting member that restricts the movement of the interlocking portion 600 (refer to FIG. 4) is attached to the screw member 510.

Specifically, an attached portion 510B is provided at one end part 510A of the screw member 510. The restricting member can be attached to the attached portion 510B.

Specifically, an end surface located at the one end part 510A of the screw member 510 is provided with a concave portion 510C having a circular cross section, which is recessed toward the inner side of the screw member 510. A female thread is formed on an inner surface of the concave portion 510C. In the present exemplary embodiment, a restricting member 980 (refer to FIG. 4) including a male screw is attached to the female thread portion.

In the present exemplary embodiment, in a case where the screw member 510 rotates more than necessary and the interlocking portion 600 reaches the one end part 510A (refer to FIG. 12) of the screw member 510, the interlocking portion 600 bumps against the restricting member 980 to restrict the movement of the interlocking portion 600.

Accordingly, a situation in which the interlocking portion 600 is separated from the screw member 510 is suppressed.

Additionally, in the present exemplary embodiment, a groove 510D extending in the circumferential direction of the screw member 510 is formed on the one end part 510A and the outer peripheral surface of the screw member 510.

In the present exemplary embodiment, a retainer (not illustrated) having, for example, an E-shaped or C-shaped cross section can be mounted on the groove 510D. In the present exemplary embodiment, the movement of the interlocking portion 600 can be restricted even by this retainer.

Figure 13:
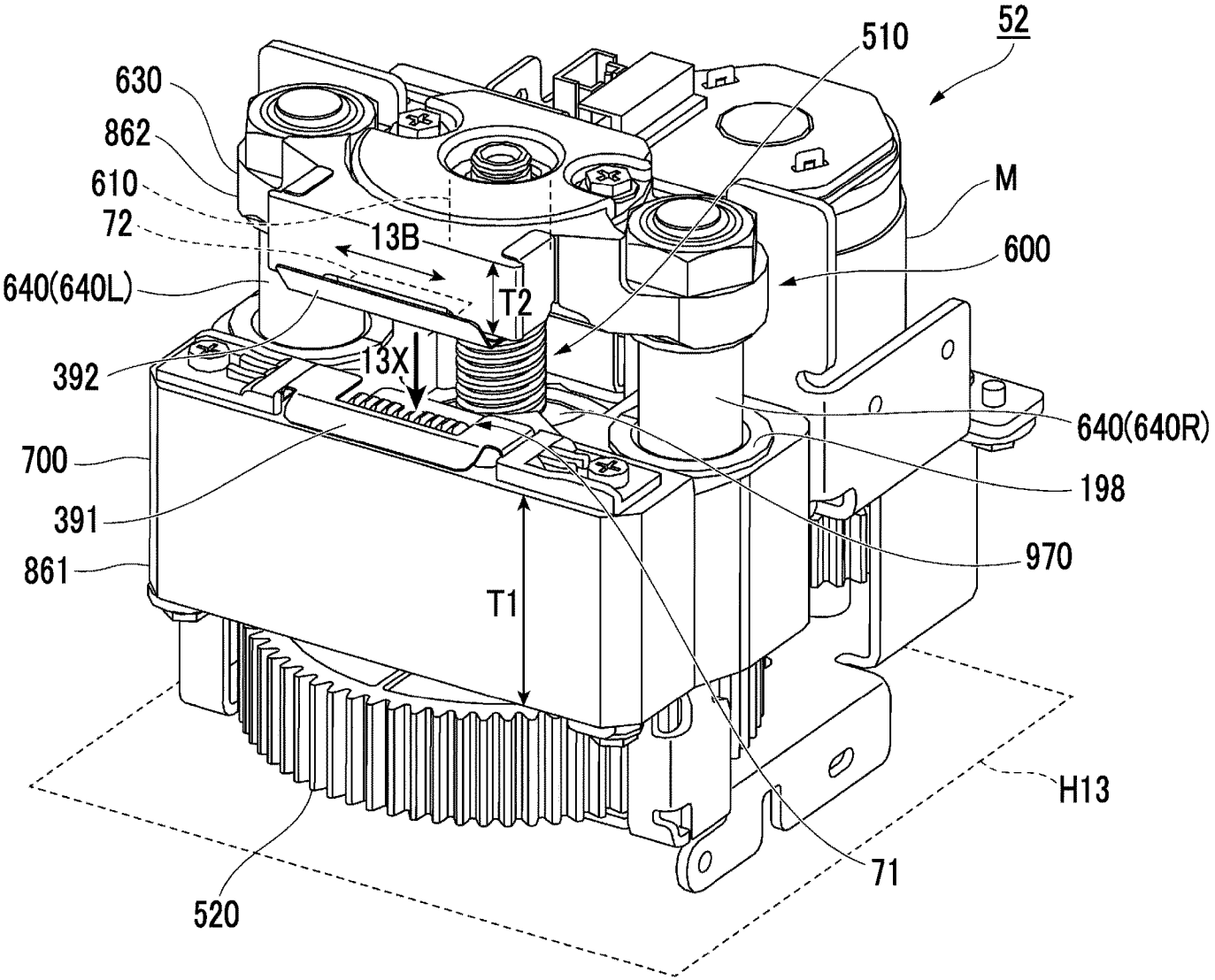
FIG. 13 is a perspective view illustrating another configuration example of the second binding processing device.

FIG. 13 is a perspective view illustrating another configuration example of the second binding processing device 52.

In addition, the components of the second binding processing device 52 illustrated in FIG. 13 are the same as the components of the second binding processing device 52 described above.

In this configuration example illustrated in FIG. 12, the positional relationship between the left rod-shaped member 640L, the right rod-shaped member 640R, the screw member 510, and the female thread portion 610 is different from the above.

Specifically, in this configuration example illustrated in FIG. 13, the screw member 510 and the female thread portion 610, which is an example of the load receiving portion, are provided between the left rod-shaped member 640L that is the first guided portion and the right rod-shaped member 640R that is the second guided portion.

More specifically, in this configuration example, in a case where the left rod-shaped member 640L, the right rod-shaped member 640R, the screw member 510, and the female thread portion 610 are projected toward the upstream side or the downstream side in the movement direction of the second binding teeth 72, the screw member 510 and the female thread portion 610 are located between the left rod-shaped member 640L and the right rod-shaped member 640R.

More specifically, a case where the left rod-shaped member 640L, the right rod-shaped member 640R, the screw member 510, and the female thread portion 610 are projected toward the upstream side or the downstream side in the movement direction of the second binding teeth 72 and toward the virtual plane H13 having a relationship orthogonal to the movement direction of the second binding teeth 72 is assumed.

In this case, the screw member 510 and the female thread portion 610 are located between the left rod-shaped member 640L and the right rod-shaped member 640R on the virtual plane H13.

Here, the expression "the screw member 510 and the female thread portion 610 are located between the left rod-shaped member 640L and the right rod-shaped member 640R" means not only a state in which all portions of the female thread portion 610 and all portions of the screw member 510 are located between the left rod-shaped member 640L and the right rod-shaped member 640R, but also a state in which a part of the female thread portion 610 and a part of the screw member 510 are located therebetween.

In addition, the present exemplary embodiment has a configuration in which all parts of the screw member 510 and all parts of the female thread portion 610 are located between the left rod-shaped member 640L and the right rod-shaped member 640R.

Additionally, in this configuration example, in a case where the left rod-shaped member 640L, the right rod-shaped member 640R, the first binding teeth 71, and the second binding teeth 72 are projected toward the upstream side or the downstream side in the movement direction of the second binding teeth 72, the first binding teeth 71 and the second binding teeth 72 are located at points out of between the left rod-shaped member 640L and the right rod-shaped member 640R.

In the present exemplary embodiment, two guided portions including the left rod-shaped member 640L and the right rod-shaped member 640R, are provided as the guided portions, but in this configuration example, the first binding teeth 71 and the second binding teeth 72 are located at points out of between the two guided portions.

More specifically, a case where the left rod-shaped member 640L, the right rod-shaped member 640R, the first binding teeth 71, and the second binding teeth 72 are projected toward the upstream side or the downstream side in the movement direction of the second binding teeth 72 and toward the above virtual plane H13 having a relationship orthogonal to the movement direction of the second binding teeth 72 is assumed.

In this case, the first binding teeth 71 and the second binding teeth 72 are located at points deviated from between the left rod-shaped member 640L and the right rod-shaped member 640R on the virtual plane H13.

Moreover, a case where the left rod-shaped member 640L, the right rod-shaped member 640R, the first binding teeth 71, and the second binding teeth 72 are projected toward the upstream side or the downstream side in the movement direction of the second binding teeth 72 is assumed.

In this case, the first binding teeth 71 and the second binding teeth 72 are located closer to the right rod-shaped member 640R side than the left rod-shaped member 640L and located closer to the left rod-shaped member 640L side than the right rod-shaped member 640R.

In other words, on the above virtual plane H13, the first binding teeth 71 and the second binding teeth 72 are located closer to the right rod-shaped member 640R side than the left rod-shaped member 640L and located closer to the left rod-shaped member 640L side than the right rod-shaped member 640R.

Additionally, a case where the left rod-shaped member 640L, the right rod-shaped member 640R, the first binding teeth 71, the second binding teeth 72, and the female thread portion 610 are projected toward the upstream side or the downstream side in the movement direction of the second binding teeth 72 is assumed.

In this case, in the present exemplary embodiment, the female thread portion 610 is located closer to the side where the left rod-shaped member 640L and the right rod-shaped member 640R are provided, than the first binding teeth 71 and the second binding teeth 72.

In other words, on the virtual plane H13, the female thread portion 610 is located closer to the side where the left rod-shaped member 640L and the right rod-shaped member 640R are provided, than the first binding teeth 71 and the second binding teeth 72.

Additionally, a case where the left rod-shaped member 640L, the right rod-shaped member 640R, the screw member 510, and the female thread portion 610 are projected toward the upstream side or the downstream side in the movement direction of the second binding teeth 72 is assumed.

In this case, in the present exemplary embodiment, the screw member 510 and the female thread portion 610 as an example of the load receiving portion are located between the left rod-shaped member 640L and the right rod-shaped member 640R.

In other words, on the virtual plane H13, the screw member 510 and the female thread portion 610 are located between the left rod-shaped member 640L and the right rod-shaped member 640R.

In other words, on the virtual plane H13, the screw member 510 and the female thread portion 610 are located in a region sandwiched between the left rod-shaped member 640L and the right rod-shaped member 640R.

Additionally, in the configuration example illustrated in FIG. 13, a first elastic member 391 for separating the paper bundle T (not illustrated in FIG. 13) after the binding processing from the first binding teeth 71 is attached to the lower support member 700.

Additionally, in the present exemplary embodiment, a second elastic member 392 for separating the paper bundle T after the binding processing from the second binding teeth 72 is attached to the upper support member 630.

In the present exemplary embodiment, in a case where binding is performed on the paper bundle T, the first elastic member 391 and the second elastic member 392 are sandwiched and compressed by the upper support member 630 and the lower support member 700.

Additionally, in the present exemplary embodiment, in a case where the binding on the paper bundle T is completed and the second binding teeth 72 retreat from the first binding teeth 71, the first elastic member 391 and the second elastic member 392 in the compressed state are restored.

Accordingly, the paper bundle T is pressed by the first elastic member 391 and the second elastic member 392, and the paper bundle T is separated from the first binding teeth 71 and the second binding teeth 72.

In addition, although the description is omitted above, the first elastic member 391 and the second elastic member 392 are similarly provided in the second binding processing device 52 illustrated in FIGS. 4 to 11.

Figure 14A:
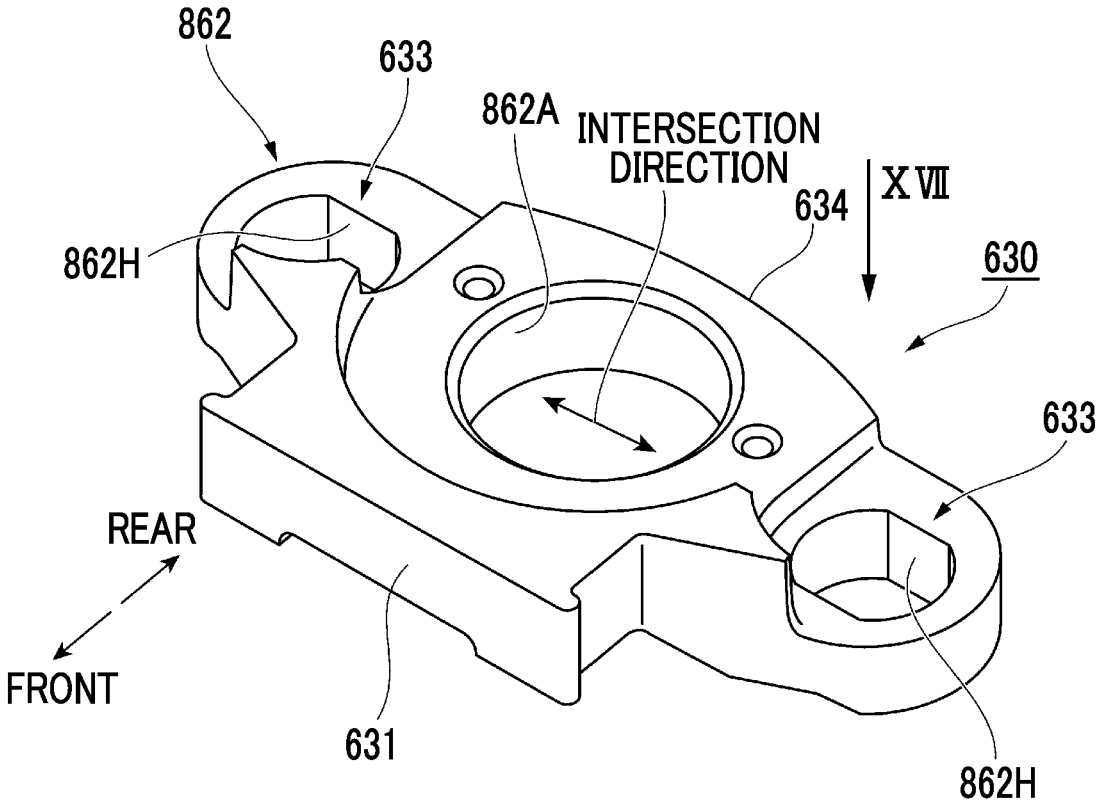
FIG. 14A and FIG. 14B are perspective views of an upper support member provided in the second binding processing device.
Figure 14B:
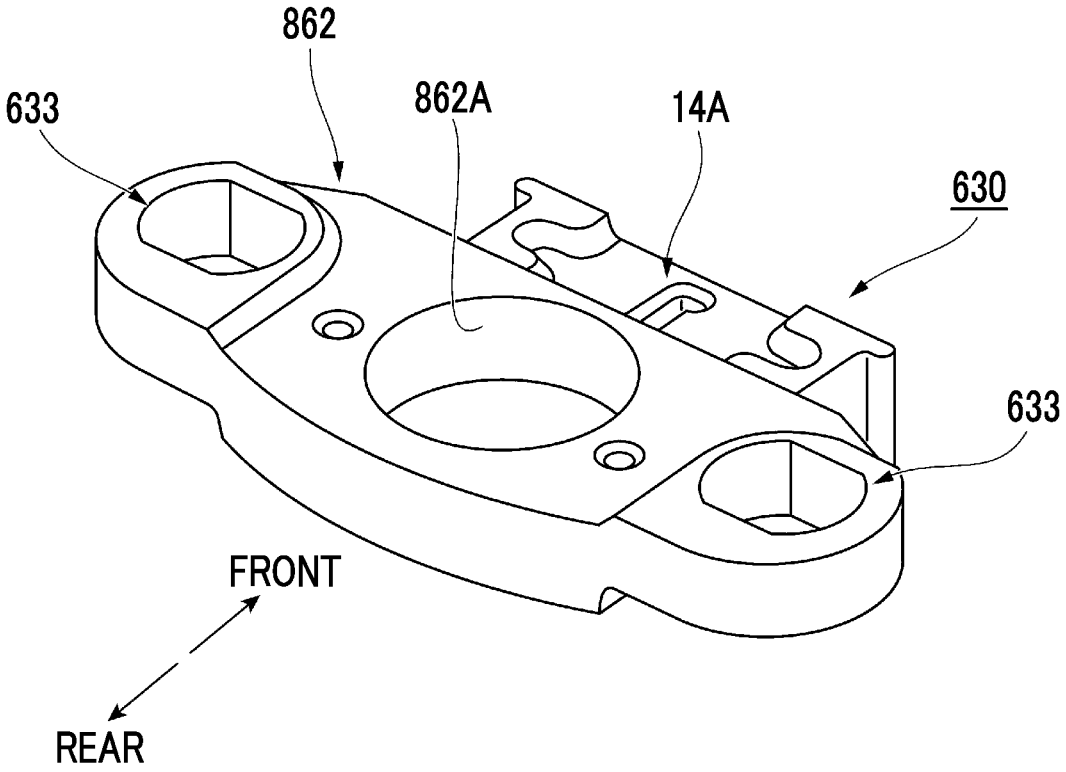

FIGS. 14A and 14B are perspective views of the upper support member 630 provided in the second binding processing device 52 illustrated in FIG. 13. In addition, FIG. 14(A) is a perspective view in a case where the upper support member 630 is viewed from above, and FIG. 14(B) is a perspective view in a case where the upper support member 630 is viewed from below.

As described above, the upper support member 630 supports the second binding teeth 72 (not illustrated in FIG. 14), which is an example of the second teeth. In the present exemplary embodiment, the second binding teeth 72 are fixed to the point of the upper support member 630 indicated by reference numeral 14A in FIG. 14B by press fitting.

The upper support member 630 is made of a metal block (hereinafter referred to as "second metal block 862"). In addition, the upper support member 630 in the exemplary embodiment illustrated in FIGS. 4 to 11 is also made of a metal block.

The second metal block 862 is made of a metallic sintered body, and the hardness of the second metal block 862 is high.

In addition, the second metal block 862 may be formed by casting or forging. In a case where the second metal block 862 is made of the metallic sintered body or is formed by the casting or forging, the hardness of the second metal block 862 becomes larger.

The interlocking portion 600 (refer to FIG. 13) is constituted by a combination of a plurality of members. In the present exemplary embodiment, a member to which the second binding teeth 72 of the interlocking portion 600 is attached is constituted by the second metal block 862.

Moreover, in the present exemplary embodiment, as illustrated in FIG. 14, the second metal block 862 is provided with a moving member hole 862A. In the present exemplary embodiment, the above screw member 510, which is an example of a moving member, is passed through the moving member hole 862A.

In other words, in the present exemplary embodiment, the above screw member 510, which is an example of the moving member used for moving the second metal block 862 toward the first metal block 861 (to be described below), is passed through the moving member hole 862A.

Additionally, as illustrated in FIG. 14, two through-holes 633 are formed in the second metal block 862.

Here, the through-hole 633 is an example of a guiding hole, and in the present exemplary embodiment, the rod-shaped member 640, which is a guiding member used for guiding the second metal block 862 that moves toward the first metal block 861, is inserted into the through-hole 633.

In this configuration example, the moving member hole 862A is provided between the two through-holes 633.

Figure 15:
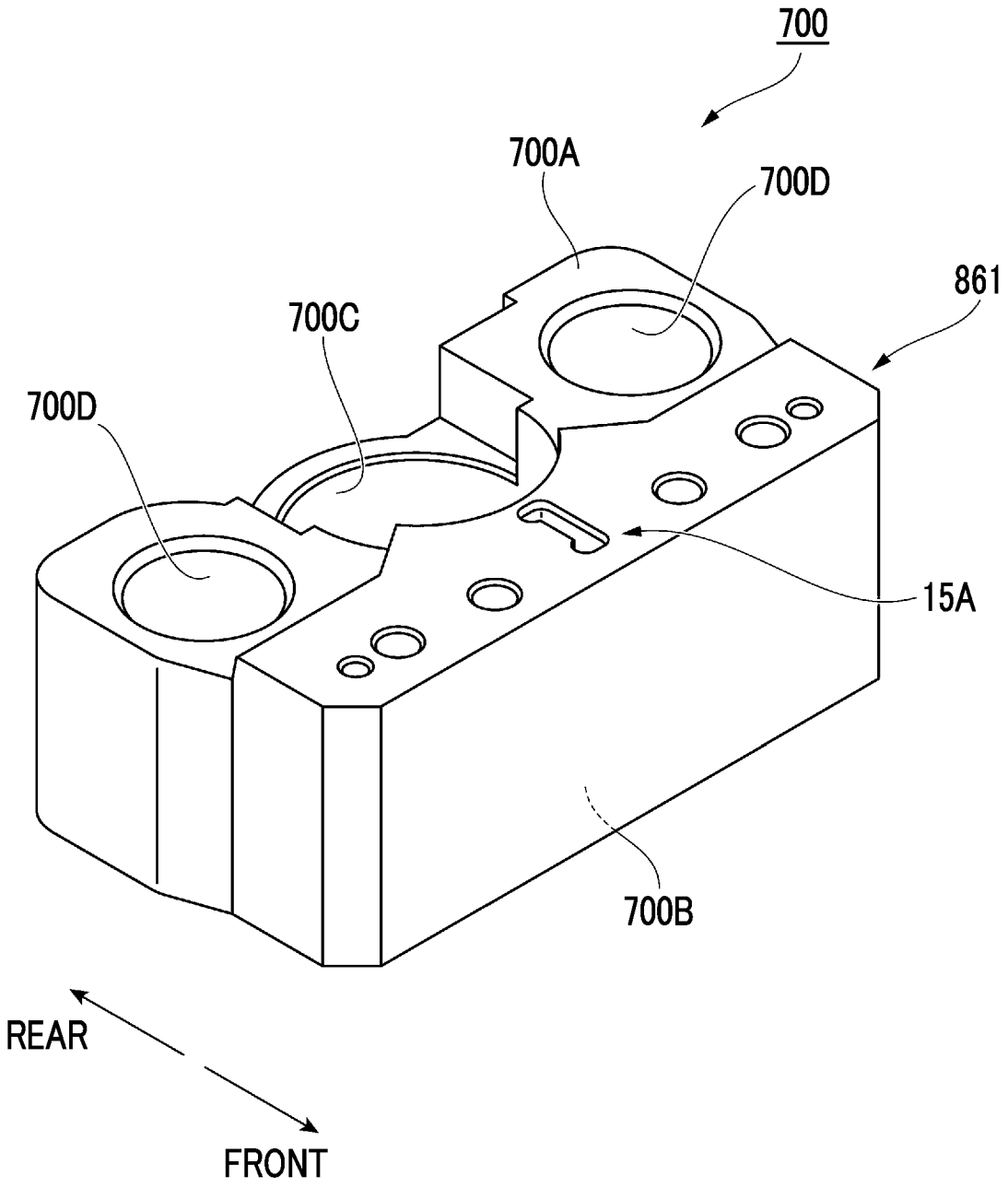
FIG. 15 is a perspective view of a lower support member.

FIG. 15 is a perspective view of the lower support member 700.

As described above, the lower support member 700 supports the first binding teeth 71 (not illustrated in FIG. 15) that is an example of the first teeth. Specifically, in the present exemplary embodiment, the first binding teeth 71 are fixed to a point indicated by reference numeral 15A by press fitting.

The lower support member 700 is also made of a metal block (hereinafter, referred to as "first metal block 861"). In addition, the lower support member 700 in the exemplary embodiment illustrated in FIGS. 4 to 11 is also made of a metal block.

The first metal block 861 is made of a metallic sintered body, and the hardness of the first metal block 861 is high.

In addition, the first metal block 861 may be formed by casting or forging. In a case where the first metal block 861 is made of the metallic sintered body or is formed by the casting or forging, the hardness of the first metal block 861 is increased.

In the present specification, the term "metal block" refers to a metal lump formed by any method of casting, forging, or sintering, rather than a sheet metal or one obtained by bending the sheet metal.

As an example of the support member, the lower support member 700 has one surface 700A and the other surface 700B. In other words, the first metal block 861 has one surface 700A and the other surface 700B.

The first binding teeth 71 are attached to the one surface 700A side of the lower support member 700.

Additionally, the lower support member 700 is provided with a through-hole 700C extending from the other surface 700B toward the one surface 700A. The screw member 510 (refer to FIG. 13) is passed through the through-hole 700C.

In addition, in the present exemplary embodiment, as illustrated in FIG. 13, a cylindrical bearing 970 is disposed in the through-hole 700C. In the present exemplary embodiment, the portion of the screw member 510 located in the through-hole 700C is supported by the bearing 970.

The through-hole 700C (refer to FIG. 15) can be regarded as a moving member hole, and the lower support member 700 is also provided with a moving member hole through which the screw member 510, which is an example of the moving member, is passed.

Additionally, the lower support member 700 is provided with two guiding holes 700D into which the rod-shaped member 640, which is a guiding member used for guiding the second metal block 862 that moves toward the first metal block 861, is inserted.

In the present exemplary embodiment, the hole portion 91 illustrated in FIG. 5 is realized by the guiding hole 700D.

In the present exemplary embodiment, the through-hole 700C as an example of the moving member hole is provided between the two guiding holes 700D.

The interlocking portion 600 illustrated in FIG. 13 is provided on one surface 700A side of the lower support member 700 illustrated in FIG. 15.

In the present exemplary embodiment, in a case where the screw member 510 (FIG. 13) rotates in the circumferential direction, the interlocking portion 600 approaches one surface 700A (refer to FIG. 15) of the lower support member 700.

Accordingly, the second binding teeth 72 attached to the interlocking portion 600 approaches the first binding teeth 71 attached to the one surface 700A side.

Additionally, also in this configuration example illustrated in FIG. 13, the larger-diameter gear 520, which is connected to the screw member 510 and receives a driving force transmitted to the screw member 510, is provided similar to the above.

The larger-diameter gear 520 sandwiches the lower support member 700 and is provided on the side opposite to the installation side of the interlocking portion 600.

Figure 16:
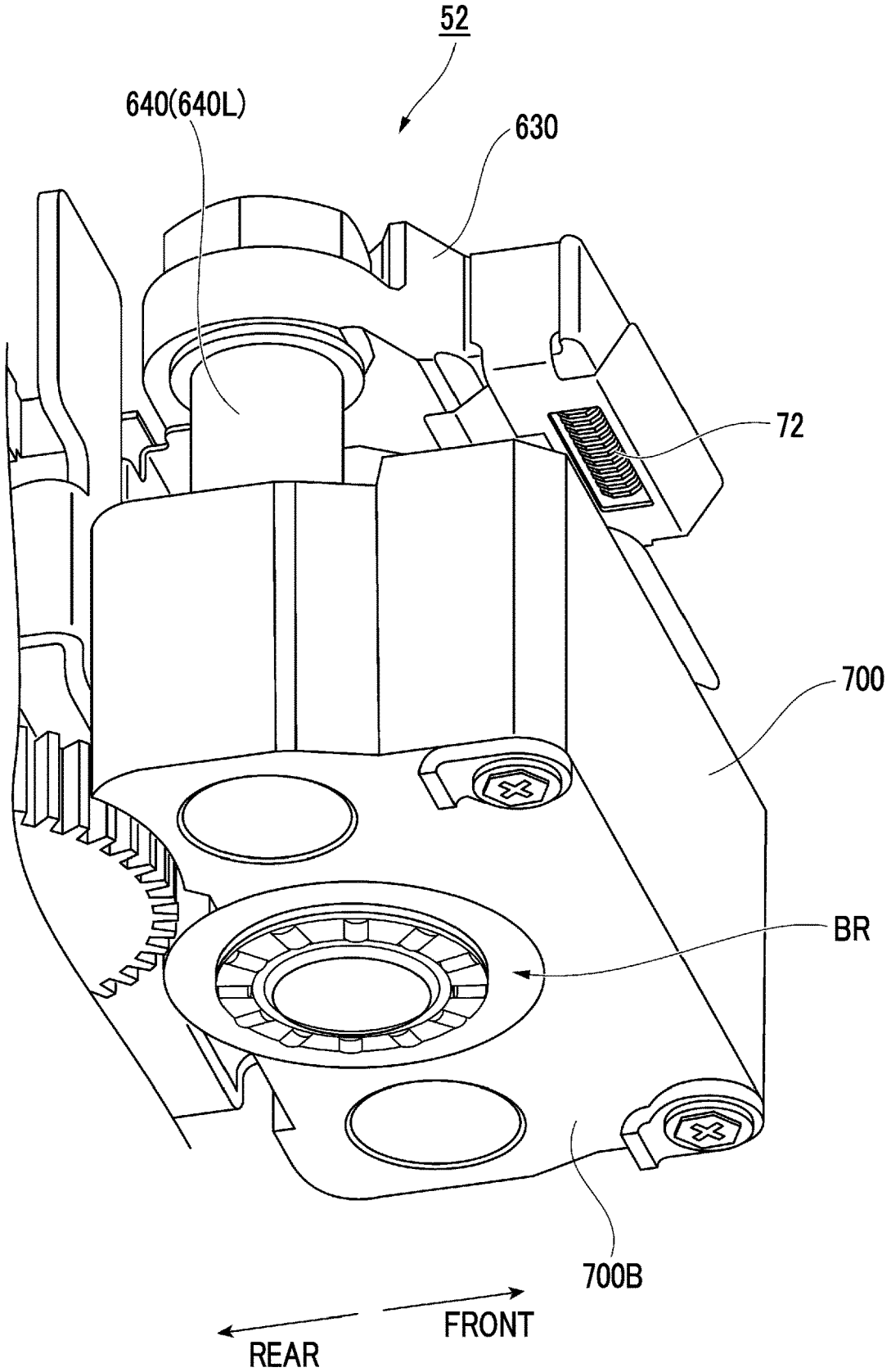
FIG. 16 is a perspective view in a case where the second binding processing device is viewed from below and is a view showing a state of the second binding processing device in a state where a larger-diameter gear is removed.

FIG. 16 is a perspective view in a case where the second binding processing device 52 is viewed from below and is a view illustrating a state of the second binding processing device 52 in a state where the larger-diameter gear 520 is removed.

In the present exemplary embodiment, a bearing BR is provided between the lower support member 700 and the larger-diameter gear 520 (refer to FIG. 13).

More specifically, in the present exemplary embodiment, a thrust bearing in which columnar rotating bodies are disposed radially is provided as the bearing BR.

In the present exemplary embodiment, in a case where the second binding teeth 72 are pushed against the paper bundle T, the larger-diameter gear 520 is pressed against the other surface 700B of the lower support member 700, and the larger-diameter gear 520 is less likely to rotate.

In contrast, in a case where the bearing BR is provided as in the present exemplary embodiment, the larger-diameter gear 520 is more likely to rotate than in a case where the bearing BR is not provided.

In the present exemplary embodiment, the hardness of the second metal block 862 (refer to FIG. 14) constituting the upper support member 630 is different from the hardness of the first metal block 861 (refer to FIG. 15) constituting the lower support member 700.

In the present exemplary embodiment, the hardness of the second metal block 862 is higher than the hardness of the first metal block 861.

In other words, in the present exemplary embodiment, the hardness of the second metal block 862, which is a member to which the second binding teeth 72 are attached, of the interlocking portion 600, is larger than the hardness of the first metal block 861 that a member to which the first binding teeth 71 are attached.

More specifically, in the present exemplary embodiment, the second metal block 862 is hardened, while the first metal block 861 is not hardened, and the hardness of the second metal block 862 is higher than the hardness of the first metal block 861.

In the present exemplary embodiment, the first metal block 861 and the second metal block 862 are formed of an SUS-based metal. In addition, not limited to this, the first metal block 861 and the second metal block 862 may be formed of metals other than the SUS-based metal.

Additionally, in the present exemplary embodiment, the hardness of the first binding teeth 71 and the second binding teeth 72 are the largest. Next, the hardness of the second metal block 862 is large, and then the hardness of the first metal block 861 is large.

Additionally, in the present exemplary embodiment, the volume of the first metal block 861 and the volume of the second metal block 862 are different from each other.

Specifically, in the present exemplary embodiment, the volume of the second metal block 862 is smaller than the volume of the first metal block 861.

In other words, in the present exemplary embodiment, the volume of the second metal block 862, which is a member to which the second binding teeth 72 are attached, of the interlocking portion 600, is larger than the volume of the first metal block 861 that a member to which the first binding teeth 71 are attached.

In the present exemplary embodiment, in a case where the second binding teeth 72 move toward the first binding teeth 71, the first binding teeth 71 are in a stationary state without movement.

In the present exemplary embodiment, the first binding teeth 71 in the stationary state and the first metal block 861 supporting the first binding teeth 71 receive a load from the second binding teeth 72.

In the present exemplary embodiment, the volume of the first metal block 861, which is a metal block that receives the load, is larger than the volume of the second metal block 862 that moves.

Additionally, in the present exemplary embodiment, in a case where the thicknesses of the screw members 510 in the axial direction is compared, as illustrated in FIG. 13, a thickness T1 of the first metal block 861 is larger than a thickness T2 of the second metal block 862.

In the present exemplary embodiment, as described above, the first binding teeth 71 are disposed in a stationary state without movement, and the first binding teeth 71 and the first metal block 861 receive the load from the second binding teeth 72.

In the present exemplary embodiment, the thickness T1 of the first metal block 861, which is a metal block that receives the load, is larger than the thickness T2 of the second metal block 862 that moves.

In the present exemplary embodiment, the rod-shaped member 640 guided by the first metal block 861 is attached to the second metal block 862 illustrated in FIG. 14.

Specifically, in the present exemplary embodiment, the rod-shaped member 640 as an example of a guided member is fixed to the second metal block 862 in a state where the rod-shaped member 640 is inserted into the through-hole 633 that is an example of a hole provided in the second metal block 862.

Additionally, in the present exemplary embodiment, the rod-shaped member 640 is guided by an inner surface of the guiding hole 700D that is an example of a hole provided in the first metal block 861 (refer to FIG. 15).

Moreover, in the present exemplary embodiment, the second metal block 862 is movable with respect to the rod-shaped member 640 (refer to FIG. 13), and the second metal block 862 is movable in a direction intersecting the movement direction of the second binding teeth 72.

Specifically, in the present exemplary embodiment, a direction indicated by arrow 13X in FIG. 13 is the movement direction of the second binding teeth 72, and the second metal block 862 is movable in a direction indicated by arrow 13B that is the direction intersecting the movement direction.

Specifically, as described above and as illustrated in FIG. 14, in the present exemplary embodiment, the through-hole 633 as an example of a hole portion provided in the upper support member 630 is an elongated hole.

Accordingly, the second metal block 862 is movable in the direction intersecting the movement direction of the second binding teeth 72.

Figure 17:
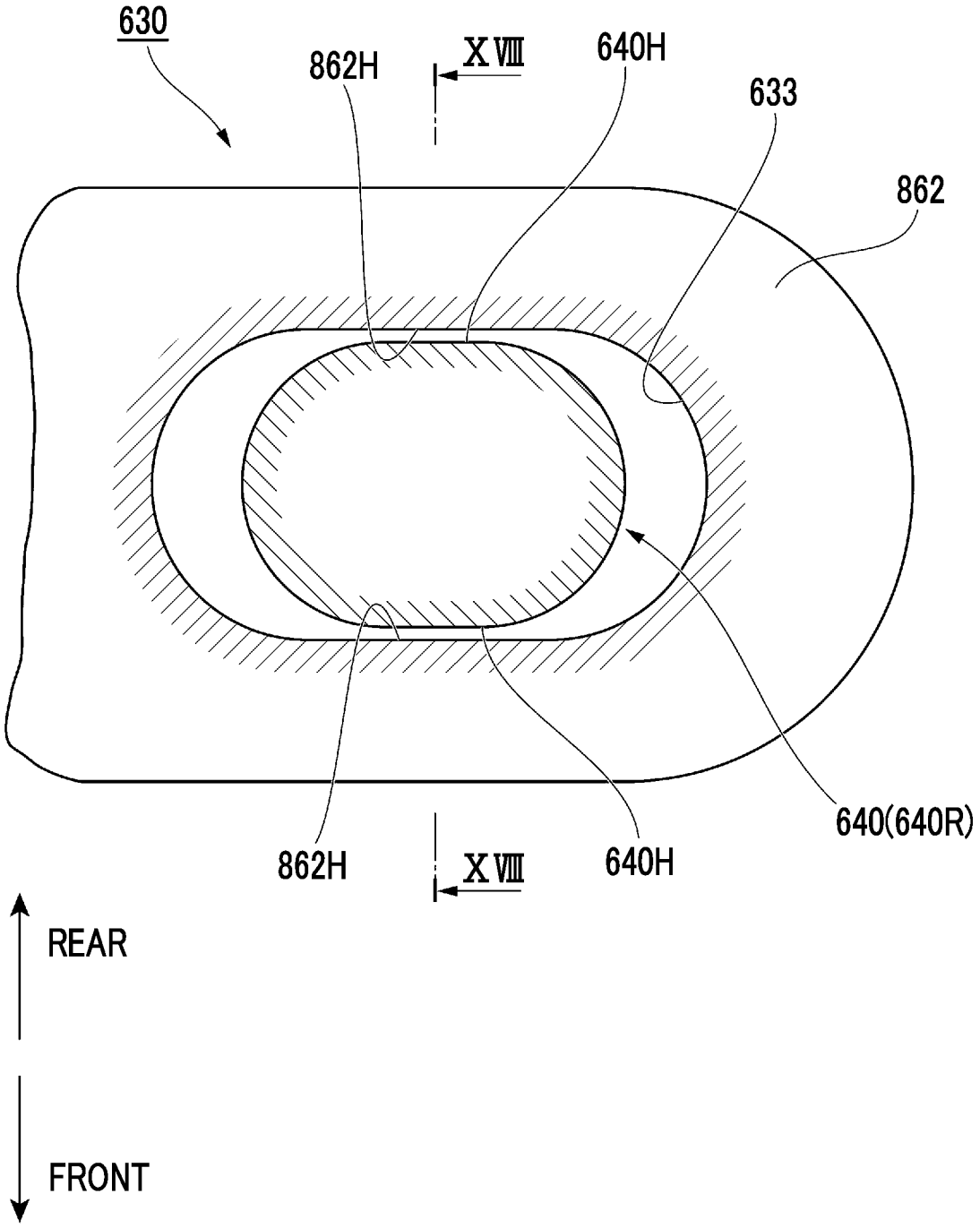
FIG. 17 is a diagram illustrating a through-hole and a rod-shaped member inserted into the through-hole from a direction indicated by arrow XVII in FIG. 14.

FIG. 17 is a diagram of the through-hole 633 and the rod-shaped member 640 inserted into the through-hole 633 from a direction indicated by arrow XVII of FIG. 14.

In the present exemplary embodiment, a flat surface 640H is provided on the portion of the rod-shaped member 640 facing the second metal block 862. Specifically, a flat surface 640H is provided on the portion of the rod-shaped member 640 facing the inner surface of the through-hole 633.

Additionally, in the present exemplary embodiment, a flat surface 862H along the flat surface 640H is provided at the portion of the second metal block 862 facing the flat surface 640H.

More specifically, in the present exemplary embodiment, the flat surface 862H facing the flat surface 640H provided on the rod-shaped member 640 is provided on an inner surface of the through-hole 633 formed as an elongated hole.

In the present exemplary embodiment, the flat surface 640H provided on the rod-shaped member 640 and the flat surface 862H provided on the second metal block 862 extend in a direction intersecting (orthogonal to) a direction from one end part 631 (refer to FIG. 14A) of the second metal block 862 toward the other end part 634.

As illustrated in FIG. 14A, the second metal block 862 has one end part 631 and the other end part 634 that have mutually different positions in the depth direction of the second binding processing device 52.

In the present exemplary embodiment, the second binding teeth 72 (refer to FIG. 13) is attached to the one end part 631 of the second metal block 862.

Then, in the present exemplary embodiment, the flat surface 640H provided on the rod-shaped member 640 and the flat surface 862H provided on the second metal block 862 extend in the direction intersecting the direction from the one end part 631 toward the other end part 634.

Figure 18:
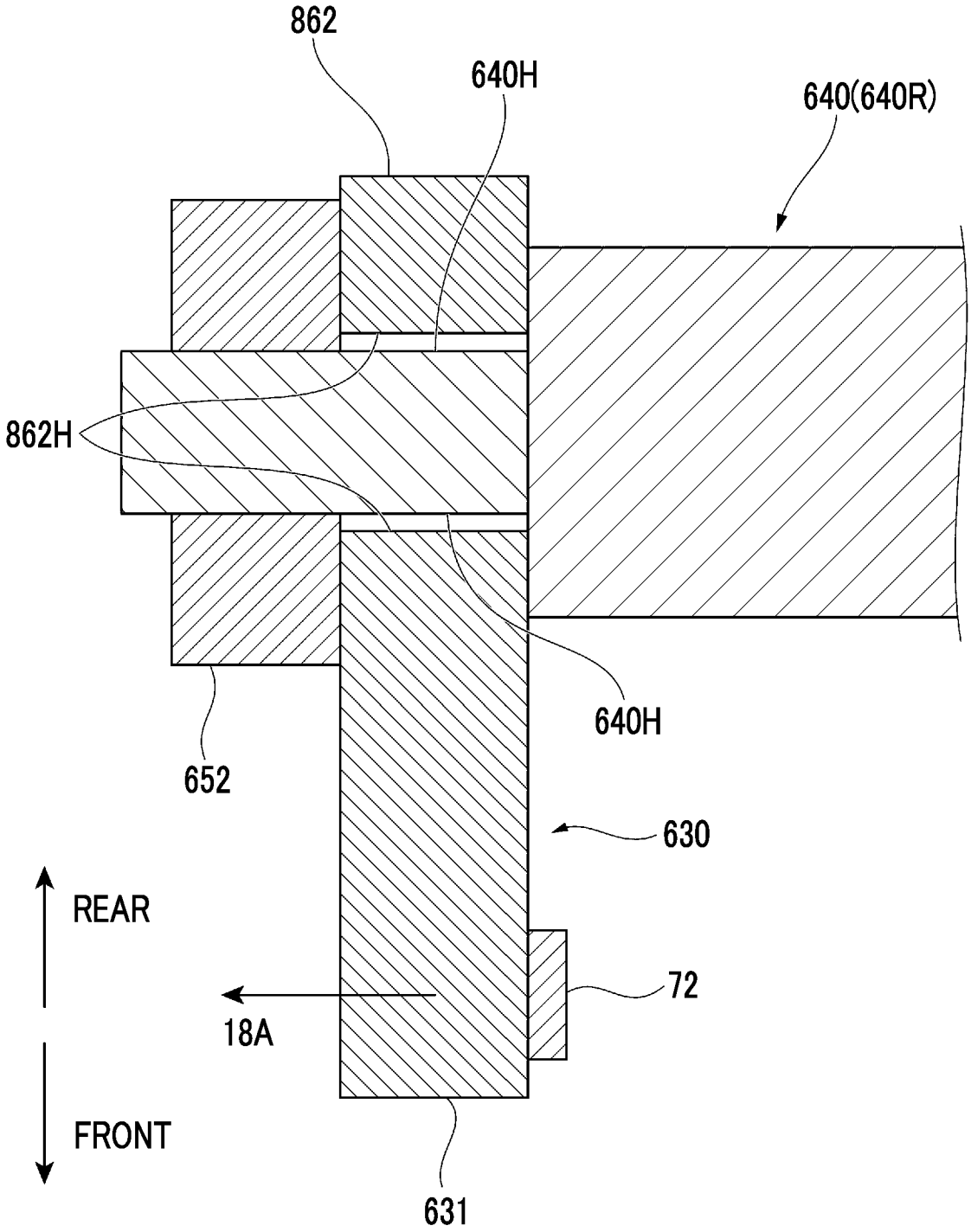
FIG. 18 is a cross-sectional view taken along line XVIII-XVIII in FIG. 17.

FIG. 18 is a cross-sectional view taken along line XVIII-XVIII in FIG. 17.

In the present exemplary embodiment, in a case where the second binding teeth 72 provided on the second metal block 862 is pushed against the paper bundle T, a reaction force acts on the second binding teeth 72, and one end part 631 of the upper support member 630 is pressed in a direction indicated by arrow 18A.

In this case, in a case where the flat surfaces 640H and 862H extending in the above intersecting directions face each other as in the present exemplary embodiment, the flat surfaces come into contact with each other. Accordingly, the deformation of the upper support member 630 is suppressed by the rod-shaped member 640.

In this case, the load acting on the paper bundle T from the second binding teeth 72 is larger than that in a configuration in which no flat surface is provided and the upper support member 630 is easily deformed.

Figure 19:
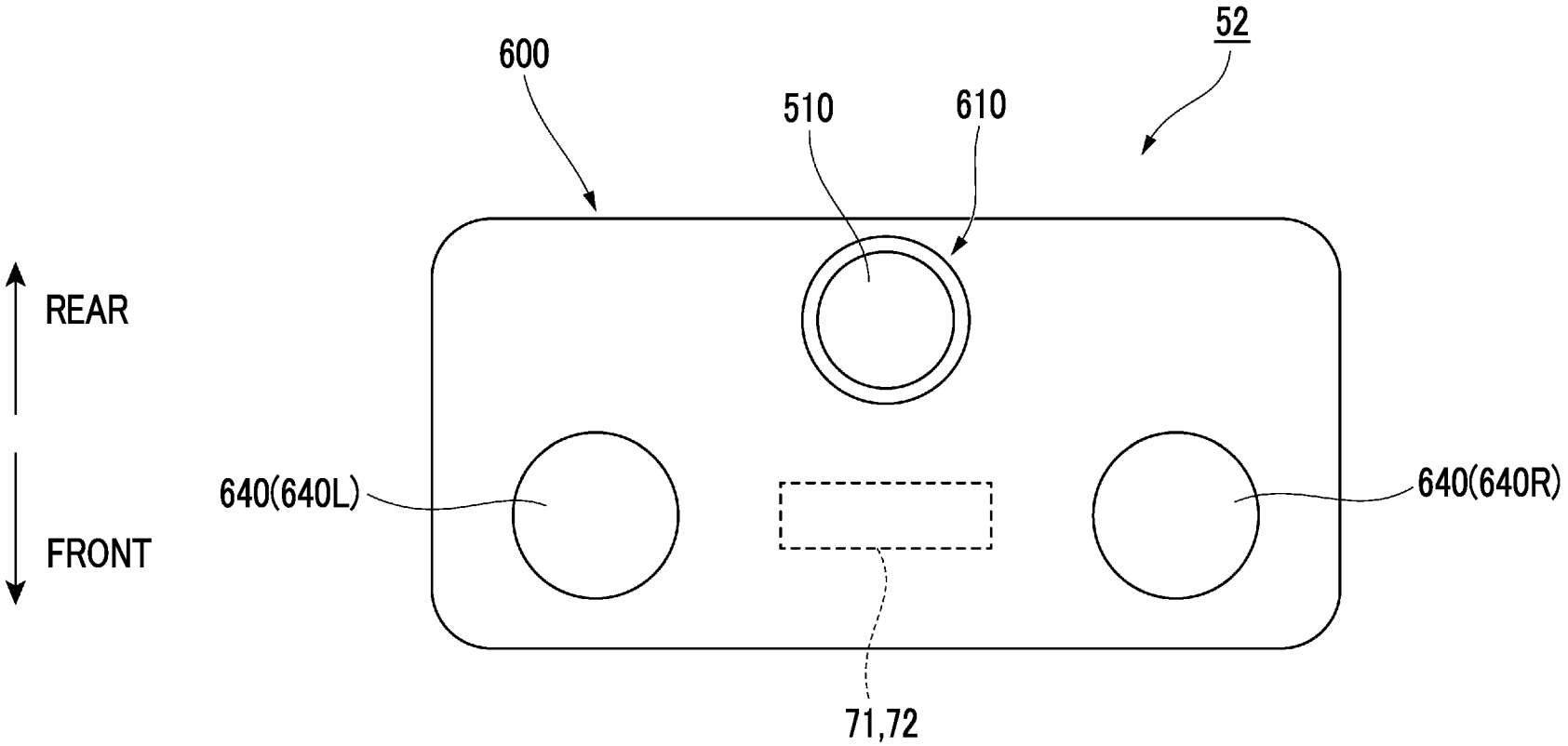
FIG. 19 is a diagram illustrating another configuration example of the second binding processing device.

FIG. 19 is a diagram illustrating another configuration example of the second binding processing device 52. In addition, FIG. 19 illustrates a state in a case where the second binding processing device 52 is viewed from above.

In this configuration example, similar to the above, the two rod-shaped members 640 including the left rod-shaped member 640L and the right rod-shaped member 640R are provided as the guided portions provided in the interlocking portion 600.

Additionally, in this configuration example, in a case where the left rod-shaped member 640L, the right rod-shaped member 640R, the first binding teeth 71, and the second binding teeth 72 are projected toward the upstream side or the downstream side in the movement direction of the second binding teeth 72, the first binding teeth 71 and the second binding teeth 72 are located between the left rod-shaped member 640L and the right rod-shaped member 640R.

More specifically, a case where the left rod-shaped member 640L, the right rod-shaped member 640R, the first binding teeth 71, and the second binding teeth 72 are projected onto the above virtual plane H13 (refer to FIG. 13) is assumed.

In this case, the first binding teeth 71 and the second binding teeth 72 are located between the left rod-shaped member 640L and the right rod-shaped member 640R on the virtual plane H13.

Additionally, in this configuration example illustrated in FIG. 19, the screw member 510 and the female thread portion 610 are located at points deviated from between the left rod-shaped member 640L and the right rod-shaped member 640R.

A case where the screw member 510, the female thread portion 610, the left rod-shaped member 640L, and the right rod-shaped member 640R are projected onto the above virtual plane H13 is assumed.

In this case, the screw member 510 and the female thread portion 610 are located at points deviated from between the left rod-shaped member 640L and the right rod-shaped member 640R on the virtual plane H13.

As in this configuration example illustrated in FIG. 19, the first binding teeth 71 and the second binding teeth 72 may be positioned between the left rod-shaped member 640L and the right rod-shaped member 640R.

In a case where the first binding teeth 71 and the second binding teeth 72 are positioned between the left rod-shaped member 640L and the right rod-shaped member 640R, binding cannot be performed at the binding positions in (A) and (B) of FIG. 3. Specifically, the paper bundle T interferes with the left rod-shaped member 640L and the right rod-shaped member 640R, and binding cannot be performed.

However, even in this configuration example illustrated in FIG. 19, at the binding positions in (C) and (D) of FIG. 3, this interference can be avoided and the binding of the paper bundle T can be performed.

Additionally, in the present exemplary embodiment, the separation distance between the second binding teeth 72 and the screw member 510 that is an example of a connecting member is equal to or less than the size of a margin at a corner portion of the paper P constituting the paper bundle T to be a binding processing target.

Here, the screw member 510 of the present exemplary embodiment is connected to the interlocking portion 600 and also functions as a connecting member that applies a load for moving the second binding teeth 72 to the interlocking portion 600.

In the present exemplary embodiment, the separation distance between the second binding teeth 72 and the screw member 510, which is an example of the connecting member, is equal to or less than the size of the margin at the corner portion of the paper P.

Figure 20B:
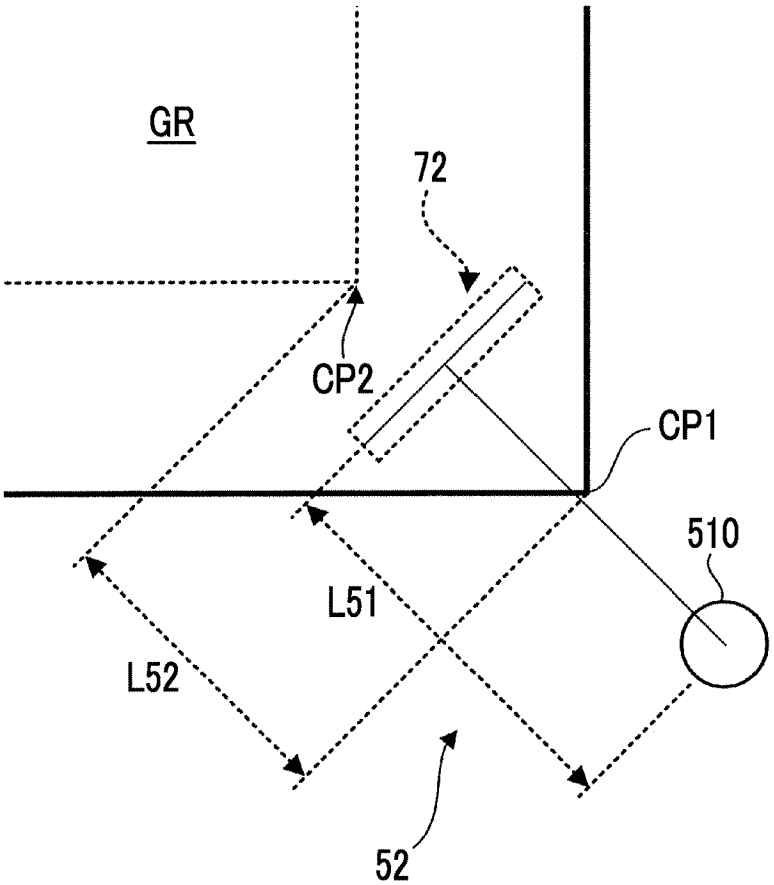
FIGS. 20A and 20B are diagrams in a case where the second binding processing device and the like are viewed from above.
Figure 20A:
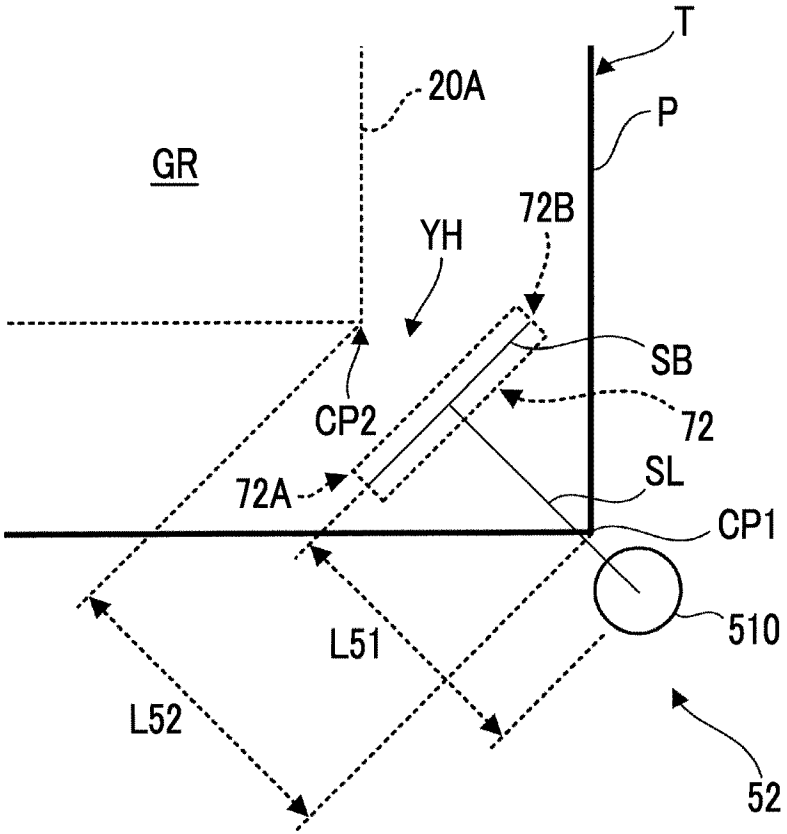

More specifically, as illustrated in FIG. 20A (a drawing in a case where the second binding processing device and the like are viewed from above), in the present exemplary embodiment, assuming a perpendicular bisector SL with respect to a line segment SB connecting one end 72A and the other end 72B of the second binding teeth 72 in the longitudinal direction of the second binding teeth 72, the screw member 510 as an example of the connecting member is located on the perpendicular bisector SL.

In the present exemplary embodiment, a separation distance L51 between the second binding teeth 72 and the screw member 510 on the perpendicular bisector SL is equal to or less than the size of a margin YH at a corner portion CP1 of the paper P constituting the paper bundle T.

The margin YH in the corner portion CP1 of the paper P constituting the paper bundle T refers to a portion located between a corner portion CP2 of a rectangular image forming region GR (a region inside a broken line 20A) in which the image of the paper P is formed, and the corner portion CP1 of the paper P.

Additionally, the size of the margin YH in the corner portion CP1 of the paper P constituting the paper bundle T refers to a separation distance L52 between the corner portion CP2 of the rectangular image forming region GR and the corner portion CP1 of the paper P.

In the present exemplary embodiment, a separation distance L51 between the second binding teeth 72 and the screw member 510 on the perpendicular bisector SL is equal to or less than a separation distance L52 between the corner portion CP2 of the image forming region GR and the corner portion CP1 of the paper P.

Here, as illustrated in FIG. 20B, a case where the separation distance L51 between the second binding teeth 72 and the screw member 510 is larger than the separation distance L52 between the corner portion CP2 of the image forming region GR and the corner portion CP1 of the paper P is assumed.

In this case, as illustrated in FIG. 20B, the screw member 510 is separated from the corner portion CP1 of the paper P, and accordingly, the entire second binding processing device 52 is separated from the paper P.

In this case, the size of the first post-processing device 40 (refer to FIG. 1) is increased by the amount that the second binding processing device 52 is separated from the paper P.

In contrast, in a case where the separation distance L51 between the second binding teeth 72 and the screw member 510 is equal to or less than the separation distance L52 between the corner portion CP2 of the image forming region GR and the corner portion CP1 of the paper P, the second binding processing device 52 is disposed closer to the paper P. In this case, the increase in size of the first post-processing device 40 is suppressed.

Figure 21:
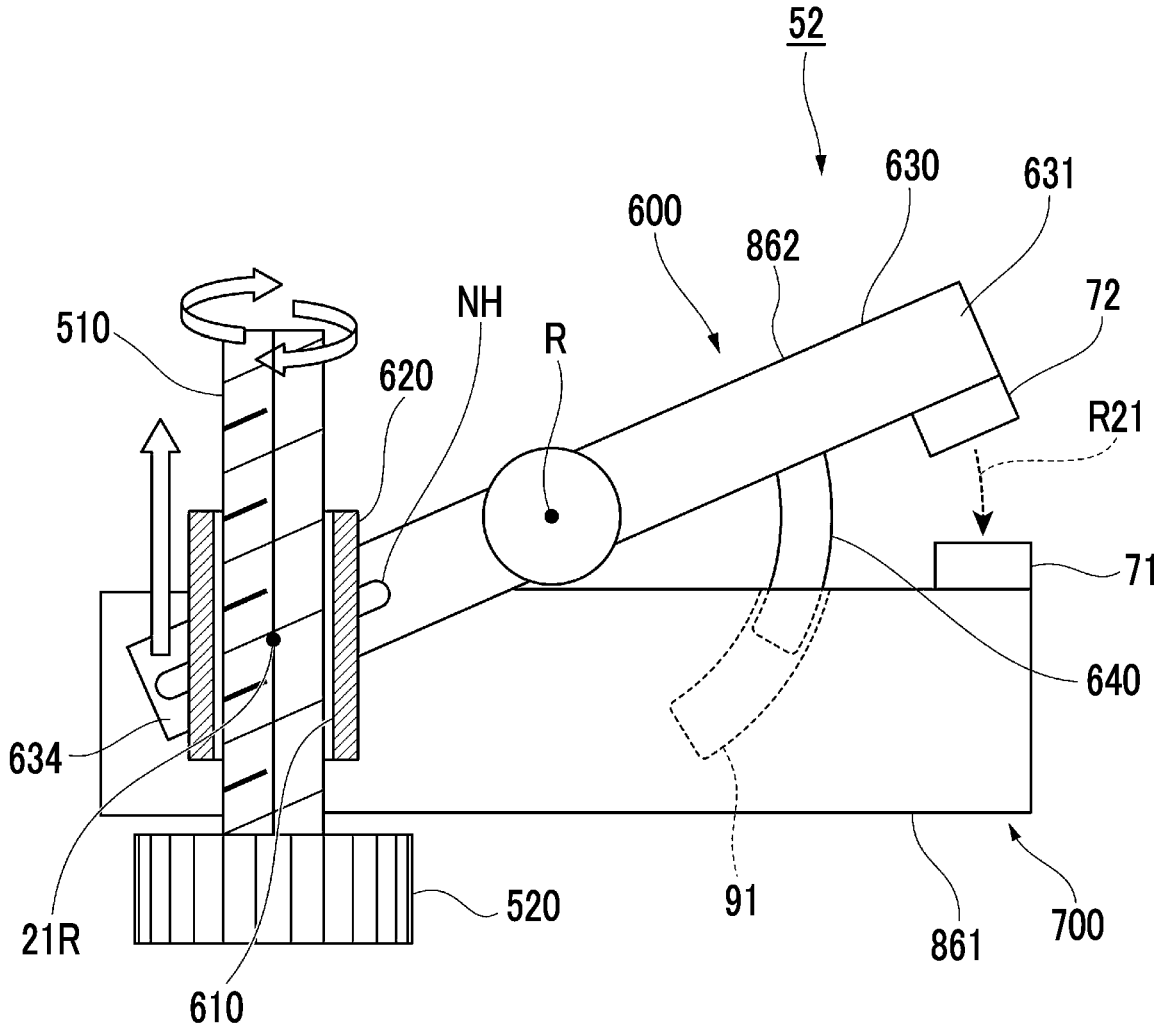
FIG. 21 is a diagram illustrating another configuration example of the second binding processing device.

FIG. 21 is a diagram illustrating another configuration example of the second binding processing device 52.

In the above, the case where the second binding teeth 72 moves along the linear movement route has been described, but the second binding teeth 72 may move along a movement route R21 having a curvature.

In the configuration example illustrated in FIG. 21, the upper support member 630 is configured to rotate about a rotation center R. Additionally, in this configuration example, the screw member 510 is connected to the other end part 634 of the upper support member 630, and the second binding teeth 72 are attached to the one end part 631 of the upper support member 630.

More specifically, in this configuration example, the load receiving member 620 is provided at the other end part 634 of the upper support member 630, and the second binding teeth 72 are attached to the one end part 631 of the upper support member 630.

The load receiving member 620 is provided with the female thread portion 610, similar to the above.

Additionally, the load receiving member 620 is rotatable with respect to the upper support member 630.

Specifically, the load receiving member 620 is rotatable about a rotation axis 21R extending in a direction orthogonal to the paper plane of FIG. 21.

Additionally, the upper support member 630 is provided with an elongated hole NH. The rotation axis 21R, which is the center of rotation of the load receiving member 620, is inserted into the elongated hole NH and is movable along the elongated hole NH. In other words, the load receiving member 620 is movable along the elongated hole NH.

In this configuration example, in a case where the screw member 510 rotates in the circumferential direction, the other end part 634 of the upper support member 630 moves in an extension direction of the screw member 510, and accordingly, the second binding teeth 72 advance and retreat with respect to the first binding teeth 71.

Accordingly, even in this configuration example, binding can be performed using the first binding teeth 71 and the second binding teeth 72.

Even in a case where the straight screw member 510 is used, there is a case where the second binding teeth 72 do not move along the linear movement route and follows the movement route R21 having a curvature as illustrated in FIG. 21.

Additionally, also in this configuration example illustrated in FIG. 21, a guide portion for guiding the interlocking portion 600 interlocking with the second binding teeth 72 is provided. Additionally, also in this configuration example, a guided portion provided in the interlocking portion 600 and guided by the guide portion is provided.

Specifically, also in this configuration example, the hole portion 91 is provided as the guide portion. Additionally, the rod-shaped member 640 that comes into contact with the inner surface of the hole portion 91 extending in the movement direction (movement route) of the interlocking portion 600 is provided as the guided portion.

In this configuration example, the rod-shaped member 640 is provided on the second binding teeth 72 side, and the hole portion 91 is provided on the first binding teeth 71 side. However, similar to the above, the hole portion 91 may be provided on the second binding teeth 72 side, and the rod-shaped member 640 may be provided on the first binding teeth 71 side.

Additionally, in the configuration example illustrated in FIG. 21, similar to the above, the upper support member 630 is formed by the second metal block 862, and the lower support member 700 is formed by the first metal block 861.

Other configuration examples will be further described. In the above, the configuration in which the screw member 510 is connected to the second binding teeth 72 side and the second binding teeth 72 moves has been described as an example, but a configuration in which the screw member 510 is connected to the first binding teeth 71 side and the first binding teeth 71 moves may be adopted.

Additionally, the screw member 510 may be provided corresponding to each of the first binding teeth 71 and the second binding teeth 72, and both the first binding teeth 71 and the second binding teeth 72 may be moved to perform the binding processing.

Additionally, in moving both the first binding teeth 71 and the second binding teeth 72, one common screw member 510 may be connected to the first binding teeth 71 and the second binding teeth 72. In this case, the one screw member 510 is rotated to bring the first binding teeth 71 and the second binding teeth 72 closer to each other and separate from each other.

In a case where one screw member 510 is used, the one screw member 510 is provided with a first thread portion in which a thread groove is directed in the clockwise direction and a second thread portion in which a thread groove is directed in the counterclockwise direction.

Then, in this case, for example, the first thread portion is used to move the first binding teeth 71, and the second thread portion is used to move the second binding teeth 72.

Figure 22:
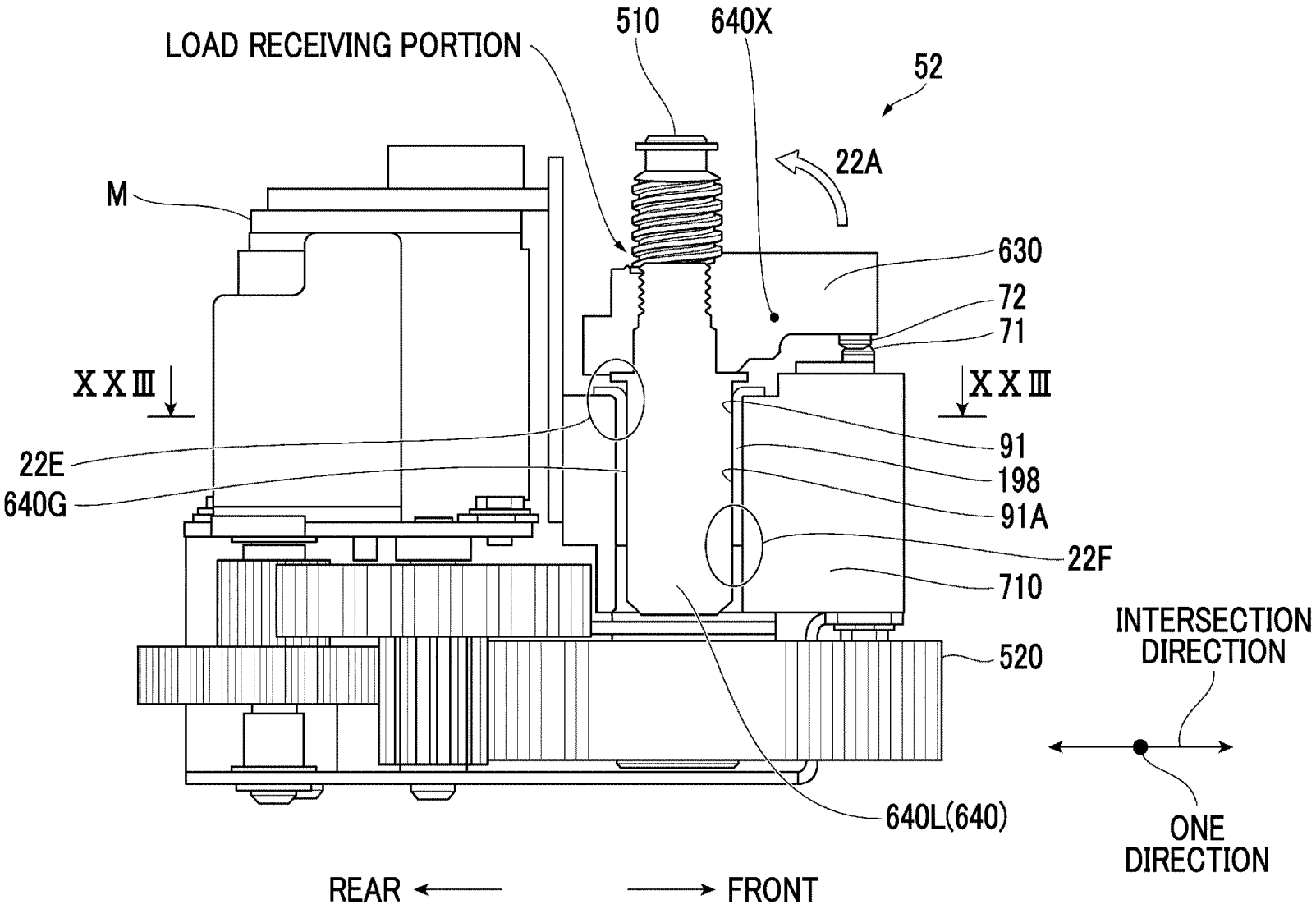
FIG. 22 is a vertical cross-sectional view of the second binding processing device at an installation point of the rod-shaped member and is a vertical cross-sectional view in a state where a paper bundle is pressed by first binding teeth and second binding teeth.

FIG. 22 is a vertical cross-sectional view of the second binding processing device 52 at the installation point of the rod-shaped member 640 (left rod-shaped member 640L) and is a vertical sectional view in a state in which the paper bundle T (not illustrated) is pressed by the first binding teeth 71 and the second binding teeth 72.

In the present exemplary embodiment, the convex portions are arranged in one direction in each of the first binding teeth 71 and the second binding teeth 72 (refer to FIGS. 4 and 5).

In FIG. 22, this one direction is a direction orthogonal to the paper plane of FIG. 22, and in each of the first binding teeth 71 and the second binding teeth 72, the convex portions are arranged in the direction orthogonal to the paper plane of FIG. 22.

In the following description, an intersection direction that intersects this one direction, which is an arrangement direction of the convex portions, is assumed.

In the present exemplary embodiment, the installation point of the load receiving portion in this intersection direction is different from the installation point of the first binding teeth 71 and the second binding teeth 72 in this intersection direction. In the present exemplary embodiment, the load receiving portion refers to a portion, which receives a load for moving the second binding teeth 72, in the portion interlocking the second binding teeth 72.

More specifically, in the present exemplary embodiment, the load receiving member 620 (refer to FIG. 4) is provided as an example of the load receiving portion, and the installation point of the load receiving member 620 and the installation points of the first binding teeth 71 and the second binding teeth 72 are different from each other.

In a case where the installation point of the load receiving portion and the installation point of the first binding teeth 71 and the second binding teeth 72 are different from each other and in a case where the paper bundle T is pressed by the first binding teeth 71 and the second binding teeth 72, the second binding teeth 72 receives a reaction force from the paper bundle T (not illustrated in FIG. 22), and the upper support member 630 tends to rotate in the counterclockwise direction as indicated by arrow 22A in FIG. 22.

Additionally, in this case, the rod-shaped member 640 also tends to rotate in the counterclockwise direction about a rotation center 640X.

In the present exemplary embodiment, in a case where the rod-shaped member 640 tends to rotate in the counterclockwise direction, accordingly, an outer peripheral surface 640G, which is an example of the outer surface of the rod-shaped member 640, is pushed against the inner peripheral surface 91A of the hole portion 91 at points indicated by reference numerals 22E and 22F in FIG. 22.

In addition, in the present exemplary embodiment, regarding the hole portion 91, the rod-shaped member 640, the first binding teeth 71, and the second binding teeth 72, the installation points of the hole portion 91 and the rod-shaped member 640 in the intersection direction and the installation points of the first binding teeth 71 and the second binding teeth 72 in the intersection direction are different from each other.

Figure 23:
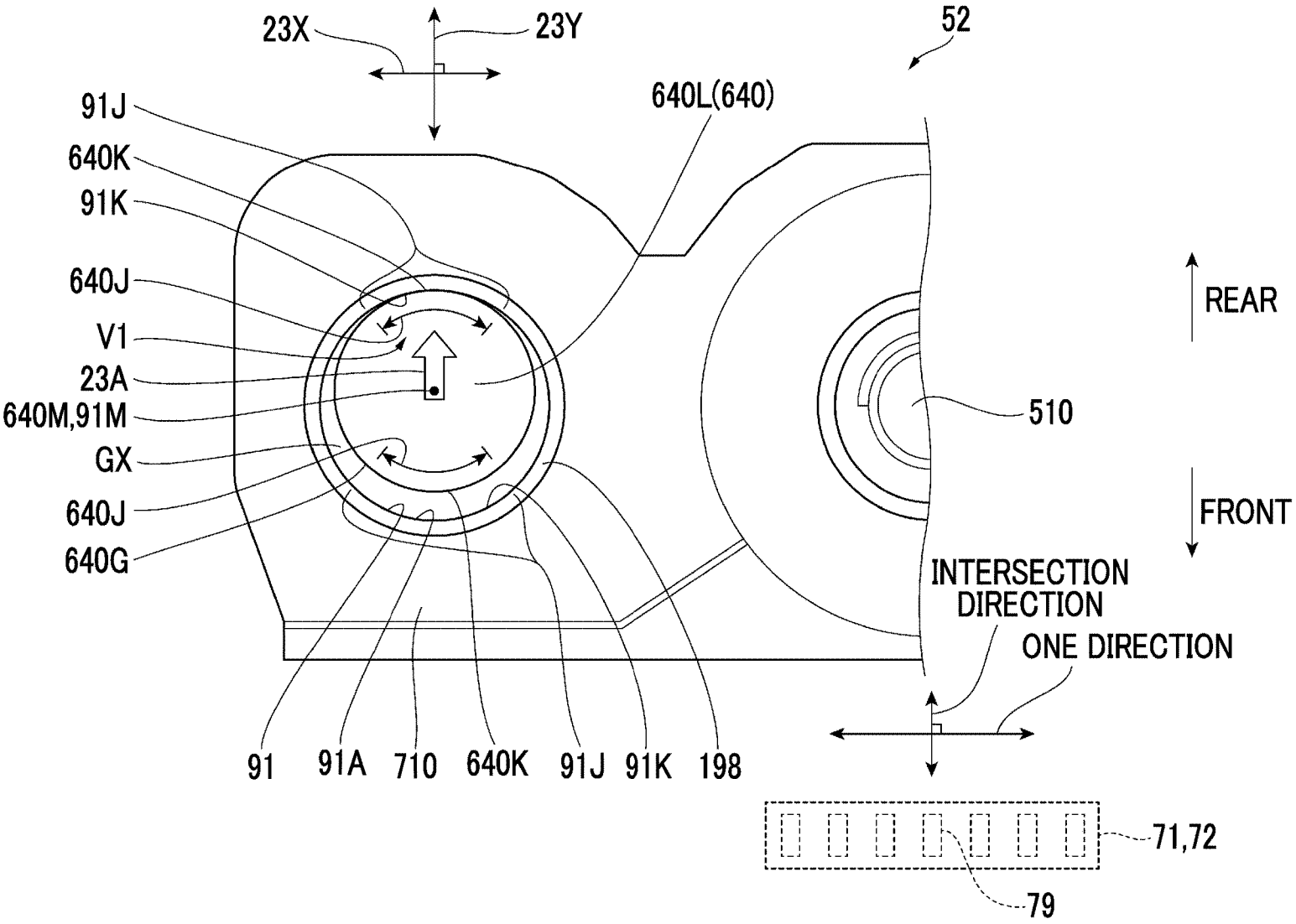
FIG. 23 is a cross-sectional view of the second binding processing device taken along line XXIII-XXIII in FIG. 22.

FIG. 23 is a cross-sectional view of the second binding processing device 52 taken along line XXIII-XXIII in FIG. 22. In other words, FIG. 23 illustrates a cross-sectional view of the second binding processing device 52 at a point where the outer peripheral surface 640G of the rod-shaped member 640 is pushed against the inner peripheral surface 91A of the hole portion 91. Additionally, FIG. 23 illustrates the state of the second binding processing device 52 in a virtual plane orthogonal to the axial direction of the rod-shaped member 640.

In addition, the first binding teeth 71, the second binding teeth 72, and the screw member 510 are altogether illustrated in FIG. 23.

In the present exemplary embodiment, the hole portion 91 is provided, and the rod-shaped member 640 is inserted into the hole portion 91. In the present exemplary embodiment, the outer peripheral surface 640G of the rod-shaped member 640 is guided by the inner peripheral surface 91A of the hole portion 91.

In the present exemplary embodiment, the outer diameter of the rod-shaped member 640 is smaller than the inner diameter of the hole portion 91, and a gap GX is present between the inner peripheral surface 91A of the hole portion 91 and the outer peripheral surface 640G of the rod-shaped member 640.

In the present exemplary embodiment, as described above, in a case where the paper bundle T is pressed by the first binding teeth 71 and the second binding teeth 72, as indicated by arrow 23A in FIG. 23, the inner peripheral surface 91A of the hole portion 91 is pushed against the outer peripheral surface 640G of the rod-shaped member 640.

In this case, even in a case where the rod-shaped member 640 tends to move in the direction indicated by arrow 23X in the drawing, this movement is restricted. In other words, in this case, even in a case where the rod-shaped member 640 tends to move in the above one direction that is the arrangement direction of the convex portions 79 provided on the first binding teeth 71 and the second binding teeth 72, this movement is restricted.

In the present exemplary embodiment, the rod-shaped member 640 is pressed against a valley portion V1 formed by the inner peripheral surface 91A of the hole portion 91, and the movement in one direction is restricted. In the present exemplary embodiment, even in a case where the rod-shaped member 640 tends to move in the above one direction, the inner peripheral surface 91A is located on the downstream side in this one direction, and this movement is restricted. In other words, in the present exemplary embodiment, the movement of the rod-shaped member 640 in the longitudinal direction of the first binding teeth 71 and the second binding teeth 72 is restricted.

Accordingly, in the present exemplary embodiment, the movement of the second binding teeth 72 in the longitudinal direction of the first binding teeth 71 and the second binding teeth 72 are restricted, and thereby, the poor binding of the paper bundle T is less likely to occur.

Figure 24:
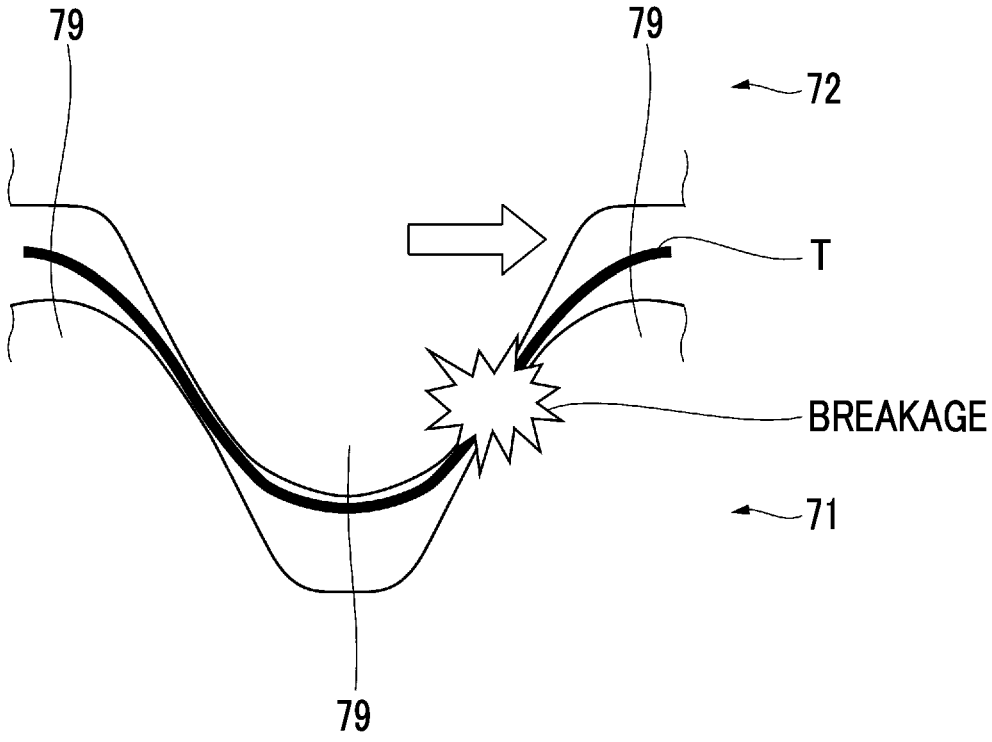
FIG. 24 is a view in a case where a part of the first binding teeth and a part of the second binding teeth are viewed from the front.

In the present exemplary embodiment, in a case where the paper bundle T is pressed by the first binding teeth 71 and the second binding teeth 72, as illustrated in FIG. 24 (a view in a case where a part of the first binding teeth 71 and a part of the second binding teeth 72 are viewed from the front), the paper bundle T may be broken. In this case, a reaction force acting on the second binding teeth 72 may be reduced, and the second binding teeth 72 may move toward a side where the break has occurred.

In this case, in a case where a configuration is adopted such that the movement of the second binding teeth is restricted as in the present exemplary embodiment, the movement of the second binding teeth 72 caused by this breakage in the paper bundle T is restricted. In this case, deterioration of the binding quality caused by the movement of the second binding teeth 72 may be suppressed.

In FIG. 23, the direction indicated by the arrow 23X is one direction that is the arrangement direction of the convex portions 79 provided on each of the first binding teeth 71 and the second binding teeth 72. Additionally, a direction indicated by arrow 23Y is the intersection direction intersecting this one direction.

In the present exemplary embodiment, a portion 91J facing the intersection direction is present on a part of the inner peripheral surface 91A of the hole portion 91. In the present exemplary embodiment, the portion 91J facing the intersection direction is provided with a bulging surface 91K having a curvature and bulging in a direction away from an axis 91M of the hole portion 91.

The bulging surface 91K is not limited to the entire region of the portion 91J facing the intersection direction and may be provided in a part thereof. In other words, the bulging surface 91K is not limited to being provided in the entire region of the hole portion 91 axial direction but may be provided in a part of the hole portion 91 in the axial direction.

More specifically, for example, the bulging surface 91K may be provided only at a point, on the inner peripheral surface 91A of the hole portion 91, against which the outer peripheral surface 640G of the rod-shaped member 640 is pushed, like the portions indicated by reference numerals 22E and 22F in FIG. 22.

Additionally, in the present exemplary embodiment, as illustrated in FIG. 23, a portion 640J facing the intersection direction is also present on the outer peripheral surface 640G of the rod-shaped member 640.

In the present exemplary embodiment, the bulging surface 640K of the rod-shaped member 640 having a curvature and bulging in the direction away from an axis 640M of the rod-shaped member 640 is provided on the portion 640J of the rod-shaped member 640 facing the intersection direction and facing the above bulging surface 91K.

In addition, similar to the above, the bulging surface 640K is not limited to the entire region of the portion 640J facing the intersection direction and may be provided in a part thereof.

In other words, the bulging surface 640K may be provided not only in the entire region of the rod-shaped member 640 in the axial direction but also in a part of the rod-shaped member 640 in the axial direction.

More specifically, the bulging surface 640K may be provided only at the point of the rod-shaped member 640 that is pressed against the inner peripheral surface 91A of the hole portion 91, like the portions indicated by reference numerals 22E and 22F in FIG. 22.

In the present exemplary embodiment, in a case where the paper bundle T is sandwiched between the first binding teeth 71 and the second binding teeth 72, the two provided bulging surfaces 91K and 640K face each other. Moreover, the bulging surface 640K provided in the rod-shaped member 640 enters the valley portion V1 formed by the bulging surface 91K provided as a part of the inner peripheral surface 91A of the hole portion 91.

Accordingly, in the present exemplary embodiment, as described above, the movement of the rod-shaped member 640 and the second binding teeth 72 is restricted, and the deterioration of the binding quality of the paper bundle T is suppressed.

In addition, in the present exemplary embodiment, the outer diameter of the rod-shaped member 640 is smaller than the inner diameter of the hole portion 91, and the curvature of the bulging surface 640K provided on the rod-shaped member 640 is larger than the curvature of the bulging surface 91K provided on the inner peripheral surface 91A of the hole portion 91.

Here, the movement of the second binding teeth 72 can be restricted, for example, by making the gap GX between the rod-shaped member 640 and the inner peripheral surface 91A of the hole portion 91 smaller. Meanwhile, in this case, problems may occur such that it is necessary to further improve the dimensional accuracy of each part or the sliding resistance between the rod-shaped member 640 and the inner peripheral surface 91A of the hole portion 91 increases.

In contrast, in the configuration of the present exemplary embodiment, in a case where the paper bundle T is pressed by the first binding teeth 71 and the second binding teeth 72 while increasing the gap GX between the rod-shaped member 640 and the inner peripheral surface 91A of the hole portion 91, the movement of the second binding teeth 72 is restricted.

In this case, the movement of the second binding teeth 72 can be restricted while suppressing the increase in the sliding resistance.

In addition, in restricting the movement of the second binding teeth 72, it is desired to increase the pressing force of the rod-shaped member 640 against the inner peripheral surface 91A of the hole portion 91.

In order to increase this pressing force, it is desired to adopt the form illustrated in FIGS. 13 and 22 rather than the form illustrated in FIG. 6.

That is, it is desired to have a form in which the rod-shaped member 640 interlocks with the moving second binding teeth 72 rather than a form in which the rod-shaped member 640 does not interlock with the moving second binding teeth 72.

In the form where the rod-shaped member 640 interlocks with the moving second binding teeth 72, as illustrated in FIG. 22, the portion of the rod-shaped member 640 located at a point greatly away from the rotation center 640X of the rod-shaped member 640 and located by reference numeral 22F is pressed against the inner peripheral surface 91A of the hole portion 91.

In other words, in this case, the separation distance between the point of the rod-shaped member 640 that is pressed against the inner peripheral surface 91A and the rotation center 640X of the rod-shaped member 640 can be made larger.

In this case, the pressing force in a case where the rod-shaped member 640 is pressed against the inner peripheral surface 91A can be increased as compared to a case where the separation distance is smaller.

As illustrated in FIG. 6, in the configuration in which the rod-shaped member 640 does not interlock with the moving second binding teeth 72 and the rod-shaped member 640 guides the interlocking portion 600, a configuration for increasing the separation distance is not easily adopted.

In the form illustrated in FIG. 23, the case where the cross-sectional shape of the hole portion 91 and the cross-sectional shape of the rod-shaped member 640 are circular has been described as an example, but the cross-sectional shape is not limited to the circular shape and may be a non-circular shape such as an elliptical shape.

Additionally, it is not necessary that all portions of the entire region of the hole portion 91 and the rod-shaped member 640 in the axial direction are not necessarily circular or elliptical, and as described above, only points, which come into contact with each other and are pressed against each other, of the inner peripheral surface 91A of the hole portion 91 and the outer peripheral surface 640G of the rod-shaped member 640, may be a circular shape or an elliptical shape.

In other words, it is not necessary to provide the above bulging surfaces 91K and 640K over the entire region of the hole portion 91 and the rod-shaped member 640 in the axial direction, and the above bulging surfaces 91K and 640K may be provided only at the points that come into contact with each other and are pressed against each other, of the inner peripheral surface 91A of the hole portion 91 and the outer peripheral surface 640G of the rod-shaped member 640.

In addition, in the present exemplary embodiment, as described above and as illustrated in FIG. 23, the cylindrical member 198 is provided, and in FIG. 23, the hole portion 91 is a space inside the cylindrical member 198. Additionally, the inner peripheral surface 91A of the hole portion 91 is an inner peripheral surface of the cylindrical member 198.

In the present exemplary embodiment, grease is not applied to the inner peripheral surface of the cylindrical member 198.

In a configuration in which the grease is applied, in a case where the grease is solidified, the solidified grease may adhere to the valley portion V1 and the entering of the rod-shaped member 640 into the valley portion V1 is hindered.

In the configuration in which no grease adheres as in the present exemplary embodiment, the adhesion of the solidified grease to the valley portion V1 is suppressed, and the rod-shaped member 640 enters the valley portion V1 more reliably.

Additionally, in the configuration in which the grease is applied, in a case where the grease is solidified, the rod-shaped member 640 may be tilted due to the influence of the solidified grease. In a case where the rod-shaped member 640 is tilted, the positional relationship between the first binding teeth 71 and the second binding teeth 72 may change, which leads to the deterioration of binding processing performance.

In contrast, in the configuration in which the grease is not made to adhere, the rod-shaped member 640 is less likely to be unintentionally inclined, and the deterioration of the binding processing performance is suppressed.

Additionally, in the present exemplary embodiment, at least the inner peripheral surface of the cylindrical member 198 is processed with Teflon (registered trademark), and in the present exemplary embodiment, the slip between the cylindrical member 198 and the rod-shaped member 640 is likely to occur due to this Teflon processing.

In other words, in the present exemplary embodiment, at least the inner peripheral surface of the cylindrical member 198 is surface-coated with polytetrafluoroethylene, and the slip between the cylindrical member 198 and the rod-shaped member 640 is likely to slip due to the surface-coating.

In addition, as described above, the hole portion 91 may be provided directly in the lower support member 700 without installing the cylindrical member 198. Additionally, the Teflon processing may be performed on the inner peripheral surface 91A of the hole portion 91 directly provided in the lower support member 700 (refer to FIG. 15).

Moreover, in the present exemplary embodiment, the size of the gap GX in the above one direction (the arrangement direction of the convex portions 79 provided on the first binding teeth 71 and the second binding teeth 72) is smaller than the thickness of the maximum number of recording material bundles T in which the binding processing can be performed by the second binding processing device 52.

Here, the "maximum number of sheets" does not mean the maximum number of sheets that can be actually processed by the second binding processing device 52 but refers to a rated value described in a specification, a manual, or the like.

Figure 25:
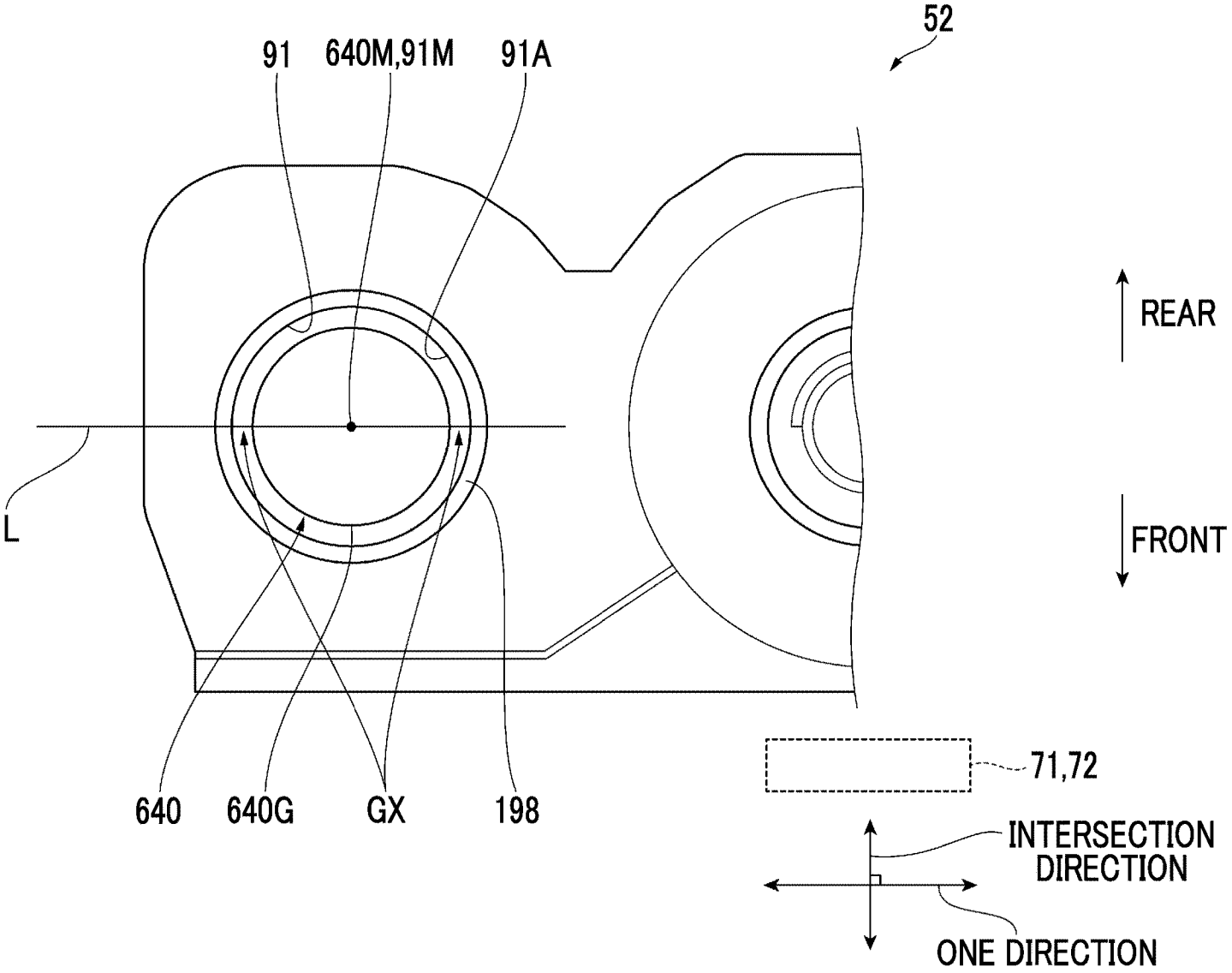
FIG. 25 is a cross-sectional view of the second binding processing device.

Additionally, as illustrated in FIG. 25 (a cross-sectional view of the second binding processing device 52), the "size of the gap GX in one direction" refers to the size of the gap GX between the outer peripheral surface 640G of the rod-shaped member 640 and the inner peripheral surface 91A of the hole portion 91 in a case where the rod-shaped member 640 is disposed in a state in which the axis 640M of the rod-shaped member 640 and the axis 91M of the hole portion 91 coincide with each other.

More specifically, the "size of the gap GX in one direction" refers to the size of the gap GX on the straight line L extending in the above one direction through the axis 640M of the rod-shaped member 640. More specifically, the "size of the gap GX in one direction" refers to the size of the gap GX in a case where the sizes of the gaps GX generated on both sides of the rod-shaped member 640 are added together.

In the present exemplary embodiment, the size of the gap GX in a case where the axis 640M of the rod-shaped member 640 and the axis 91M of the hole portion 91 coincide with each other, and the size of the gap GX in a case where the sizes of the gaps GX generated on both sides of the rod-shaped member 640 on the straight line L are added together is smaller than the thickness of the above maximum number of sheets of recording material bundles T.

In the present exemplary embodiment, in the maximum number of recording material bundles T, as illustrated in FIG. 24, in a case where the breakage of the paper bundle T has occurred, a situation where the second binding teeth 72 move greatly is likely to occur.

In this case, in a case where the size of the gap GX in one direction is smaller than the thickness of the maximum number of recording material bundles T as in the present exemplary embodiment, even in a case where the second binding teeth 72 tends to move with the breakage of the paper bundle T, this movement of the second binding teeth 72 is likely to be restricted.

In this case, for example, a situation where the second binding teeth 72 come into contact with the first binding teeth 71 is less likely to occur, and a situation where the binding quality deteriorates greatly is suppressed.

In addition, an example of a form regarding the dimensions and the like of each part is as follows.

In a case where the arrangement interval (pitch) of the convex portions 79 of the first binding teeth 71 and the second binding teeth 72 are "1.0 to 3.0 mm", Outer diameter of rod-shaped member 640: 10 to 20 mm Inner diameter of hole portion 91: 10.03 to 20.2 mm The "size of the gap GX in one direction (the size of the gap GX in a case where the sizes of the gaps GX generated on both sides of the rod-shaped member 640 on the straight line L are added together)": 0.03 to 0.2 m.

Additionally, the respective configurations described above are not limited to the above-described exemplary embodiment and the modification examples thereof and can be changed without departing from the spirit. In other words, it should be understood that various changes in form and details are possible without departing from the spirit and scope of the claims.

For example, some of the respective configurations described above may be omitted, or other functions may be added to the respective configurations described above.

Additionally, although the plurality of exemplary embodiments have been described above, the configuration included in one exemplary embodiment and the configuration included in another exemplary embodiment may be replaced with each other, or the configuration included in one exemplary embodiment may be added to another exemplary embodiment.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. The recording material processing apparatus comprising:

first teeth that are used for binding processing of a recording material bundle;

second teeth that move toward the first teeth and press the recording material bundle located between the first teeth and the second teeth;

a guide portion that guides an interlocking portion interlocking with the second teeth, wherein the interlocking portion is in physical contact with the second teeth; and a guided portion that is provided in the interlocking portion and guided by the guide portion, wherein one of the guide portion and the guided portion includes a hole, and the other includes a rod-shaped portion that extends in a movement direction of the interlocking portion and comes into contact with an inner surface of the hole.

2. The recording material processing apparatus according to claim 1, wherein the hole extends in the movement direction of the interlocking portion, and wherein the interlocking portion includes a recess portion that accommodates the second teeth.

3. The recording material processing apparatus according to claim 1, wherein a contact area between the guide portion and the guided portion increases as the second teeth move toward the first teeth.

4. The recording material processing apparatus according to claim 1, wherein a plurality of each of the guide portion and the guided portion are provided.

5. The recording material processing apparatus according to claim 1, wherein the guided portion provided in the interlocking portion is the rod-shaped portion, and the guide portion is the hole that guides an outer surface of the rod-shaped portion.

6. The recording material processing apparatus of claim 1, wherein at least two guided portions including a first guided portion and a second guided portion are provided as the guided portion provided in the interlocking portion, and the second teeth are located closer to the second guided portion side than the first guided portion and are located closer to the first guided portion side than the second guided portion.

7. The recording material processing apparatus of claim 1, wherein the second teeth move toward the first teeth by a load being applied to a load receiving portion of the interlocking portion, at least two guided portions including a first guided portion and a second guided portion are provided as the guided portion provided in the interlocking portion, and the load receiving portion is located closer to the second guided portion side than the first guided portion and is located closer to the first guided portion side than the second guided portion.

8. The recording material processing apparatus according to claim 7, wherein in a case where the first guided portion, the second guided portion, and the load receiving portion are projected toward an upstream side or a downstream side in the movement direction of the second teeth, the load receiving portion is located between the first guided portion and the second guided portion.

9. The recording material processing apparatus according to claim 1, wherein at least two guided portions including a first guided portion and a second guided portion are provided as the guided portion provided in the interlocking portion, and in a case where the first guided portion, the second guided portion, and the second teeth are projected toward an upstream side or a downstream side in the movement direction of the second teeth, the second teeth are located at a point deviated from between the first guided portion and the second guided portion.

10. The recording material processing apparatus according to claim 9, wherein in a case where the first guided portion, the second guided portion, and the second teeth are projected toward the upstream side or the downstream side in the movement direction of the second teeth, the second teeth are located closer to the second guided portion side than the first guided portion and located closer to the first guided portion side than the second guided portion.

11. The recording material processing apparatus according to claim 10, wherein the second teeth move toward the first teeth by a load being applied to a load receiving portion of the interlocking portion, and in a case where the first guided portion, the second guided portion, the second teeth, and the load receiving portion are projected toward the upstream side or the downstream side in the movement direction of the second teeth, the load receiving portion is located closer to a side where the first guided portion and the second guided portion are provided, than the second teeth.

12. The recording material processing apparatus according to claim 11, wherein in a case where the first guided portion, the second guided portion, the second teeth, and the load receiving portion are projected toward the upstream side or the downstream side in the movement direction of the second teeth, the load receiving portion is located between the first guided portion and the second guided portion.

13. The recording material processing apparatus according to claim 1, wherein at least two guided portions including a first guided portion and a second guided portion are provided as the guided portion provided in the interlocking portion, and in a case where the first guided portion, the second guided portion, and the second teeth are projected toward an upstream side or a downstream side in the movement direction of the second teeth, the second teeth are located between the first guided portion and the second guided portion.

14. The recording material processing apparatus according to claim 1, further comprising:

a connecting member that is connected to the interlocking portion and applies a load for moving the second teeth to the interlocking portion, wherein the connecting member is located on a perpendicular bisector with respect to a line segment connecting one end and the other end of the second teeth in a longitudinal direction of the second teeth, and a separation distance between the second teeth and the connecting member on the perpendicular bisector is equal to or less than a size of a margin at a corner portion of a recording material constituting the recording material bundle.

15. The recording material processing apparatus according to claim 1, wherein convex portions are arranged in one direction in the first teeth and the second teeth, the second teeth moves toward the first teeth by a load being applied to a load receiving portion of the interlocking portion, and an installation point of the load receiving portion in an intersection direction, which is a direction intersecting the one direction that is an arrangement direction of the convex portions, and an installation point of the first teeth and the second teeth in the intersection direction are different from each other.

16. The recording material processing apparatus according to claim 15, wherein at least a part of a portion of the inner surface of the hole facing the intersection direction is provided with a bulging surface that has a curvature and bulges toward a direction away from an axis of the hole.

17. The recording material processing apparatus according to claim 16, wherein at least a part of a portion of an outer surface of the rod-shaped portion facing the intersection direction and facing the bulging surface is provided with a bulging surface that has a curvature and bulges toward a direction away from an axis of the rod-shaped portion.

18. The recording material processing apparatus according to claim 1, wherein convex portions are arranged in one direction in the first teeth and the second teeth, a gap is provided between the inner surface of the hole and an outer surface of the rod-shaped portion, and a size of the gap in the one direction is smaller than a thickness of a maximum number of recording material bundles capable of being subjected to binding processing by the recording material processing apparatus.

19. An image forming system comprising:

an image forming apparatus that forms an image on a recording material; and a recording material processing apparatus that performs binding processing on a recording material bundle including a plurality of sheets of recording materials on which the image is formed by the image forming apparatus, wherein the recording material processing apparatus is constituted by the recording material processing apparatus according to claim 1.

20. An image forming system comprising:

an image forming apparatus that foil is an image on a recording material; and a recording material processing apparatus that performs binding processing on a recording material bundle including a plurality of sheets of recording materials on which an image is formed by the image forming apparatus, wherein the recording material processing apparatus is constituted by the recording material processing apparatus according to claim 2.

* * * * *